US007308223B2

(12) United States Patent
Kurosu

(10) Patent No.: US 7,308,223 B2
(45) Date of Patent: Dec. 11, 2007

(54) METHOD, DEVICE AND IMAGE FORMING APPARATUS FOR DEVELOPING AN IMAGE USING A TWO-COMPONENT DEVELOPING AGENT

(75) Inventor: Hisao Kurosu, Kanagawa-ken (JP)

(73) Assignee: Ricoh Co., Ltd., Tokyo (JP)

( * ) Notice: Subject to any disclaimer, the term of this patent is extended or adjusted under 35 U.S.C. 154(b) by 510 days.

(21) Appl. No.: 10/787,729

(22) Filed: Feb. 27, 2004

(65) Prior Publication Data

US 2004/0229152 A1 Nov. 18, 2004

(30) Foreign Application Priority Data

Feb. 28, 2003 (JP) ..... 2003-054120
Oct. 16, 2003 (JP) ..... 2003-356210

(51) Int. Cl.
*G03G 15/09* (2006.01)

(52) U.S. Cl. ..... 399/267; 399/277

(58) Field of Classification Search ..... 399/157, 399/267, 274–277
See application file for complete search history.

(56) References Cited

U.S. PATENT DOCUMENTS 4,866,474 A * 9/1989 Kinoshita et al. ..... 399/157
6,708,015 B2 3/2004 Kurosu et al.
7,027,760 B2 * 4/2006 Enoki ..... 399/267
2002/0146632 A1 10/2002 Kurosu et al.

FOREIGN PATENT DOCUMENTS

| | | |
|---|---|---|
| JP | 5-46014 | 2/1993 |
| JP | 6-208304 | 7/1994 |
| JP | 7-319174 | 12/1995 |
| JP | 2668781 | 10/1997 |
| JP | 11-161028 | 6/1999 |

* cited by examiner

*Primary Examiner*—William J. Royer
(74) *Attorney, Agent, or Firm*—Oblon, Spivak, McClelland, Maier & Neustadt, P.C.

(57) ABSTRACT

A developing agent carrying member including magnets is disposed facing an image carrying member, a two-component developing agent containing toner and magnetic carrier is carried in a form of a layer on a surface of the developing agent carrying member, speed difference is generated between the developing agent carrying member and the magnets so as to cause a magnetic brush to flow while forming the magnetic brush on a developing agent layer at least in a facing region where the developing agent carrying member and the image carrying member face one another, and free toner separated from magnetic carrier in a flow of the magnetic brush adheres onto a latent image formed on the image carrying member, whereby developing is performed. A line-shaped latent image is developed with the toner starting from a middle portion thereof in a width direction of the line-shaped latent image.

61 Claims, 23 Drawing Sheets

METHOD, DEVICE AND IMAGE FORMING APPARATUS FOR DEVELOPING AN IMAGE USING A TWO-COMPONENT DEVELOPING AGENT

BACKGROUND OF THE INVENTION

1. Field of the Invention

The present invention relates to a developing method employing electrophotography, which can be applied to electrostatic image formation performed by photocopiers, printers, facsimile apparatuses, or the like., and relates to a developing device and an image forming apparatus using the developing method.

2. Description of the Related Art

Presently, with image forming apparatuses such as photocopiers, printers, facsimile apparatuses, or the like, a toner image is formed by an image carrying member (which will be referred to as a "photosensitive member" hereafter) including a photosensitive layer having photoconductivity on the surface, and a developing device storing a developing agent. In general, a two-component developing agent (which will be simply referred to as a "developing agent" hereafter) mainly formed of toner and magnetic carrier is employed for the developing device because it makes color image formation easy. The developing agent is mixed and stirred within the developing device so as to be charged due to friction. The toner electrostatically adheres to the surface of the magnetic carrier due to electrostatic charge. The magnetic carrier having the toner adhered to the surface thereof is magnetically attracted onto the surface of a developing agent carrying member (which will be referred to as a "developing sleeve" hereafter) including a magnet. Subsequently, the magnetic carrier is transported due to rotation of the developing sleeve.

The developing sleeve contains a magnet (which will be referred to as a "developing main magnet" hereafter) at a position which is the closest to the photosensitive member. The closer to the developing main magnet the transported developing agent is, the greater the number of magnetic carrier particles in the developing agent which forms chain along the magnetic lines of force is. The great number of chains looks like a brush, so, in general, are also referred to as a "magnetic brush, and the developing method using the magnetic brush is referred to as "magnetic-brush developing".

It is assumed that with the magnetic-brush developing, the magnetic carrier serving as a dielectric substance increases the electric field strength generated at a gap between the photosensitive member and the developing sleeve, and the toner is transferred from the surfaces of the magnetic carrier particles positioned at the tips of the chains of the magnetic brush to the photosensitive member due to the increased electric field strength. Accordingly, with the conventional magnetic-brush developing, developing with toner is performed only at a portion where the magnetic brush is generated. Accordingly, the magnetic-brush developing with toner is performed using only a limited portion, leading to difficulty in performing developing with a large amount of toner while adjusting other conditions.

However, developing methods for obtaining a high-density image using the limited region have been proposed.

Japanese Patent No. 2,668,781, for example, describes a developing method that uses both of toner particles carried on the brush chains of magnetic particles and toner particles carried on the developing agent carrying member for development by using an alternating electric field. With the developing method using the alternating electric field, it is known that the toner which has temporarily adhered to the photosensitive member hops therearound, moves to a position around the middle portion of a dot or line, which is positioned deep within a latent image, and is fixed, thereby obtaining a smooth image without edge effects.

Further, another developing method is proposed that the toner is carried by the photosensitive member, following which excessive toner is removed, in order to obtain a high-density image with low fogging. For example, each of Published Japanese patent application Nos. 6-208304 and 7-319174 describes a developing device wherein the magnetic toner carried on the surface of an electrostatic latent image carrying member including a magnet is brought into contact with an electrode roller including a magnet, thereby removing excessive toner which adheres to portions other than the latent image portions.

Published Japanese patent application No. 5-46014 describes a developing device in which a first developing roller develops a latent image, and then a second developing roller supplied only with magnetic carrier particles removes excess toner particles.

However, the above-described proposed developing methods limit a developing region to a region where the magnetic carrier particles or the like come into contact with the photosensitive member. It is therefore difficult to achieve sufficiently high image density only with the toner particles carried on the chains of the magnetic carrier particles and the toner carried on the developing sleeve. Further, an electrode effect cannot easily implement a smooth high-quality image with high uniformity of a solid portion because the number of chains formed of the magnetic carrier particles or the like is small.

Accordingly, with the conventional developing devices, a developing agent with high-density toner is used so as to increase uniformity of a solid portion. However, in this case, developing is performed with an excessively high performance in a normal state, leading to a new problem that the horizontal/vertical ratio of a line may greatly deviate from 1. The horizontal/vertical ratio used here means the width of the line in the main-scanning direction as to the width of the line in the sub-scanning direction orthogonal to the main scanning direction.

As a method for obtaining a high-quality image which exhibits high image density in a solid portion, U.S. patent application Publication No. 2002-0146632A1 describes a developing method wherein a developing agent carrying member including a magnet is disposed opposite to an image carrying member, a two-component developing agent containing a toner and magnetic carrier is carried on the surface of the developing agent carrying member, a magnetic brush is formed at least in a region where the developing agent carrying member faces the image carrying member while causing the magnetic brush to flow by rotating the developing agent carrying member and the magnet with difference in speed, and free toner, which parts from the magnetic carrier particles in the flow, adheres to a latent image on the surface of the image carrying member, and thereby a toner image is formed. However, there is no mention of any method for obtaining an image without edge effects.

Thus, it is desirable to provide a developing method for obtaining a smooth high-quality image with high uniformity of image density on a solid portion without edge effects while suppressing the deviation of the horizontal/vertical ratio at a portion other than the solid portion.

It is further desirable to provide a developing device and an image forming apparatus using the developing method.

SUMMARY OF THE INVENTION

According to one aspect of the present invention, a method of developing a latent image including a line-shaped latent image formed on an image carrying member with a two-component developing agent containing toner and magnetic carrier, includes carrying the two-component developing agent on a developing agent carrying member, which is disposed facing the image carrying member, in a form of a layer; causing the magnetic carrier not to contact the image carrying member; and developing the line-shaped latent image with the toner starting from a middle portion of the line-shaped latent image in a width direction of the line-shaped latent image.

According to another aspect of the present invention, a method of developing a latent image including a line-shaped latent image formed on an image carrying member with a two-component developing agent containing toner and magnetic carrier, includes preparing a developing agent carrying member facing the image carrying member and including at least one magnetic field generating device to carry the two-component developing agent on the developing agent carrying member in a form of a layer; forming a magnetic brush including the magnetic carrier holding the toner on the layer of the two-component developing agent at least in a facing region where the developing agent carrying member and the image carrying member face one another and causing the magnetic brush to flow by making a speed difference between the developing agent carrying member and the at least one magnetic field generating device; separating the toner from the magnetic carrier; and developing the line-shaped latent image with the toner separated from the magnetic carrier starting from a middle portion of the line-shaped latent image in a width direction of the line-shaped latent image.

According to another aspect of the present invention, a developing device that develops a latent image including a line-shaped latent image formed on an image carrying member with a two-component developing agent containing toner and magnetic carrier, includes a developing agent carrying member configured to carry the two-component developing agent in a form of a layer, the developing agent carrying member being disposed facing the image carrying member; and at least one magnetic field generating device configured to generate a magnetic field, the at least one magnetic field generating device being provided in the developing agent carrying member. The magnetic carrier does not contact the image carrying member, and the line-shaped latent image is developed with the toner starting from a middle portion of the line-shaped latent image in a width direction of the line-shaped latent image.

According to another aspect of the present invention, a developing device that develops a latent image including a line-shaped latent image formed on an image carrying member with a two-component developing agent containing toner and magnetic carrier, includes a developing agent carrying member configured to carry the two-component developing agent in a form of a layer, the developing agent carrying member being disposed facing the image carrying member; and at least one magnetic field generating device configured to generate a magnetic field, the at least one magnetic field generating device being provided in the developing agent carrying member. A speed difference is made between the developing agent carrying member and the at least one magnetic field generating device so as to form a magnetic brush including the magnetic carrier holding the toner on the layer of the two-component developing agent at least in a facing region where the developing agent carrying member and the image carrying member face one another and to cause the magnetic brush to flow. The toner is separated from the magnetic carrier in a flow of the magnetic brush, and the line-shaped latent image is developed with the toner separated from the magnetic carrier starting from a middle portion of the line-shaped latent image in a width direction of the line-shaped latent image.

According to another aspect of the present invention, an image forming apparatus includes an image carrying member configured to carry a latent image including a line-shaped latent image, and the above-described developing device.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1A:
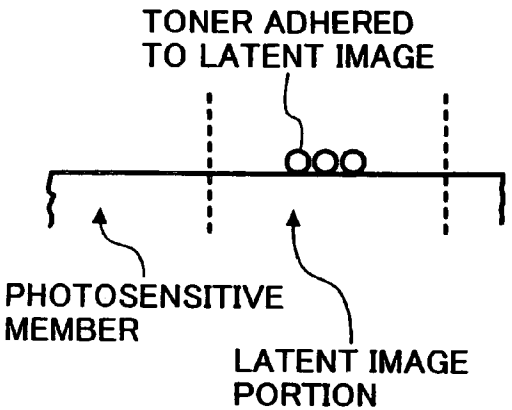
FIGS. 1A-1C are schematic explanatory diagrams for describing steps of toner developing according to the embodiment of the present invention.

Preferred embodiments of the present invention are described in detail referring to the drawings, wherein like reference numerals designate identical or corresponding parts throughout the several views.

In a developing method according to the embodiments of the present invention, a magnetic carrier on the surface of a developing agent carrying member is not in contact with an image carrying member, and developing is performed such that a line-shaped latent image is filled in with toner from the middle portion in its width direction toward its edges.

[1] Developing Step for a Line-Shaped Latent Image

Figure 1B:
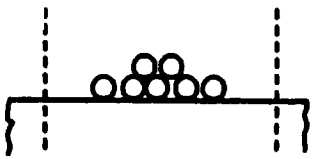
Figure 1C:
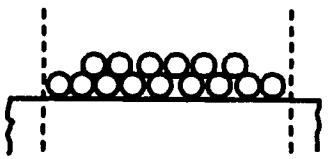

The inventor made analysis of the developing step for developing a line-shaped latent image with a toner T, using images acquired with a frame rate of 9,000 to 40,500 frames per second using a stereoscopic microscope (SZH10 manufactured by Olympus Corporation) and a high-speed camera (FASTCAM-Ultima-$I^2$ manufactured by PHOTRON Limited). FIGS. 1A through 1C are schematic diagrams which show toner adhering to a latent image portion (the portion between broken lines) on a photosensitive member (i.e., an image carrying member) over time, according to an embodiment of the present invention. Time elapses in order of FIG. 1A, FIG. 1B, and FIG. 1C, wherein FIG. 1A shows the latent image portion wherein toner adheres to a middle portion thereof, FIG. 1B shows the latent image portion wherein the toner further adhered to the middle portion of the latent image so as to overlay the toner layer, and FIG. 1C shows the latent image portion wherein a bottom layer is filled in with the toner, and an upper layer is filled in with the toner except for both edges thereof. In this case, the thickness of the toner is small at both edges of the latent image portion, thereby obtaining an image without edge effects. Specifically, it is important to control the position where the toner adheres to the latent image in the earliest stage. It was found that in the developing method wherein the toner adheres to the middle portion of the line-shaped latent image, the line latent image was developed into an image without edge effects.

Figure 1D:
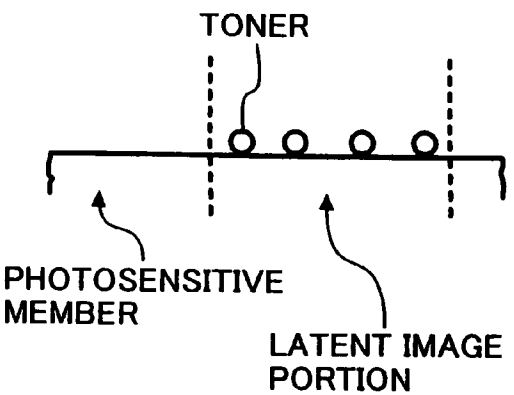
FIG. 1D BACKGROUND ART
FIGS. 1D-1F are schematic explanatory diagrams for describing steps of conventional toner developing.
Figure 1E:
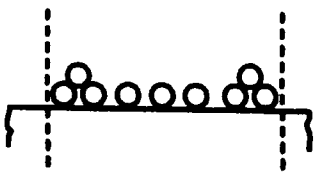
FIG. 1E BACKGROUND ART
Figure 1F:
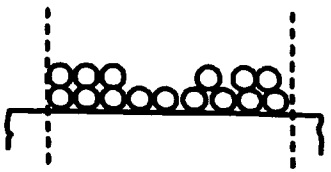
FIG. 1F BACKGROUND ART

On the other hand, FIGS. 1D through 1F are schematic diagrams which show toner adhering to a latent image portion (the portion between broken lines) on a photosensitive member over time, according to a background technology. Time elapses in order of FIG. 1D, FIG. 1E, and FIG. 1F, wherein FIG. 1D shows the latent image portion wherein the toner adheres to the latent image portion while being scattered over the entire region thereof with a small density, FIG. 1E shows the latent image portion wherein the toner further adheres to the latent image portion while overlaying the toner layer on both ends thereof, and FIG. 1F shows the latent image portion wherein excessive toner adheres to both ends of the latent image portion. In this case, the thickness of the toner is great at both edges of the latent image portion, thereby obtaining an image with edge effects.

As described above, as shown in FIGS. 1A through 1C, in the developing method according to the present embodiment, the toner adheres to the middle portion of the line-shaped latent image in the width direction in the earliest stage, thereby obtaining an image without edge effects. On the other hand, as shown in FIGS. 1D through 1F, in the background developing method, the toner adheres to the latent image portion while being scattered over the entire region thereof in the earliest stage, leading to a problem of obtaining an image with edge effects.

Now, description will be made regarding the mechanism of the developing method for obtaining a smooth image without edge effects according to the present embodiment while revealing the causes of edge effects.

The edge effects in electrophotography is known as described in "Electrophotography Process Technique" (Ken Kawauchi, edited and issued by Triceps pp 27-28, pp 116-123 (Jan. 31, 1992)). Brief description will be made regarding the edge effects in electrophotography as follows (described in 1.1 through 1.3).

1.1 Relation of Developing Electric Field and Edge Effects

Figure 2:
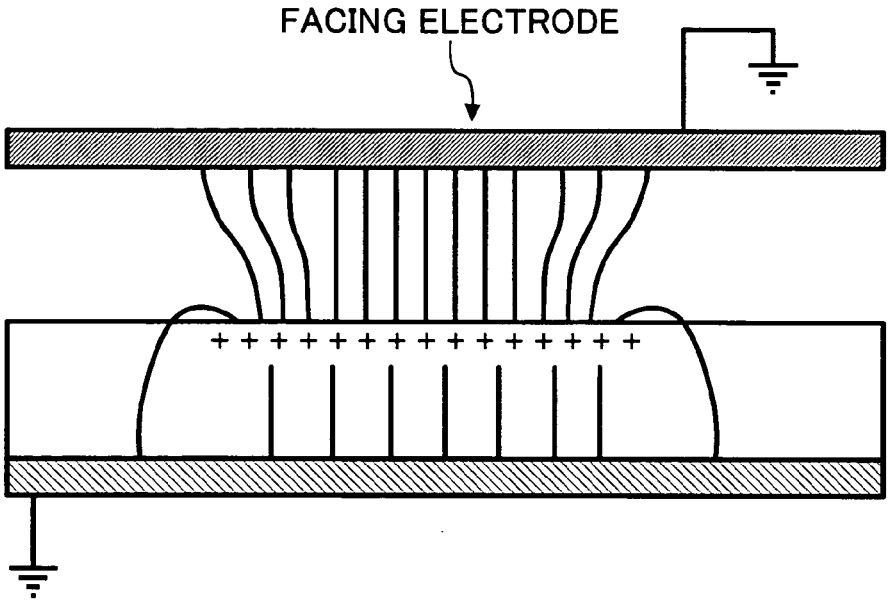
FIG. 2 is a schematic diagram which shows an electric field formed above an electrostatic latent image portion.

FIG. 2 is a schematic diagram showing an electric field formed above an electrostatic latent image portion. In the two-component developing, the carrier particles serve as electrodes in the developing region, and accordingly, as shown in FIG. 2, the electric field is distributed into the capacitance of the photosensitive member and the capacitance of a space between the carrier particles (electrodes) and the photosensitive member. Thus, the electric field, which extends toward the carrier (i.e., the developing sleeve side), is obtained. The electric field is required for developing, and is referred to as a "developing electric field". The developing electric field becomes greater the closer to the photosensitive member the developing electrode is.

The electric lines of force are shown spreading outwards in FIG. 2. This phenomenon causes the edge effects. While FIG. 2 shows a so-called positive/positive developing method in which an electrostatic latent image is developed with a developing agent having a charge whose polarity is different from that of the electrostatic latent image, a so-called negative/positive developing method, in which an electrostatic latent image is developed with a developing agent having a charge whose polarity is the same as that of the electrostatic latent image, is performed with the same mechanism in this embodiment.

1.2 Counter Charge

In the two-component developing, upon separation of the toner from the carrier at the time of developing, the carrier has the same amount of counter charge as an amount of charge of the separated toner. The smaller the carrier resistance is, the carrier has the advantage that the counter charge decays more rapidly. However, developing using carrier having excessively small resistance leads to a problem that upon the carrier coming in contact with the latent image on the photosensitive member, the charge of the latent image is weakened. On the other hand, in a case of developing using an insulating carrier, the generated counter charge causes reduction of the electric field above the latent image on a solid portion, inhibiting developing, and leading to a problem of obtaining an image with insufficient image density. For the reasons as described above, carrier having medium-to-low resistance has been generally used in developing.

1.3 Edge Effects Due to Counter Charge

In the step wherein the latent image is developed with the toner, a phenomenon occurs as follows. The electric lines of force spreads in the shape of a fan above a fine line or an edge, and accordingly, the counter charge generated above the fine line or the edge is scattered, thereby reducing inhibition of developing due to the counter charge. As a result, the fine line and the edge are developed with high image density as compared with the middle portion of the solid portion, leading to a problem of obtaining an image with edge effects due to relative small density of the middle portion of the solid portion. In this case, the portions other than the fine line or edge are developed with insufficient image density, leading to a problem of edge effects. An excessive amount of the toner does not adhere to the edge beyond the evaluated amount of the toner which adheres to the solid portion without counter charges.

Figure 3:
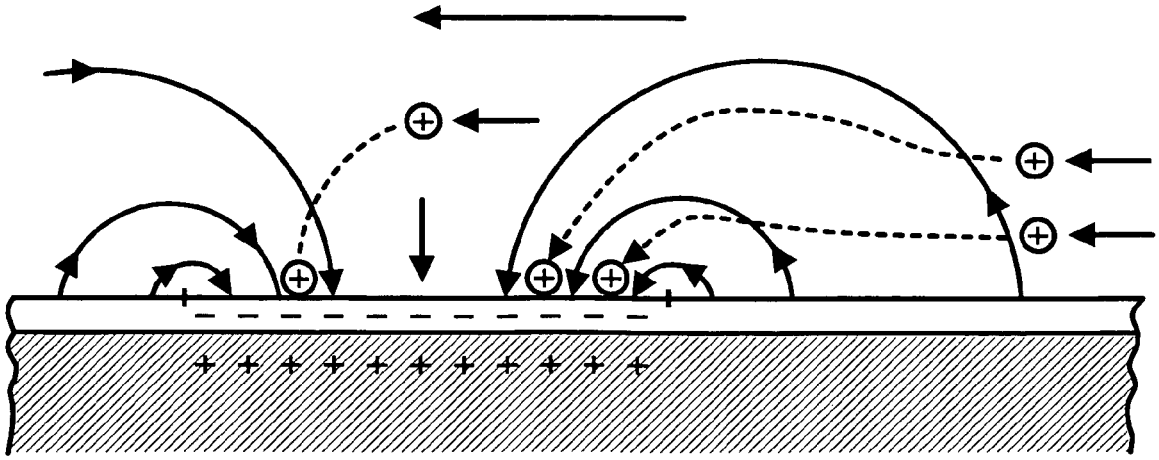
FIG. 3 is a schematic diagram which shows an electric field near an edge of an electrostatic latent image and motion of toner particles in a flow of a developing agent.

FIG. 3 is a schematic diagram which shows an electric field near edges of an electrostatic latent image and motion of toner particles in a flow of a developing agent. FIG. 3 shows developing of the latent image with edge effects varying corresponding to the direction of the flow of the developing agent. In FIG. 3, the developing agent flows in the direction of the arrow from right to left. At the rear end (right end) of the negative-charged region (latent image), the electric lines of force (indicated by curves) are shown extending toward the upstream of the flow of the developing agent, and surrounding the edge, in FIG. 3, leading to inhibition of access of the developing toner to the edge. On the other hand, at the front end of the latent image (left end), such phenomenon does not occur, conversely, leading to adhesion of the toner with high image density.

Figure 4:
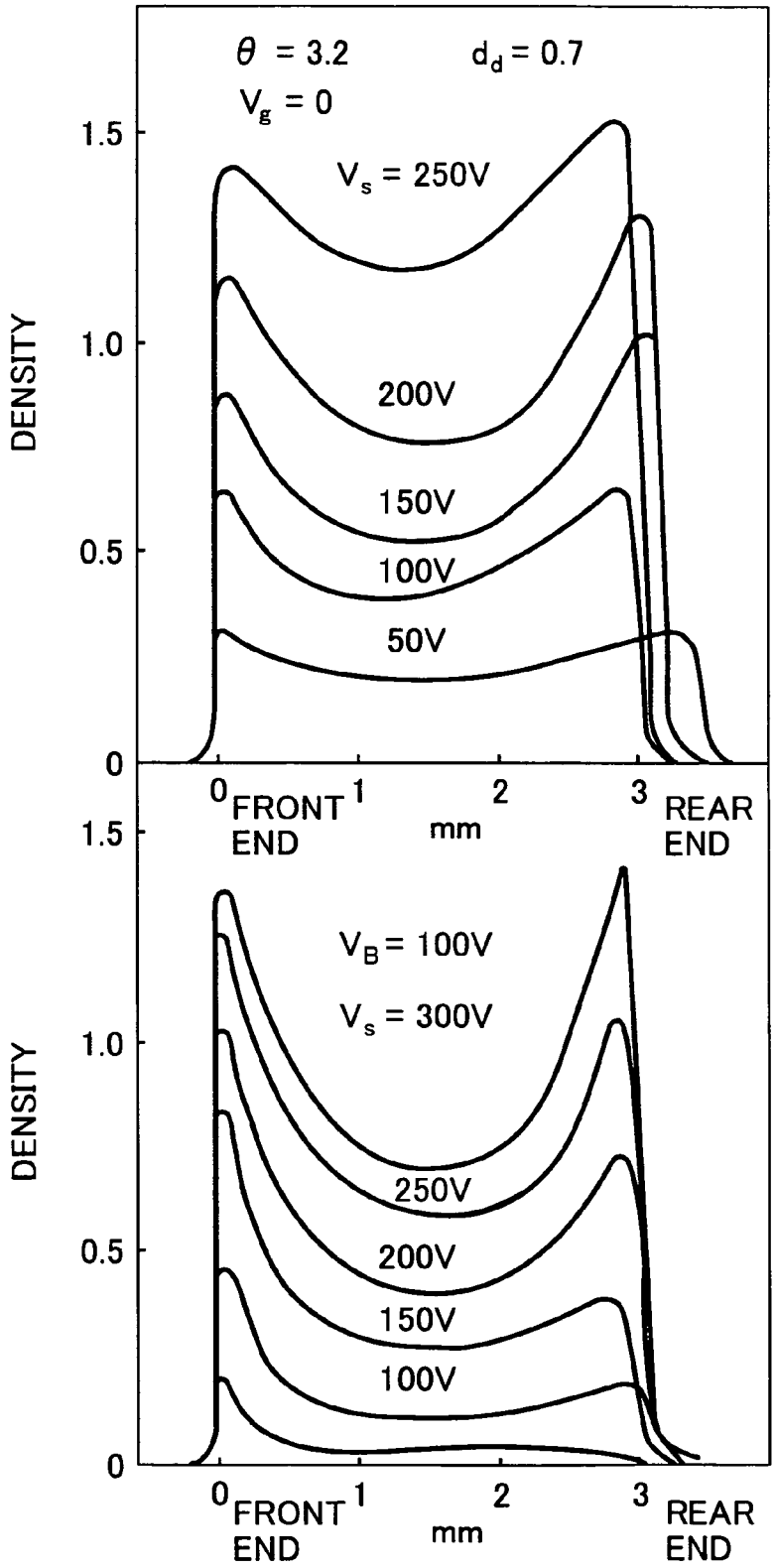
FIG. 4 is a diagram which shows developing density of a band-shaped pattern.

Accordingly, the edge effects vary corresponding to the direction of the flow of the developing agent. FIG. 4 is a diagram which shows developing density of a band-shaped pattern having a width of 3 mm. As shown in FIG. 4, the latent image is developed with greater edge effects at the front end of the latent image (left end) and with the smaller edge effects (without sharpness) at the rear end thereof. In the drawing, "Density" denotes the image density, "$V_B$" denotes the developing bias voltage, and $V_S$ denotes the electric potential at the latent image. As can be seen from FIG. 4, the directional tendency of the edge effects becomes more serious in a medium image density range. Furthermore, the greater the thickness of the developing-agent layer is, the greater the rotational speed of the developing roller is (i.e., the greater the ratio of the linear velocity is), and the greater the bias voltage is, the more serious the directional tendency of the edge effects becomes.

As can be understood from description in the above 1.1 through 1.3, in order to obtain a smooth image without edge effects, first, adhesion of the toner is controlled as described above, and next, developing is performed while reducing the influence of the counter charges.

[2] Developing Method, Apparatus, and the like Wherein Adhesion of the Toner is Controlled As described referring to FIGS. 1A through 1C, in the event that developing is performed for the latent image (which is taken as a line-shaped latent image in the vertical direction in the drawing) such that the line-shaped latent image is filled in with the toner from the middle portion toward the edges, an image is obtained without edge effects. Such developing can be made using free toner described below, thereby obtaining an excellent image without edge effects.

FIG. 1A shows the latent image being developed at a portion upstream of the nearest position between the photosensitive member and the developing sleeve using free toner as described later, FIG. 1B shows the latent image being developed at a position immediately upstream of the nearest position thereof, and FIG. 1C shows the latent image being developed at the nearest position and at a position downstream from the nearest position thereof.

In the developing method using the free toner, the toner moves along the electric lines of force shown in FIG. 2, and accordingly, it is assumed that developing is performed such that the line-shaped latent image is filled in with the toner from the middle portion thereof toward the edges thereof.

On the other hand, FIGS. 1D through 1F show the latent image being developed with the background developing method without the free toner, using transfer of the toner by bringing magnetic carrier into contact with the photosensitive member. With such a developing method, the toner is transferred from the magnetic carrier particles to the latent image due to the impact at the time of contact of the magnetic brush with the photosensitive member, or due to the strength of the developing electric field exceeding adhesion strength around the nearest position between the photosensitive member and the developing sleeve, and accordingly the toner adheres to the latent image at random in the width direction of the line-shaped latent image. Furthermore, as described above, a counter charge is generated which affects the adverse effects on developing, and the generated counter charge is scattered above a fine line or an edge due to the electric lines of force spreading in the shape of a fan above the fine line or the edge, reducing the aforementioned adverse effects upon developing above the fine line and the edge, and leading to a problem of obtaining an image with edge effects.

However, it has been found that even with the developing method wherein developing is performed such that the line-shaped latent image is filled in with the toner from the middle portion thereof toward the edges thereof in the width direction using free toner, in some cases, an image with edge effects is obtained. In this case, edge effects occur in the event that the magnetic carrier particles come into contact with the latent image. In this case, the generated counter charge affects the adverse effects upon developing, and the generated counter charge is scattered above a fine line or an edge due to the electric lines of force extending in the shape of a fan above the fine line or the edge, reducing the aforementioned adverse effects upon developing above the fine line and the edge, and leading to a problem of obtaining an image with edge effects.

Accordingly, with the developing method according to the present invention, the tips of the chains formed of the magnetic carrier particles are not brought into contact with the photosensitive member in the developing region. However, with the conventional non-contact two-component developing using erected magnetic chains, which is employed in the present embodiment, as well, but without using the free toner, developing is performed with insufficient toner, leading to a problem of poor image density such as non-uniformity of the image density of a solid portion. In a conventional method, in order to solve the aforementioned problems, relatively high developing bias is applied. However, this leads to an increase of the difference in the strength of the electric field between the edge and the middle portion, leading to a further problem of obtaining an image with greater edge effects.

[3] Developing Method for Reducing the Adverse Effects Due to Counter Charge Generated in Magnetic Carrier Following separation of the toner, the generated counter charge in the magnetic carrier decays due to transfer of the counter charge to the developing sleeve. In the developing method using a free toner according to the present embodiment, the toner is separated from the magnetic carrier at a portion sufficiently upstream of the nearest position between the photosensitive member and the developing sleeve, and accordingly, the time which elapses from the separation of the toner up to the remaining magnetic carrier reaching the latent image portion (the time elapses in order of FIGS. 1A, 1B, and 1C) is sufficient for decay of the counter charge generated in the magnetic carrier, thereby obtaining a smooth image without edge effects.

Further, as a developing method for suppressing the adverse effects due to the counter charge by further increasing the aforementioned time for decay of the counter charge, the rotational speeds of the image carrying member and the developing agent carrying member, the gap (developing gap) between the image carrying member and the developing agent carrying member, and the resistance of the magnetic carrier are adjusted such that the aforementioned magnetic carrier particles pass through above the line-shaped latent image sufficiently following decay of the counter charge generated in the magnetic carrier due to separation of the toner, thereby eliminating the adverse effects upon developing.

Next, a basic configuration of a developing device using the developing method according to the embodiment of the present invention will be described.

Figure 5:
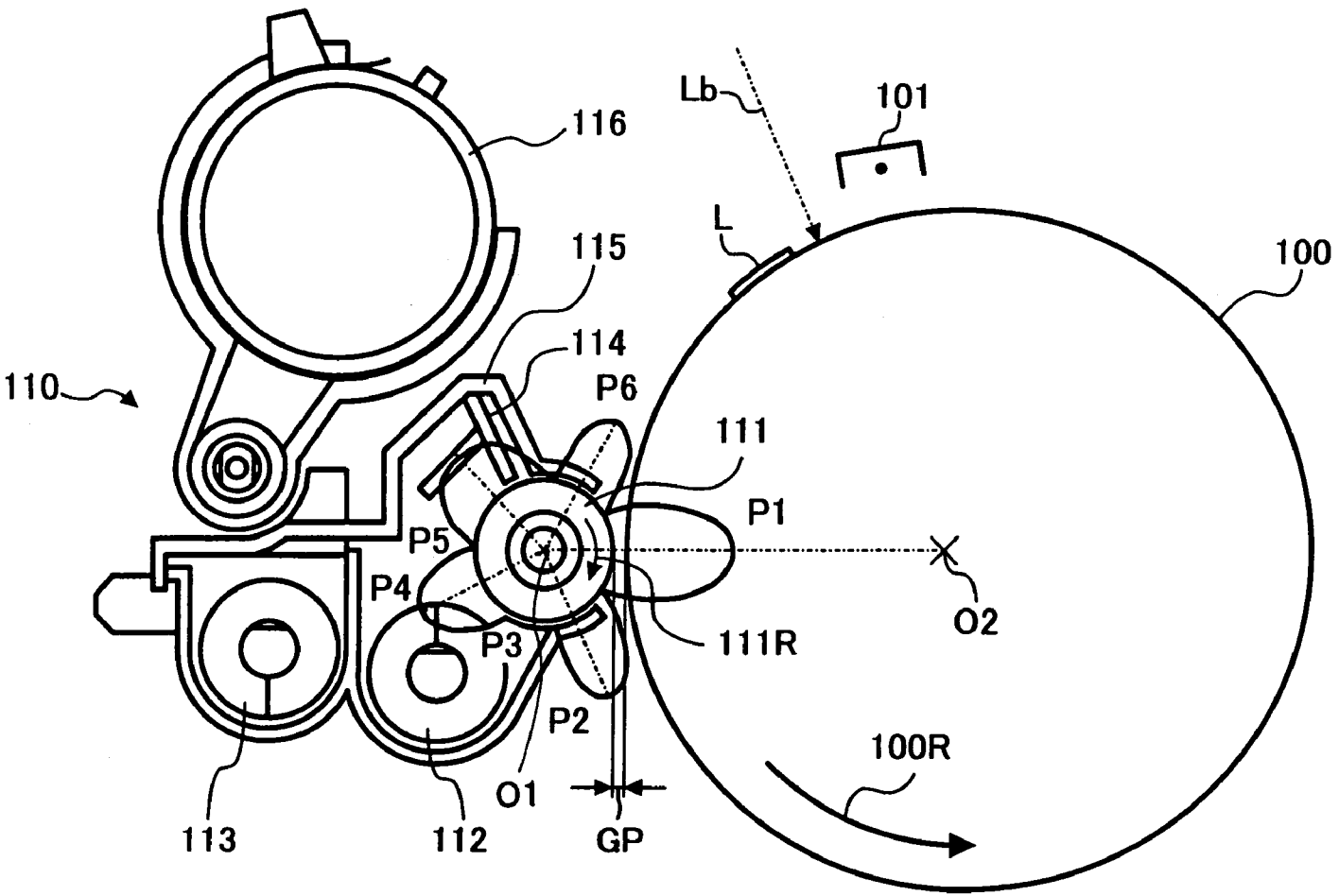
FIG. 5 is a schematic view showing a basic configuration of a developing device.

As shown in FIG. 5, a charger 101 is provided beside a photosensitive member 100 (i.e., an image carrying member) for charging the surface of the photosensitive member 100. The photosensitive member 100 includes a photosensitive layer on its surface and is formed in the shape of a cylinder. The photosensitive member 100 is rotated in the counterclockwise direction indicated by arrow 100R in FIG. 5. A developing device 110 includes a developing sleeve 111 serving as a developing agent carrying member provided at a position facing the photosensitive member 100 with a predetermined developing gap (GP). The developing sleeve 111 has a magnet therewithin and is formed in the shape of a cylinder.

Further, the developing device 110 includes a developing casing 115 for storing a developing agent including toner and magnetic carrier, and stirring screws 112 and 113 for stirring the developing agent. The developing agent is supplied to the developing sleeve 111 by rotating the stirring screws 112 and 113 while stirring the developing agent.

A toner storage unit 116 is provided at the upper portion of the developing casing 115 to supply a suitable amount of the toner into the developing casing 115 corresponding to the consumed toner.

In a step for forming an electrostatic latent image, first, the charger 101 uniformly charges the photosensitive member 100 beforehand. Then, the uniformly-charged surface of the photosensitive member 100 is exposed to a laser beam (Lb). As a result, an electrostatic latent image (L) is formed on the surface of the photosensitive member 100. The photosensitive member 100 is rotated so that the latent image (L) reaches the region facing the developing sleeve 111. In the region facing the developing sleeve 111, the charged toner adheres to the latent image (L), thereby forming a toner image.

A doctor blade 114 serving as a layer-thickness regulating member is provided at a position upstream of the region facing the photosensitive member 100 in the developing agent transporting direction indicated by arrow 111R in FIG. 5. The doctor blade 114 regulates the height of the magnetic chains formed of the magnetic carrier particles carrying the toner particles, i.e., the thickness of the developing-agent layer on the developing sleeve 111.

A conventional doctor blade is formed of a non-magnetic material in the form of a plate. The doctor blade 114 according to the present embodiment has a configuration wherein a plate formed of a magnetic material is fixed to a non-magnetic plate. In this embodiment, the doctor blade 114 includes a component formed of a magnetic material, thereby facilitating formation of the magnetic chains with uniformity of the height thereof as described later.

In FIG. 5, a transfer device for transferring a toner image formed on the photosensitive member 100 onto a recording sheet, a cleaning device for removing remaining toner on the photosensitive member 100, and a discharge device for removing remaining electric potential on the photosensitive member 100, are omitted.

In the step for forming a color image with such a configuration, first, a cyan toner image formed on the photosensitive member 100 is transferred onto an intermediate transfer belt, for example. Subsequently, color toner images such as magenta, yellow, and black color toner images are transferred onto the intermediate transfer belt in order in a superimposed manner, thereby forming a full-color toner image. The full-color toner image is transferred onto a recording sheet transported from a paper feed tray (not shown). The recording sheet carrying the toner image, which has not been fixed, is separated from the intermediate transfer belt. Then, the toner image is fixed onto the recording sheet while the recording sheet passes through a fixing device (not shown). The remaining toner on the photosensitive member 100, which has not been used for transfer, is removed from the photosensitive member 100 by the cleaning device. The photosensitive member 100 subjected to removal of the remaining toner is initialized (i.e., all traces of the previous latent image are erased) by a discharge lamp (not shown) for the next image formation step.

The developing sleeve 111 is formed of a magnetic substance such as aluminum, brass, stainless steel, conductive resin, or the like, and has a configuration so as to be rotated clockwise, for example in FIG. 5, around magnets (not shown) by a rotational driving mechanism (not shown).

The magnetic chains are formed of the developing agent due to the magnetic field formed by these magnets, and are transported by rotation of the developing sleeve 111. The magnetic carrier particles form chains along magnetic lines of force due to these magnets, and further, these chains form a magnetic brush. The chains and magnetic brush are formed of magnetic carrier particles carrying charged toner particles.

The developing sleeve 111 is disposed near the photosensitive member 100 with the developing gap (GP), and developing is performed at a region where the developing sleeve 111 and the photosensitive member 100 face one another. In this embodiment, both the photosensitive member 100 and the developing sleeve 111 are formed in the shape of a cylinder, and accordingly, the facing region, where the convex-curved faces of photosensitive member 100 and the developing sleeve 111 face one another, has a configuration wherein the gap between the developing sleeve 111 and the photosensitive member 100 becomes greater the farther away from the nearest position where the developing sleeve 111 and the photosensitive member 100 are the closest one to another, in both the upstream direction and downstream direction. The photosensitive member 100 may be formed from a belt in the shape of a plate, in place of the cylindrical-shaped photosensitive member 100. In this case, the nearest position may be formed similarly. In FIG.

5, the nearest position is situated on an imaginary line connecting between the center O1 of the developing sleeve 111 and the center O2 of the photosensitive member 100.

FIG. 5 schematically shows magnetic field distributions P1, P2, P3, P4, P5, and P6, around the developing sleeve 111. These magnetic field distributions are formed by first through sixth magnets (not shown) disposed within the developing sleeve 111, respectively.

In particular, while the magnetic field distribution P1 serving as a developing main pole is formed of a first magnet with a small cross-section area, the first magnet may be formed of a samarium-alloy magnet, in particular, samarium-cobalt-alloy magnet or the like. An iron-neodymium-boron-alloy magnet and an iron-neodymium-boron-alloy bond magnet, which are typical examples of rare earth metal alloy magnets, exhibit maximal energy products of 358 kJ/m$^3$ and around 80 kJ/m$^3$, respectively. The first magnet formed of such a material even with a sufficiently small size enables sufficient magnetic intensity over the face of the developing sleeve 111, unlike conventional magnets. A ferrite magnet and a ferrite bond magnet, which are typical examples of conventional magnets, exhibit the maximal energy products of around 36 kJ/m$^3$ and around 20 kJ/m$^3$, respectively. In a developing device wherein a developing sleeve may be formed with a great diameter, a magnet may be formed with a large size using a ferrite magnet or a ferrite bond magnet, or the tip of the first magnet facing the sleeve may be formed small, so as to make the half-central angle small.

The first magnet (corresponding to the magnetic field distribution P1) is disposed at a position corresponding to the nearest position, and the second magnet (magnetic field distribution P2), the third magnet (magnetic field distribution P3), the fourth magnet (magnetic field distribution P4), the fifth magnet (magnetic field distribution P5), and the sixth magnet (magnetic field distribution P6), are disposed downstream of the first magnet in that order. Only the first magnet (magnetic field distribution P1) of these magnets is disposed at a position where the developing sleeve 111 and the photosensitive member 100 face one another.

In the developing method performed in the developing device 110 according to the embodiment of the present invention, developing is performed using a cycle wherein the magnetic brush formed due to at least the first magnet (magnetic field distribution P1) rises and lies.

Accordingly, the developing sleeve 111 is preferably formed with a diameter of 18 to 30 mm, and the developing main magnet disposed in the developing sleeve 111 corresponding to the magnetic field distribution P1 is preferably formed with a width of 6 to 8 mm, which is a half-value width as to the peak magnetic flux density, and with magnetic flux density of 100 to 130 mT.

Developing was analyzed regarding a configuration including the developing sleeve 111 with the diameter of 18 mm, using images acquired with a frame rate of 9,000 to 40,500 frames per second acquired by the stereoscopic microscope (SZH10 manufactured by Olympus Corporation) and the high-speed camera (FASTCAM-Ultima-I$^2$ manufactured by PHOTRON Limited). As a result, it has been found that the cycle wherein the chains rise and lie is performed rapidly, leading to reduction of smoothness of motion of the magnetic brush. Accordingly, it is assumed that formation of the chains is disturbed due to the rapid motion of the magnetic brush, thereby facilitating separation of the toner particles and generation of free toner particles. Further, the period of time wherein the developing agent comes in contact with the photosensitive member can be reduced, and accordingly, it is assumed that the present configuration has the advantage of preventing adverse effects due to counter charge generated in the magnetic carrier particles.

The fourth magnet (corresponding to the magnetic field distribution P4) has a function of scooping up the developing agent to the developing sleeve 111. The third magnet (corresponding to the magnetic field distribution P3) has a function of separating the developing agent particles with the toner density reduced due to developing from the chains. Each of the second, fifth, and sixth magnets (corresponding to the magnetic field distributions P2, P5, and P6, respectively) has a function of transporting the developing agent scooped up to the developing sleeve 111 to a facing region where the developing sleeve 111 and the photosensitive member 100 face one another.

The axes of these first through sixth magnets are all positioned in the radial direction of the developing sleeve 111.

In the present embodiment, the developing sleeve 111 includes a six-pole magnet component, and a single magnet (first magnet) is disposed in a facing region where the developing sleeve 111 and the photosensitive member 100 face one another. Alternatively, two or more magnets may be disposed in the facing region to increase toner separated from magnetic carrier.

Further, the developing sleeve 111 may include an eight-pole magnet component or ten-pole magnet component, for example, wherein additional magnets are further disposed between the fourth magnet and the doctor blade 114 to improve the performance of scooping up the developing agent, and uniformity of a solid image.

In the developing device 110, an electric power supply is connected to a sleeve shaft electrically connected to the developing sleeve 111 for applying a bias voltage. The voltage supplied from the electric power supply connected to the sleeve shaft is applied to the developing sleeve 111. On the other hand, the conductive support, forming the innermost layer of the photosensitive member 100, is grounded.

Thus, an electric field is formed in the facing region for attracting the toner particles separated from the magnetic carrier particles toward the photosensitive member 100. That is, the toner particles move toward the photosensitive member 100.

As described referring to FIG. 5, in this embodiment, the toner particles are carried and transported to the facing region between the developing sleeve 111 and the photosensitive member 100 by the developing sleeve 111, which includes the magnets and is disposed at a position facing the photosensitive member 100. An electric field is formed at a space between the developing sleeve 111 and the photosensitive member 100, thereby developing the latent image (L) formed on the surface of the photosensitive member 100 with toner. Thus, developing according to the embodiment of the present invention is performed using the developing device 110.

In the illustrative embodiment, the developing device is combined with an image forming apparatus of the type writing a latent image with a laser beam (Lb). Specifically, after the charger 101 uniformly and negatively charges the surface of the photosensitive member 100, the laser beam (Lb) scans the photosensitive member 100 to form the latent image (L) by lowering the potential to reduce the amount of writing. Such a negative/positive developing method is only an example. The polarity of charges formed on the photosensitive member 100 is not essential to the developing method according to the present embodiment.

In the developing device 110, the developing sleeve 111 including the magnets is disposed at a position facing the photosensitive member 100. The layer formed of developing agent containing the toner and the magnetic carrier is carried on the surface of the developing sleeve 111. The developing sleeve 111 is rotated while maintaining the magnets stationary so as to cause a speed difference between the developing sleeve 111 and the magnets, thereby forming a magnetic brush at least at the facing region, and thereby causing the formed magnetic brush to flow. In the step for causing the magnetic brush to flow, the free toner particles separated from the magnetic carrier particles adhere to the latent image (L) formed on the photosensitive member 100, whereby developing is performed.

While the developing sleeve 111 has been shown and described as rotating relative to the stationary magnets, the magnets may be rotated relative to the developing sleeve 111 or the developing sleeve 111 and magnets may be rotated in opposite directions to each other. The crux is that a speed difference be established between the developing sleeve 111 and the magnets.

In order to perform developing without edge effects, developing should be made such that the counter charge generated in the magnetic carrier particles due to separation of toner decays sufficiently so as not to cause adverse effects on developing, following which the magnetic carrier particles pass through above the line-shaped latent image portion. In the present embodiment, each rotational speed of the developing sleeve 111 and the photosensitive member 100, the gap (developing gap GP) between the developing sleeve 111 and the photosensitive member 100, and the resistance of the magnetic carrier, are adjusted so as to perform such developing.

The stirring screw 112 is disposed at a portion across the developing sleeve 111 from the photosensitive member 100 for scooping up the developing agent stored in the developing casing 115 to the developing sleeve 111 while stirring the developing agent. The developing agent stored in the developing casing 115 includes toner T and magnetic carrier CC. The developing agent is mixed and stirred by the stirring screws 112 and 113, and the toner T is charged due to friction. In the present embodiment, the toner is charged with a toner charge (q/m) of −5 to −60 μC/g, and is preferably charged with a toner charge of −10 to −35 μC/g.

The magnetic carrier CC may be formed of ferromagnetic particles of metal such as iron, nickel, cobalt, or the like, alloy formed of the aforementioned metal and other metal, oxide such as magnetite, γ-hematite, chromium dioxide, copper-zinc ferrite, manganese-zinc ferrite, or the like, or Heuslar alloy such as manganese-copper-aluminum Heuslar alloy.

Further, the ferromagnetic particles may be coated with resin such as styrene-acrylonitrile resin, silicone resin, fluorocarbon resin, or the like. The kind of the resin may be determined, giving consideration to conductivity of the toner T. Furthermore, the resin used for coating the magnetic particles may contain a charge-restriction agent or conductive material.

The above-described magnetic particles may be dispersed in, for example, styrene-acrylonitrile resin, polyester resin, or the like.

The ferromagnetic substance with a saturation magnetization of 35 emu/g ($4.4\times10^{-5}$ Wb○m/kg) to 85 emu/g ($10.7\times10^{-5}$ Wb○m/kg) is preferably employed. The magnetic carrier with a saturation magnetization less than 35 emu/g causes deterioration in transporting performance, and leading to a problem of increased adhesion of the magnetic carrier onto the photosensitive member 100. On the other hand, the magnetic carrier with a saturation magnetization more than 85 emu/g causes excessive high magnetization, leading to formation of a magnetic brush having excessively great strength.

Each magnetic carrier particle is formed with a volume average diameter of 25 to 100 μm, and is preferably formed with a volume average diameter of 30 to 60 μm. At least, the magnetic carrier particles CC with a diameter of 74 μm or more are preferably contained in the entire magnetic carrier with a concentration of 15% or less. The reason is that the greater the diameter of the magnetic carrier particles is, the smaller the amount of the toner T contained in the magnetic brush is, since the volume of the magnetic brush is generally the same.

Further, each magnetic carrier particle is preferably formed with a volume resistance of 6 to 12 LogΩ○cm. The reason is that the electric potential of the magnetic carrier preferably becomes equal to the electric potential of the developing sleeve with a suitably rapid speed.

The toner T is formed of at least thermoplastic resin and pigment such as carbon-black pigment, copper-phthalocyanine pigment, quinacridone pigment, bis-azo pigment, or the like. Styrene-acrylonitrile resin, polyester resin, or the like, is preferably employed as the aforementioned resin. Furthermore, the toner T may contain wax such as polypropylene wax or the like, serving as a fixing assistant, and an alloy-containing pigment for controlling the charge amount of the toner. Furthermore, the toner T may contain oxide, nitride, carbide, or the like, such as silica, alumina, titanium oxide, or the like, subjected to surface processing. Furthermore, the toner T may contain a fatty acid metal salt, resin fine particles, or the like.

Each toner particle is formed with a volume average diameter of 4 to 10 μm, and the concentration of the fine particles with a volume average diameter of 4 μm or less is preferably suppressed to around 20% or less. Furthermore, while the toner T may contain an additional agent such as silica, alumina, titania, or the like, as described above, the toner T is preferably formed with a powder density of 0.25 g/cm$^3$ or more. The greater the powder density of the toner T is, the toner particles more readily separate from the magnetic carrier particles.

Next, description will be made regarding a step for forming a magnetic brush with the developing device according to the present embodiment of the present invention. As shown in FIGS. 6A through 6G, the magnetic field distributions P1, P2, P3, P4, P5, and P6, are radially formed from the outer face of the developing sleeve 111 due to the magnets included therewithin.

The developing agent carried on the developing sleeve 111 is transported by rotation of the developing sleeve 111. Upon the developing agent passing through the aforementioned magnetic field distributions during the transporting step, a cycle occurs wherein the magnetic chain formed of the magnetic carrier particles in the shape of chains rises and lies on the developing-agent layer formed on the developing sleeve 111. The magnetic chain is formed along the magnetic lines of force. FIGS. 6A through 6G are schematic diagrams showing the cycle for the magnetic chain formed of the developing agent passing through the magnetic field distribution P1. Now, description will be made regarding the magnetic chain, the free toner, the magnetic chain rising on the developing sleeve 111, and the like, with reference to FIGS. 6A through 6G. In FIGS. 6A through 6G, reference characters (1) through (7) denote magnetic lines of force in the magnetic field distribution $P_1$, schematically shown in the drawings. These magnetic lines of force (1) through (7) are shown generally in the direction tangential to the developing sleeve 111. The magnetic lines of force rise with a greater angle in order of (2) and (3), and the magnetic line of force (4) rises with a maximal angle, i.e., perpendicular to the circumference of the developing sleeve 111.

The magnetic lines of force rise with a greater angle in order of (5), (6), and (7), in the direction wherein the magnetic chain lies on the developing sleeve 111, symmetrically to the magnetic lines of force (3), (2), and (1), which are used at the time of rising the magnetic chain, with the magnetic line of force (4) as the symmetry axis. The magnetic line of force (7) lies generally in the direction tangent to the developing sleeve 111. The magnetic line of force (4) matches the line passing through the centers O1 and O2 in FIG. 5.

These magnetic lines of force (1) through (7) are maintained stationary outward from the face of the developing sleeve 111. While the developing agent carried and transported by rotation of the developing sleeve 111 forms a developing-agent layer on the developing sleeve 111, the aforementioned developing-agent layer is omitted in FIGS. 6A through 6G for simplification of the drawing. Furthermore, while the toner particles T are carried on the magnetic carrier particles CC due to electrostatic force, the toner T carried thereon is omitted for simplification of the drawing, as well.

Figure 6A:
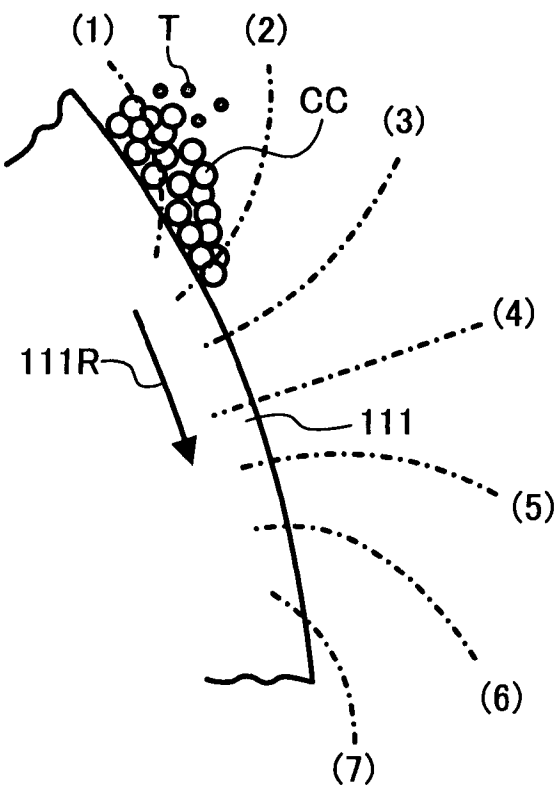
FIGS. 6A through 6G are diagrams for describing steps of the change in magnetic chains and generation of free toner.

The developing-agent layer on the developing sleeve 111 is moved by rotation of the developing sleeve 111, and upon the developing-agent layer entering the magnetic field distribution P1, the magnetic carrier particles CC form a magnetic chain, and the formed magnetic chain rises along the magnetic line of force (1), separating from the developing-agent layer as shown in FIG. 6A. The magnetic chains are arrayed in the longitudinal direction of the shaft of the developing sleeve 111, i.e., in the direction perpendicular to the surface of the drawing, and are formed so as to face the first magnet.

In the present developing method, when the magnetic chain formed of the magnetic carrier particles rises on the developing agent carrying member, a tip of the magnetic brush is separated from the developing-agent layer formed of the magnetic carrier particles on the developing agent carrying member by the magnetic field generating device, such that the toner particles are separated from the magnetic carrier particles, thereby generating free toner particles for developing.

As shown in FIG. 6A, upon the magnetic carrier particles CC rising on the developing-agent layer along the magnetic line of force (1), the toner particles T are separated from the magnetic carrier particles CC. The separated free toner particles are generated in the region upstream of the nearest portion where the photosensitive member 100 and the developing sleeve 111 face one another, in the direction for transporting the developing agent.

Thus, the toner particles T separated from the magnetic carrier particles CC hang in a space where the magnetic chain rises (a space upstream of the aforementioned nearest portion in the direction of rotation of the developing sleeve 111). Further, deformation of the developing-agent layer occurs on the surface of the developing sleeve 111 due to the magnetic chain rising, causing separation of the toner particles therefrom, thereby generating free toner particles T, as well.

The toner particles T are separated from the developing-agent layer between the two magnetic brushes adjacent one to another, where magnetic chains do not rise, as well, thereby generating the free toner particles T for developing.

In the event that the free toner particles T face the image portion (the portion exposed after being charged, i.e., the latent image portion L) on the photosensitive member 100, the free toner particles T fly onto the image portion. In the event that the non-image portion (the portion which has not been exposed after being charged) on the photosensitive member 100 is positioned in the facing region, the free toner particles T are not generated.

Figure 6B:
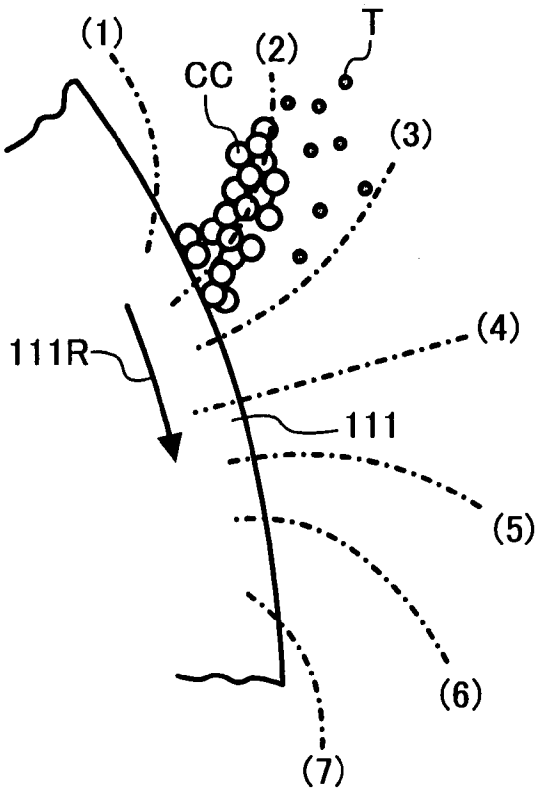

The magnetic chain extending along the magnetic line of force (1) as shown in FIG. 6A changes in shape and position so as to extend along the magnetic line of force (2) due to further rotation of the developing sleeve 111. FIG. 6B shows the state of the magnetic chain following the aforementioned change. The toner particles T are further separated from the magnetic carrier particles CC during the aforementioned change, thereby generating free toner particles T in a space where the magnetic chain rises (a space downstream of the nearest portion in the rotational direction 111R).

Figure 6C:
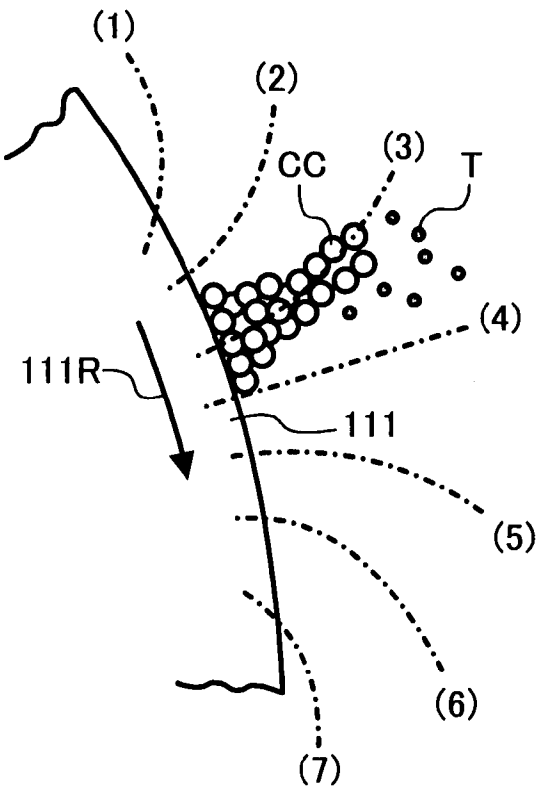

The magnetic chain extending along the magnetic line of force (2) as shown in FIG. 6B changes the shape and position thereof so as to extend along the magnetic line of force (3) due to further rotation of the developing sleeve 111. FIG. 6C shows the state of the magnetic chain following the aforementioned change. The toner particles T are further separated from the magnetic carrier particles CC during the aforementioned change, thereby generating free toner particles in a space where the magnetic chain rises (a space downstream of the aforementioned nearest portion in the rotational direction 111R).

Figure 6D:
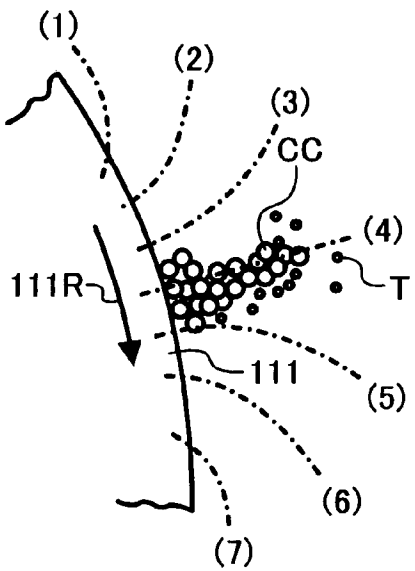

The magnetic chain extending along the magnetic line of force (3) as shown in FIG. 6C changes the shape and position thereof so as to extend along the magnetic line of force (4) due to further rotation of the developing sleeve 111, whereby the magnetic chain rises generally perpendicular to the face of the developing sleeve 111. FIG. 6D shows the state of the magnetic chain following the aforementioned change. The toner particles T are further separated from the magnetic carrier particles CC during the aforementioned change, thereby generating free toner particles T in a space around the tip of the magnetic chain.

The magnetic chain as shown in FIG. 6D changes the shape and position thereof so as to extend along the magnetic line of force (5) due to further rotation of the developing sleeve 111. The magnetic line of force (5) is positioned adjacent to the magnetic line of force (4) downstream thereof in the rotational direction 111R, and is further inclined downstream in the rotational direction 111R the farther from the developing sleeve 111 is. As a result, the magnetic chain is formed along the aforementioned magnetic line of force (5).

Figure 6E:
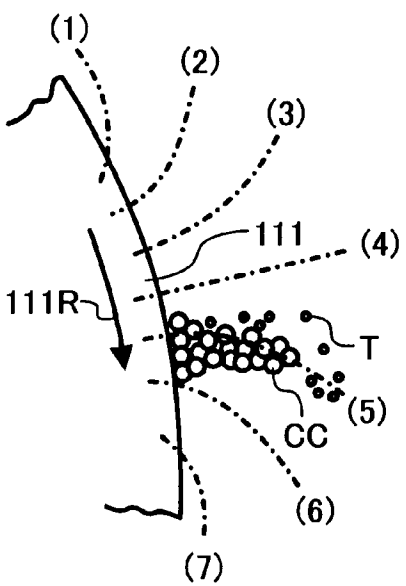

FIG. 6E shows the state of the magnetic chain following the aforementioned change. The toner particles T are further separated from the magnetic carrier particles CC during the aforementioned change, thereby generating free toner particles T in a space upstream of the magnetic chain in the rotational direction 111R, and a space around the tip of the magnetic chain. However, in this step, the developing electric field is reduced due to adhesion of the toner particles T to the latent image in the aforementioned steps shown in FIG. 6A through FIG. 6D, and the distance between the magnetic brush and the photosensitive member becomes great, and accordingly, little amount of free toner particles T is generated.

Figure 6F:
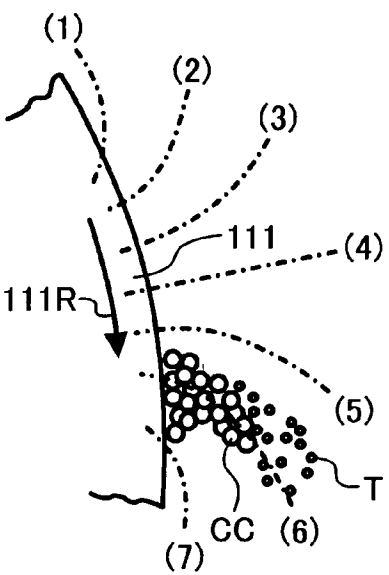

The magnetic chain as shown in FIG. 6E changes in shape and position so as to extend along the magnetic line of force (6), which is further inclined downstream, due to further rotation of the developing sleeve 111. FIG. 6F shows the state of the magnetic chain following the aforementioned change. Few new free toner particles T are generated in this step wherein the aforementioned change occurs.

Figure 6G:
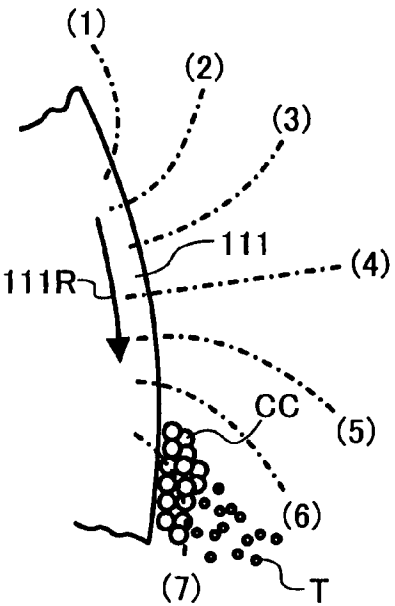

The magnetic chain as shown in FIG. 6F changes in shape and position so as to extend along the magnetic line of force (7), which is further inclined downstream, due to further rotation of the developing sleeve 111. FIG. 6G shows the state of the magnetic chain following the aforementioned change. Few new free toner particles T are generated in this step wherein the aforementioned change occurs, as well.

The magnetic chain as shown in FIG. 6G completely lies on the developing-agent layer formed on the circumference of the developing sleeve 111, which is not shown in the drawings. Few new free toner particles T are generated in this step wherein the aforementioned change occurs, as well.

In FIGS. 6A through 6G, description has been made regarding a schematic example wherein a single magnetic chain is formed along one of the magnetic lines of force (1) through (7), and the position and the shape of the magnetic chain, and the magnetic line of force along which the magnetic chain extends, change due to rotation of the developing sleeve 111. However, in reality, the magnetic chains are formed along the magnetic lines of force (1) through (7) at the same time, and the position and the shape of each magnetic chain sequentially change so as to extend along the adjacent magnetic line of force. The toner particles T are separated from the magnetic carrier particles CC in the steps wherein the shape and the position of the magnetic chains change, whereby developing is performed with the generated free toner particles T.

In the example shown in FIGS. 6A through 6G, the magnetic brush is formed of the magnetic chains along the magnetic lines of force (1) through (7). In the present example, the magnetic chains rise within the facing region. The region on the developing sleeve 111, where the cycle wherein the magnetic chains rise and lie within the facing region occurs, will be referred to as a "magnetic-chain-rising region" hereafter.

Here, the aforementioned "cycle wherein the magnetic chains rise and lie" as used here means a cycle wherein the magnetic carrier particles CC are separated from the developing-agent layer on the developing sleeve 111 so as to form a tip of the magnetic chain, the formed magnetic chain rises generally perpendicular to the face of the developing sleeve 111, and the magnetic chains completely lie on the developing-agent layer due to the magnetic force from the magnet MG in the step for transporting the developing agent on the developing sleeve 111. The toner particles T carried by the magnetic carrier particles CC are separated therefrom due to change in the shape of the magnetic chains mainly in the magnetic-chain-rising region.

In other words, a set of the magnetic chains formed along a number of the magnetic lines of force within a single magnetic field distribution is referred to as "magnetic brush", and the region on the developing sleeve 111, where the magnetic chains forming the magnetic brush, will be referred to as "magnetic-chain-rising region" hereafter. The toner particles T are separated from the magnetic carrier particles CC of the magnetic brush (magnetic chains) formed on the magnetic-chain-rising region, serving as free toner particles T, whereby developing is performed with the generated free toner particles T.

In the present embodiment, a great amount of free toner particles T are generated due to change in the shape of the magnetic chains, and the generated great amount of free toner particles T are suspended in a space around the magnetic brush (magnetic chains), whereby developing is performed with the free toner particles T, and thereby improving developing efficiency as compared with the conventional developing method wherein the toner particles T are directly transferred onto the latent image from the magnetic carrier particles CC.

It is assumed that in the present embodiment, the developing sleeve 111 is formed with a small diameter, or the magnet is formed with a small half-value width of the magnetic force is employed in a case of the developing sleeve 111 formed with a large diameter, as described above, causing the cycle wherein the magnetic chains rise and lie to occur rapidly with less smoothness, thereby generating the aforementioned great amount of free toner particles.

The developing device described above has a configuration for making developing according to the present embodiment of the invention described below so as to expand the developing region as compared with the conventional developing region, thereby providing a developing device having the advantage that the amount of the developing agent which is used for developing is increased without increasing the linear-velocity ratio (Vs/Vp) of the linear velocity of the developing sleeve 111 (Vs) as to the linear velocity of the photosensitive member 100 (Vp).

Here, the developing region is defined as the region where the toner particles T in the developing agent fly onto the photosensitive member 100, whereby developing is performed, regardless of the state whether the magnetic chains formed of the magnetic carrier particles CC form the magnetic brush, or a thin developing-agent layer is formed on the developing sleeve 111.

Next, description will be made regarding a developing bias for forming an electric field between the developing sleeve 111 and the photosensitive member 100 to generate the aforementioned free toner particles.

Figure 7:
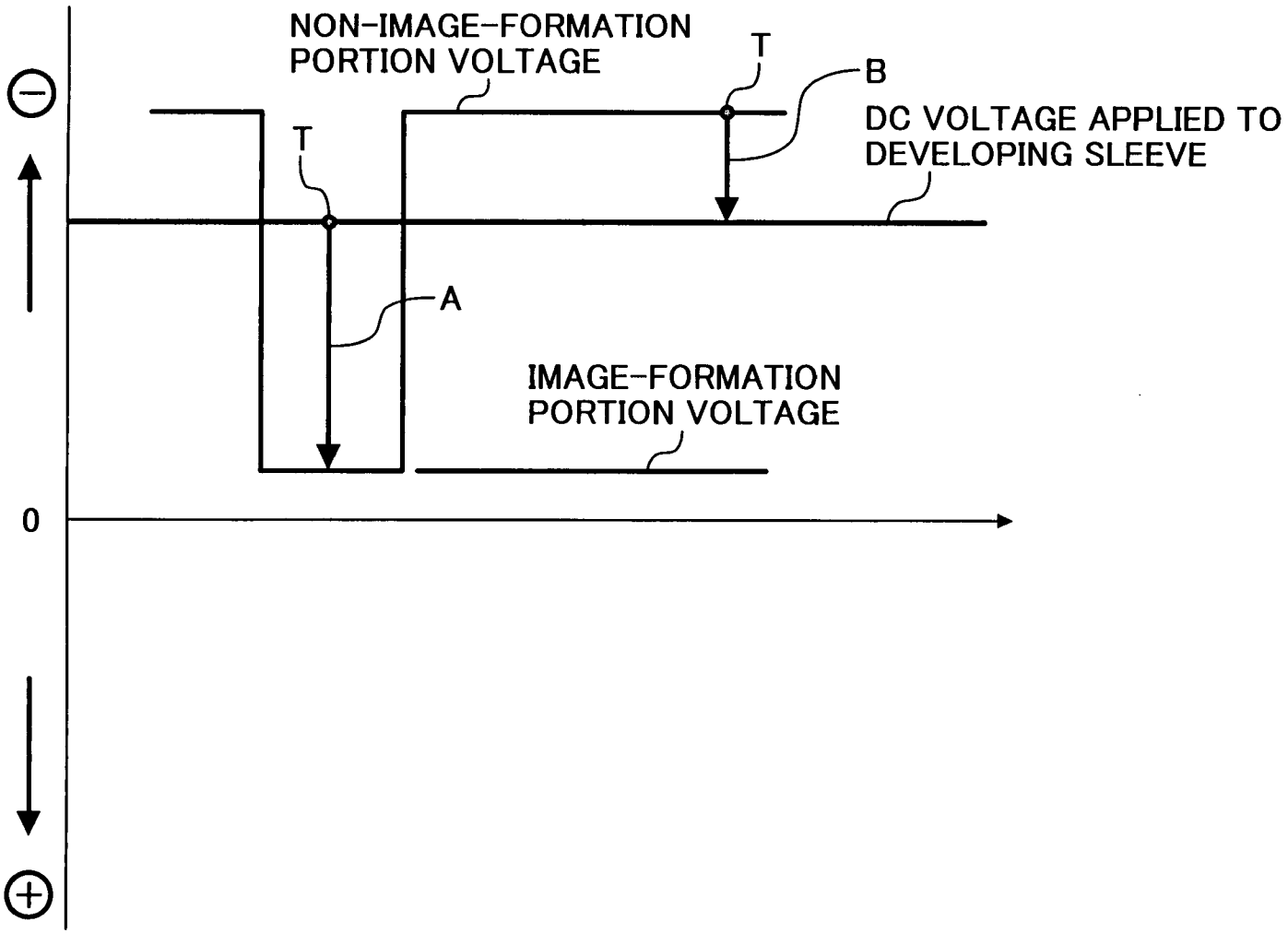
FIG. 7 is a schematic diagram for describing an electrostatic force acting upon the toner on a photosensitive member.

FIG. 7 is a schematic diagram which shows developing with the negative/positive developing method while applying a DC electric field using a DC power supply connected to the developing sleeve 111. In the photosensitive member 100 using an organic pigment as a carrier generating material, in general, the surface of the photosensitive member 100 is negatively charged, which is employed in the present embodiment, as well. The polarity of the charge on the photosensitive member 100, which is used in developing, is not essential.

In a step for writing an image with the laser beam (Lb), the portion, where the latent image is to be formed, is exposed. This writing method has the advantage of reducing the writing amount. The charge on the exposed portion is weakened due to holes generated from the carrier generating material, causing reduction of the electric potential on the image-formation portion.

A DC voltage is applied to the developing sleeve 111 using the power supply connected therewith such that the surface of the developing sleeve ill is more negatively charged than the image-formation portion with the reduced electric potential, thereby providing a force acting upon the negative-charged free toner particles T and the toner particles T carried by the magnetic carrier particles CC (both of which are represented by "toner T" in FIGS. 7 and 8), from the developing sleeve 111 toward the image-formation portion, which is indicated by arrow A in FIG. 7.

In FIG. 7, even if toner particles T adhere to the non-image-formation portion on the photosensitive member 100, the force acts upon the toner particles T from the non-image-formation portion toward the developing sleeve 111 as indicated by arrow B in FIG. 7, and accordingly, the toner particles T are surely separated from the non-image-formation portion, thereby obviating background contamination.

In the developing method according to the present embodiment, particle properties such as a particle diameter of the magnetic carrier particles CC, magnetic properties such as saturation magnetization of the magnets, and configuration properties such as the width and shape of each component, are adjusted so as to control the force acting upon the toner particles T carried on the surfaces of the magnetic carrier particles CC, thereby generating the free toner particles T. Further, the magnetic brush, which generates the free toner particles T, is formed, thereby developing the latent image (L) formed on the photosensitive member 100 with high toner density, and thereby providing a developing method with high developing performance.

Figure 8:
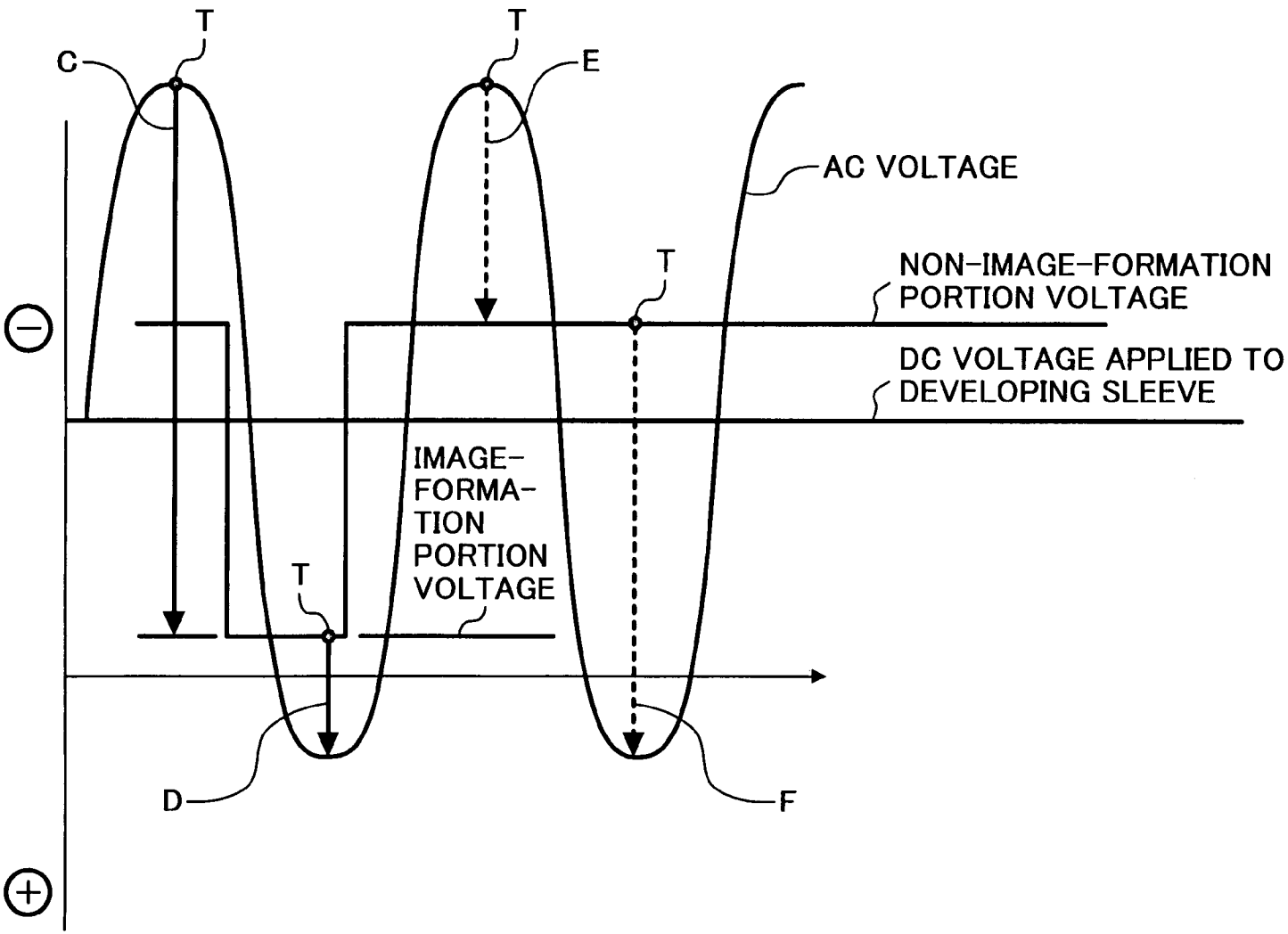
FIG. 8 is a schematic diagram for describing an electrostatic force acting upon the toner on the photosensitive member.

FIG. 8 is a schematic diagram which shows developing with a negative/positive developing method while applying an AC electric field serving as a developing bias electric field using an AC voltage power supply serving as a power supply connected to the developing sleeve 111, more specifically, using a power supply for generating a voltage wherein an AC voltage and a DC voltage are superimposed.

As shown in FIG. 8, an AC electric field can be applied to the region where the photosensitive member 100 and the developing sleeve 111 face one another. In particular, in the present developing method, an AC electric field generated by superimposing an AC voltage and a DC voltage is preferably employed for a bias electric field applied to the developing sleeve 111.

In FIG. 8, the electric field, formed between the developing sleeve 111 and the photosensitive member 100, causes the negatively-charged toner particles T to deposit on the latent image like the DC electric field described previously. In FIG. 8, a force acting upon the toner particles T from the developing sleeve 111 toward the image-formation portion is indicated by arrow C, a force acting upon the toner particles from the image-formation portion toward the developing sleeve 111 is indicated by arrow D, a force acting upon the toner particles from the developing sleeve 111 toward the non-image-formation portion is indicated by arrow E, and a force acting upon the toner particles from the non-image-formation portion toward the developing sleeve 111 is indicated by arrow F.

In this case, because the magnetic carrier particles CC on the developing sleeve 111 are dielectric, the electric field is further intensified on the photosensitive member 100 and the magnetic chains formed of the magnetic carrier particles CC and causes the toner particles T to separate from the magnetic carrier particles CC and deposit on the electrostatic latent image (L). Further, in the present embodiment, an AC electric field causes the toner particles T on the photosensitive member 100 to oscillate during developing so that developing is performed correctly corresponding to the latent image (L), thereby obtaining a high-quality image. Furthermore, when the magnetic chains of the magnetic brush are close to the photosensitive member 100, the electric field is intensified by the magnetic carrier particles CC and causes the toner particles T to be oscillated more actively. As a result, developing is performed correctly corresponding to the latent image (L), thereby obtaining a high-quality image.

More specifically, in the image-formation portion, the AC electric field biased to negative polarity allows the free toner particles T to surely deposit on the image-formation portion under the action of great and small forces directed toward the image-formation portion. Also, toner particles T, if present on the non-image-formation portion, are surely removed from the non-image-formation portion under the action of forces directed toward the developing sleeve 111, so that background contamination is surely obviated.

In the developing method according to the present embodiment, developing is performed with a linear velocity ratio (Vs/Vp) greater than 0.9 and less than 4. The linear velocity ratio (Vs/Vp) is defined as a ratio of the linear velocity Vs of the developing sleeve 111 as to the linear velocity Vp of the photosensitive member 100.

The developing sleeve 111 and the photosensitive member 100 are rotated such that the faces of both in the facing region move in the same direction. Even if the linear velocity of the developing sleeve 111 is less than that of the photosensitive member 100, i.e., the linear-velocity ratio (Vs/Vp) is 1 or less, sufficient toner particles T can deposit on the latent image (L) because the toner particles T are separated from the magnetic carrier particles CC in a sufficient amount.

If the developing sleeve 111 and the photosensitive member 100 are rotated with a linear-velocity ratio (Vs/Vp) greater than 0.9, a sufficient amount of toner particles T are generated for developing due to rotation of the developing sleeve 111, thereby obtaining an image with high image density. The linear-velocity ratio (Vs/Vp) may be further reduced, depending on the amount of free toner particles T available.

If the developing sleeve 111 and the photosensitive member 100 are rotated with a linear-velocity ratio (Vs/Vp) greater than 4, it is likely that the trailing edge of a halftone portion is lost or that a horizontal, thin line image is blurred.

In the developing method according to the present embodiment, developing is performed within the facing region using the free toner particles T without bringing the magnetic chains of the magnetic brush into contact with the photosensitive member 100, as described above. Such a non-contact type development is available with free toner particles T with the magnetic chains of the magnetic brush not contacting the photosensitive member 100 in the facing region. This can be done by adequately balancing the developing gap GP, the scooping amount of the developing agent, which is determined by the doctor gap, the magnetic force of the magnet which is positioned at the facing region, the particle diameter and the saturation magnetic moment of the magnetic carrier particles CC, and the like. The non-contact type development frees a half-tone region from granularity and provides horizontal thin lines and characters clear-cut.

More specifically, in the developing method according to the present embodiment, the developing sleeve 111 causes the developing agent to form a mannetic brush in the developing region while flowing. At this time, the magnetic carrier particles CC, carrying the toner particles T thereon, rise in the form of magnetic brush chains. Subsequently, before the magnetic brush chains fall down, the toner particles T are separated from the surfaces of the magnetic carrier particles CC and become free toner particles T.

In the developing region, the magnetic carrier particles CC, which forms the magnetic chains (magnetic brush), move close to the photosensitive member 100, causing the toner particles T to separate from the magnetic carrier particles CC, and fly toward the latent image (L).

Further, the toner particles T, which have adhered to the latent image (L) on the photosensitive member 100, are not separated from the latent image (L), even if the tips of the magnetic brush become close to the latent image (L) while the magnetic brush is being conveyed together with the developing sleeve 111. This prevents reduction of the amount of adhesion of toner and deterioration in image quality.

Next, description will be made regarding an image forming apparatus including a developing device 110 for performing the developing method described above. The image forming apparatus includes the developing device 110 having a basic configuration described above with reference to FIG. 5. The developing device 110 may be modified as appropriate.

Figure 9:
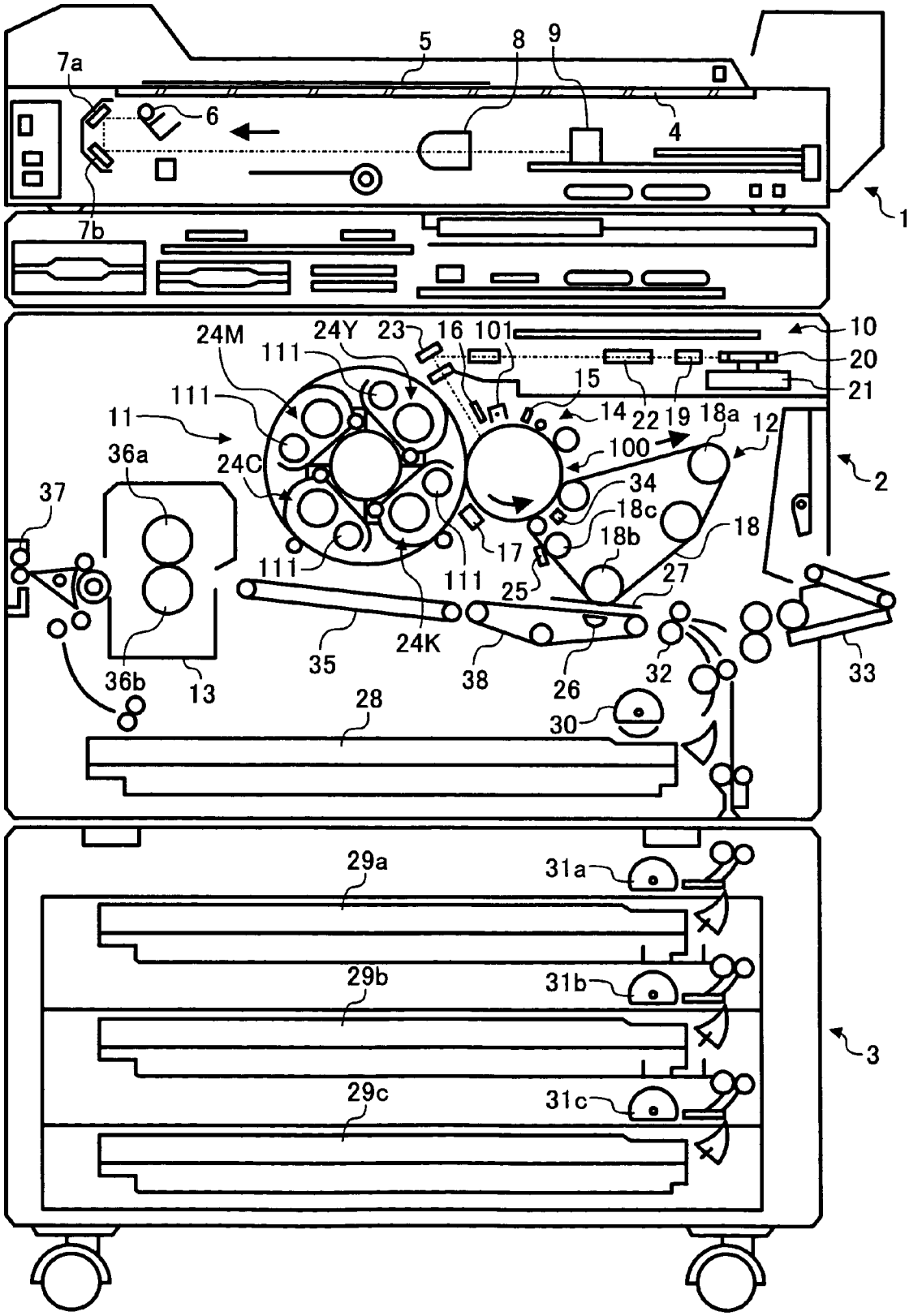
FIG. 9 is a diagram for describing a schematic configuration of an image forming apparatus.

FIG. 9 shows a schematic configuration of a color photocopier serving as an image forming apparatus. The color photocopier comprises a color image read-out device 1 (which will be referred to as a "color scanner" hereafter), a color image recording device 2 (which will be referred to as a "color printer" hereafter), a sheet-supplying bank 3, unshown controlling components, and the like.

In the color scanner 1, an image of an original document 5 positioned on a contact glass 4 is focused onto a color sensor 9 through an illuminating lamp 6, mirror sets 7*a* and 7*b*, and a lens 8, so that the color image information of the original document 5 is converted into electric image signals for each color, e.g., red, green, and blue (which will be referred to as "R", "G", and "B", respectively, hereafter).

The color sensor 9 includes a color separation device for each of R, G, and B, and a photoelectric conversion device such as a CCD (charge coupled device), wherein the image of the original document 5 is subjected to color separation such that three color images are read out at the same time. Subsequently, an unshown image processing unit performs color conversion processing based upon the color image signals of R, G, and B, which have been subjected to color separation, obtained by the color scanner 1, thereby obtaining color image data of black (which will be referred to as "Bk" hereafter), cyan (which will be referred to as "C" hereafter), magenta (which will be referred to as "M" hereafter), and yellow (which will be referred to as "Bk" hereafter).

The color scanner 1 operates so as to obtain the aforementioned color image data of Bk, C, M, and Y, as follows. Upon the color scanner 1 receiving a scanner start signal synchronously with the operation of the color printer 2 described later, the original document 5 is scanned by the optical system formed of the illuminating lamp 6, the mirror sets 7*a* and 7*b*, and the like, in the left direction in FIG. 9 (in the arrow direction). A single color image data is obtained for each scanning. The aforementioned scanning is repeated four times, whereby four color image data sets are obtained in order. The color printer 2 forms color images for each color in order, and the obtained four color images are superimposed, thereby obtaining a final four-color (full-color) image.

The color printer 2 includes the photosensitive member 100 in the shape of a cylinder serving as an image carrying member, a writing optical unit 10, a revolver developing unit 11, an intermediate transfer device 12, a fixing device 13, and the like.

The photosensitive member 100 is rotated counterclockwise in the arrow direction in FIG. 9. Components disposed therearound are: a photosensitive member cleaning device 14, a discharge lamp 15, a charger 101, an electric-potential sensor 16 for detecting the electric potential of the charged face, a developing device 24Y, 24M, 24C, and 24K including a revolver developing unit 11 (which corresponds to the developing device 110 described with reference to FIG. 5), a developing-density-pattern detector 17, an intermediate transfer belt 18 of the intermediate transfer device 12, and the like.

The writing optical unit 10 converts the color image data from the color scanner 1 into light signals to perform writing with the light, thereby forming an electrostatic latent image on the photosensitive member 100, corresponding to the image of the original document 5. The writing optical unit 10 includes a semiconductor laser 19 serving as a light source, an unshown laser-emission driving control unit, a polygon mirror 20, a motor 21 for rotating the polygon mirror 20, a f/θ lens 22, a reflecting mirror 23, and the like.

The revolver developing unit 11 includes a Bk-developing device 24K, a C-developing device 24C, an M-developing device 24M, a Y-developing device 24Y, and a revolver rotational driving unit for rotating each of the aforementioned developing devices counterclockwise in the arrow direction in FIG. 9 (described below).

Each developing device includes the developing sleeve 111 having the magnets therewithin, which is disposed facing the photosensitive member 100. The two-component developing agent containing toner and magnetic carrier carrying the toner are carried on the surface of the developing sleeve 111 so as to be transported to the facing region between the photosensitive member 100 and the developing sleeve 111. An electric field is applied to a space between the developing sleeve 111 and the photosensitive member 100, thereby developing a latent image formed on the surface of the photosensitive member 100 with toner.

Toner particles are stirred and mixed with ferrite carrier particles serving as magnetic carrier particles, and thus the toner particles are negatively charged. A developing bias voltage, wherein a negative DC voltage and an AC voltage are superimposed, is applied to each developing sleeve 111 using an electric power supply for supplying developing bias voltage. As a result, the developing sleeve 111 is biased to a predetermined electric potential relative to a conductive core of the photosensitive member 100. In the waiting state of the photocopier, the revolver developing unit 11 is set such that the Bk developing device 24K is positioned at the developing position. Upon starting copying operations, the color scanner 1 reads out the Bk-color image at a predetermined timing, following which light writing is performed based upon the color image data using a laser beam so as to form an electrostatic latent image. The electrostatic latent image formed based upon the Bk image data will be referred to as a "Bk-latent image" hereafter. The terms "C-latent image", "M-latent image", and "Y-latent image", will be used hereafter in the same way.

Before the front end of the Bk-electrostatic latent image arrives at the developing position to develop the Bk-electrostatic latent image from the front end, the Bk-developing sleeve 111 starts rotating so as to develop the Bk-electrostatic latent image with Bk toner. The subsequent Bk-electrostatic latent image region is developed in the same way, and immediately upon the rear end of the electrostatic latent image passing through the developing position, the revolver developing unit 11 is rotated such that the next color developing device is positioned at the developing position. The aforementioned rotation of the revolver developing unit 11 is completed at least before the front end of the electrostatic latent image based on the next color image data arrives at the developing position. Description will be made in detail later regarding the revolver developing unit 11.

The intermediate transfer device 12 includes an intermediate transfer belt 18, a belt cleaning device 25, a transporting belt 38, a sheet-transfer corona discharger 26 (which will be referred to as a "sheet-transfer discharger" hereafter), and the like. The intermediate transfer belt 18 is spanned around a driving roller 18*a*, a backup roller 18*b* for image transfer, a backup roller 18*c* for cleaning, and a group of driven rollers, and is rotated by an unshown driving motor.

The intermediate transfer belt 18 is formed of ETFE (Ethylene-Tetra-Fluoro-Ethylene) with a surface electric resistance of around $10^8$ to $10^{10}$ $\Omega/cm^2$. The belt cleaning device 25 includes an inlet seal, a rubber blade, a discharge coil, a separation mechanism for the inlet seal and the rubber blade. The inlet seal and the blade are separated from the intermediate transfer belt 18 by the separation mechanism during transfer of the second, third, and fourth color image onto the intermediate transfer belt 18 following the Bk image, which is the first color image, being transferred onto the intermediate transfer belt 18. The sheet-transfer discharger 26 has a function for applying a voltage where an AC voltage and a DC voltage are superimposed, or a DC voltage, with the corona discharge method, thereby transferring the superimposed toner image formed on the intermediate transfer belt 18 onto a recording sheet 27 at the same time.

The color printer 2 further includes a recording-sheet cassette 28 and the sheet-supplying bank 3 having recording-sheet cassettes 29*a*, 29*b*, and 29*c*, for storing recording sheets 27 with various kinds of sizes. The recording sheet 27 with the specified size is picked up and transported toward a registration roller pair 32 by rotating a sheet-feed roller 30, 31*a*, 31*b*, or 31*c*. The color printer 2 further includes a manual sheet-feed tray 33 on the right side face thereof for manually feeding OHP sheets, cardboard sheets, or the like.

In a color photocopier having the above-described configuration, upon start of the image formation cycle, first, the photosensitive member 100 is rotated counterclockwise in the arrow direction in FIG. 9, and the intermediate transfer belt 18 is rotated clockwise in the arrow direction in FIG. 9, by an unshown driving motor. Developing is performed such that a Bk-toner image, a C-toner image, an M-toner image, and a Y-toner image, are formed while rotating the intermediate transfer belt 18. Finally, the Bk-toner image, the C-toner image, the M-toner image, and the Y-toner image, are superimposed on the intermediate transfer belt 18 in order, whereby a full-color toner image is formed.

Description will be made below regarding formation of the Bk-toner image. First, the charger 101 performs corona discharge such that the photosensitive member 100 is negatively and uniformly charged. Subsequently, the photosensitive member 100 is exposed by raster scanning based upon the Bk-color image signals using the semiconductor laser 19. In the step of exposure in a raster manner, the charge on the exposed portion, which has been uniformly charged in the earliest stage, is weakened in proportion to the exposure amount, thereby forming the Bk-electrostatic latent image.

Subsequently, the negative-charged Bk-toner particles on the Bk-developing sleeve come into contact with the Bk-electrostatic latent image. As a result, while the toner particles do not adhere to the portion on the photosensitive member 100 where the charge has not been weakened, the toner particles adhere to the portion where the charge has been weakened, i.e., the exposed portion, thereby forming the Bk-toner image corresponding to the electrostatic latent image.

The Bk-toner image formed on the photosensitive member 100 is transferred onto the surface of the intermediate transfer belt 18, which is moving at the same speed as the photosensitive member 100, by a belt transfer device 34. Transfer of a toner image from the photosensitive member 100 onto the intermediate transfer belt 18 will be referred to as "belt transfer" hereafter.

Remaining toner particles on the photosensitive member 100, which have not been used for transfer, are removed by the photosensitive member cleaning device 14 for reuse on the photosensitive member 100. The collected toner is stored in an unshown used-toner tank through a collecting pipe.

Subsequently, to form a C-image, the C-image data is read out by the color scanner 1 at a predetermined timing, and laser writing is performed based upon the C-image data, thereby forming the C-electrostatic latent image. After the rear end of the preceding Bk-electrostatic latent image moves away from the developing position, but before the front end of the C-electrostatic latent image arrives at the developing position, the revolver developing unit 11 is rotated to bring the C-developing device 24C to the developing position. In this condition, the C-developing device 24C develops the C-electrostatic latent image with the C-toner particles.

The subsequent C-electrostatic latent image region is developed in the same way. After the rear end of the C-electrostatic latent image moves away from the developing position, the revolver developing unit 11 is rotated in the same way as with the above-described Bk-developing using the Bk developing device 24K such that the next M-developing device 24M is located at the developing position. The rotation is also completed before the front end of the next M-electro static latent image arrives at the developing position. The read-out of the image data, formation of the electrostatic latent image, and developing, are performed in the M-image formation step and the Y-image formation step in the same way as with the above-described Bk-image formation step and the C-image formation step, and accordingly, description thereof will be omitted.

The toner images of Bk, C, M, and Y, formed on the photosensitive member 100 in order, are subjected to positioning so as to be superimposed on a single face of the intermediate transfer belt 18, thereby forming a four-color-superimposed toner image. In the next transfer step, the four-color toner image is transferred onto the recording sheet 27 all at once by the sheet-transfer device 26.

At the time of image formation, the recording sheet 27 is supplied from any of the recording-sheet cassettes 28, 29*a*, 29*b*, and 29*c* and manual sheet-feed tray 33, and waits at the nip of the registration roller pair 32. Upon the front end of the toner image formed on the intermediate transfer belt 18 reaching the sheet-transfer device 26, the registration roller pair 32 is driven such that the front end of the recording sheet 27 just matches the front end of the toner image, and thus positioning is performed for the recording sheet 27 and the toner image under assistance from the transporting belt 38.

Subsequently, the recording sheet 27, which is pressed into contact with the toner image on the intermediate transfer belt 18, passes through above the positive-charged sheet-transfer device 26. In this case, the recording sheet 27 is positively charged due to corona discharge current, and accordingly, most of the toner image is transferred onto the recording sheet 27. Subsequently, the recording sheet 27 passes through the portion facing an unshown separation-discharge device using corona discharge generated from a voltage wherein an AC voltage and a DC voltage are superimposed, which is disposed on the left side of the sheet-transfer device 26, so as to be discharged. The discharged recording sheet 27 is separated from the intermediate transfer belt 18, and is moved from the transporting belt 38 to a transporting belt 35.

The recording sheet 27 having the four-color superimposed toner image which has been transferred from the intermediate transfer belt 18, is transported to a fixing device 13 by the transporting belt 35. In the fixing device 13, the toner image is fused and fixed at the nip part between a fixing roller 36*a* and a pressure roller 36*b*. The recording sheet 27 with the fixed toner image is discharged from the apparatus by a sheet discharging roller pair 37, and is stacked face-up on an unshown copy tray, thereby obtaining a full-color copy.

After the transfer, the surface of the photosensitive member 100 is cleaned up by the photosensitive member cleaning device 14 including a brush roller and a rubber blade, and is uniformly discharged by the discharge lamp 15. On the other hand, after the transfer of the toner image from the intermediate transfer belt 18 to the recording sheet 27, the blade of the belt cleaning device 25 is pressed into contact with intermediate transfer belt 18 again by the separation mechanism in order to clean up the surface of the intermediate transfer belt 18.

In a case of repeated copying, with regard to the operation of the color scanner 1 and image formation on the photosensitive member 100, the flow consecutively proceeds from the image formation step of the fourth color (Y) of the first image to the image formation step of the first color (Bk) of the second image. With regard to the intermediate transfer belt 18, the flow consecutively proceeds from the step for transferring the four-color-superimposed toner image of the first image onto the recording sheet 27 at once, to the step for cleaning the intermediate transfer belt 18 with the belt cleaning device 25 disposed thereon so as to prepare the region of the intermediate transfer belt 18 for performing belt-transfer of the Bk-toner image of the second image. The following steps are performed in the same way as with the first image.

While description has been made regarding a copy mode for obtaining four-color images, a copy mode may be made for obtaining three-color images or two-color images. In this case, the operation described above is repeated a number of times corresponding to the desired number of colors and the desired number of copies.

In a single-color copy mode, copy operation is performed while maintaining only the developing device of the specified color of the revolver developing unit 11 to perform developing operation, with the blade of the belt cleaning device 25 being pressed contact with the intermediate transfer belt 18 until a specified number of copies are completed.

In a full-color copy mode using a sheet of A3 size, image formation is preferably performed such that a single-color toner image is formed for each cycle of the intermediate transfer belt 18, and a four-toner image is obtained following the four cycles thereof. However, with the small-sized image forming apparatus including the intermediate transfer belt 18 with a reduced circumference length, in order to perform a copying operation while maintaining the copy speed for the small-sized image without reducing the copy speed for the large-sized image, image formation is preferably performed such that a single-color toner image is formed every two cycles of the intermediate transfer belt 18. In this case, following transfer of the Bk-toner image onto the intermediate transfer belt 18, the color printer 2 does not perform developing and transfer during the next cycle of the intermediate transfer belt 18, i.e., the intermediate transfer belt 18 is rotated without a copying operation. Subsequently, developing is performed with the next color toner of C and the generated C-toner image is transferred onto the intermediate transfer belt 18 during the following cycle thereof The following steps are performed in order in the same way. The revolver developing unit 11 is rotated for switching the developing device during the aforementioned cycle of the intermediate transfer belt 18 without a copy operation.

The image forming apparatus according to the embodiment of the present invention includes the developing device for performing developing with free toner particles, and accordingly, developing is performed in a broad developing region, thereby increasing the toner amount which is used for developing. This allows the image forming apparatus to be designed with broad allowable ranges for the developing gap, the rotation speed of the developing sleeve, and the like. Further, this allows the image forming apparatus to provide an image with high-quality solid portions and fine line portions. In particular, this allows a color image forming apparatus to provide a color image in which a half-tone portions are reproduced with high accuracy.

In the present embodiment, the diameter of the photosensitive member 100 is set to 90 mm, and the diameter of the developing sleeve 111 is set to 18 mm. The photosensitive member 100 and the developing sleeve 111 are rotated with respective linear velocities of 156 mm/sec and 214 mm/sec, respectively. That is, the ratio of the linear velocity of the photosensitive member 100 as to the linear velocity of the developing sleeve 111 is 1.4. Even if the ratio of the linear velocity of the photosensitive member 100 as to the linear velocity of the developing sleeve 111, i.e., (Vs/Vp) is reduced to 0.9, which is the minimal permissible linear velocity ratio, the required image density can be obtained.

The developing-agent casing stores the developing agent formed of toner T and magnetic carrier CC. The developing agent is mixed and stirred by the stirring screw rotated with the rotational speed of 152 rpm by an unshown driving device, whereby the toner T is charged due to friction.

Each magnetic carrier particle CC used here is formed of a copper-zinc ferrite particle in the shape of a sphere coated with silicone resin with an average particle diameter of 58 μm, magnetization of 65 emu/g ($8.2\times10^{-5}$ Wb○m/kg), and volume resistance of 8.5 LogΩ○cm. Each toner particle T is formed of polyol resin containing pigment and charge-control agent therewithin, and further containing hydrophobic silica of 0.7% by weight, hydrophobic titanium of 0.85% by weight on the surface thereof, with an average particle diameter of 7 μm, and with density of 0.33 g/cm$^3$ or more. Carbon-black pigment is employed for the black toner, bis-azo pigment is employed for the yellow toner, quinacridone pigment is employed for the magenta toner, and copper-phthalocyanine pigment is employed for the cyan toner. The mixed developing agent is formed with an initial toner concentration of 5% by weight, and with an initial toner charge of −20 to −35 μC/g for each color.

Description has been made regarding an example wherein the rotational developing device (revolver developing unit 11) is disposed on the side of the photosensitive member 100 as shown in FIG. 9, the revolver developing unit 11 may be disposed underneath the photosensitive member 100. In this case, toner is prevented from scattering in the developing device 110 (FIG. 5).

Evaluation was made regarding developing performed using the above-described developing agent while maintaining non-contact between the magnetic brush and the photosensitive member 100. While evaluation was made regarding only an example using the yellow toner T, it is assumed that an example using other color toner such as black toner exhibits the same results.

FIRST EXAMPLE

Example wherein the Middle Portion of the Magnetic-Chain Rising Region is Positioned at the Nearest Position The present inventor made analysis of behavior of the magnetic carrier particles CC and the toner particles T, occurring in the facing region based upon video images acquired with a frame rate of 9,000 to 40,500 frames per second using a stereoscopic microscope (SZH10 manufactured by Olympus Corporation) and a high-speed camera (FASTCAM-Ultima-I$^2$ manufactured by PHOTRON Limited). Description will be made regarding developing performed in the facing region with reference to the analysis results.

The developing sleeve 111 is rotated in the rotational direction 111R under the magnetic field distribution due to the magnet layout shown as a basic configuration in FIG. 5. As a result, the developing agent is scooped up due to the magnetic field distribution P4, and passes through the doctor gap formed by the doctor blade 114 such that the amount of the developing agent is regulated to a predetermined amount. The regulated developing agent is transported in the rotational direction due to the magnetic field distribution P6 (since the influence of the magnetic field distribution P5 upon the developing agent around the doctor blade 114 becomes smaller the closer to the facing region), whereby the developing agent reaches the facing region.

The magnetic field distribution P1 is formed in the facing region, causing formation of the magnetic brush in the magnetic field distribution region, and furthermore, causing the magnetic brush to flow corresponding to rotation of the developing sleeve 111. The toner particles transfer to the latent image in the developing region within the facing region, whereby developing is performed. Most of the remaining developing agent which has been used for developing is removed due to the magnetic field distribution P3 for removing the magnetic chains, and falls on the side of the stirring screw 112.

Figure 10:
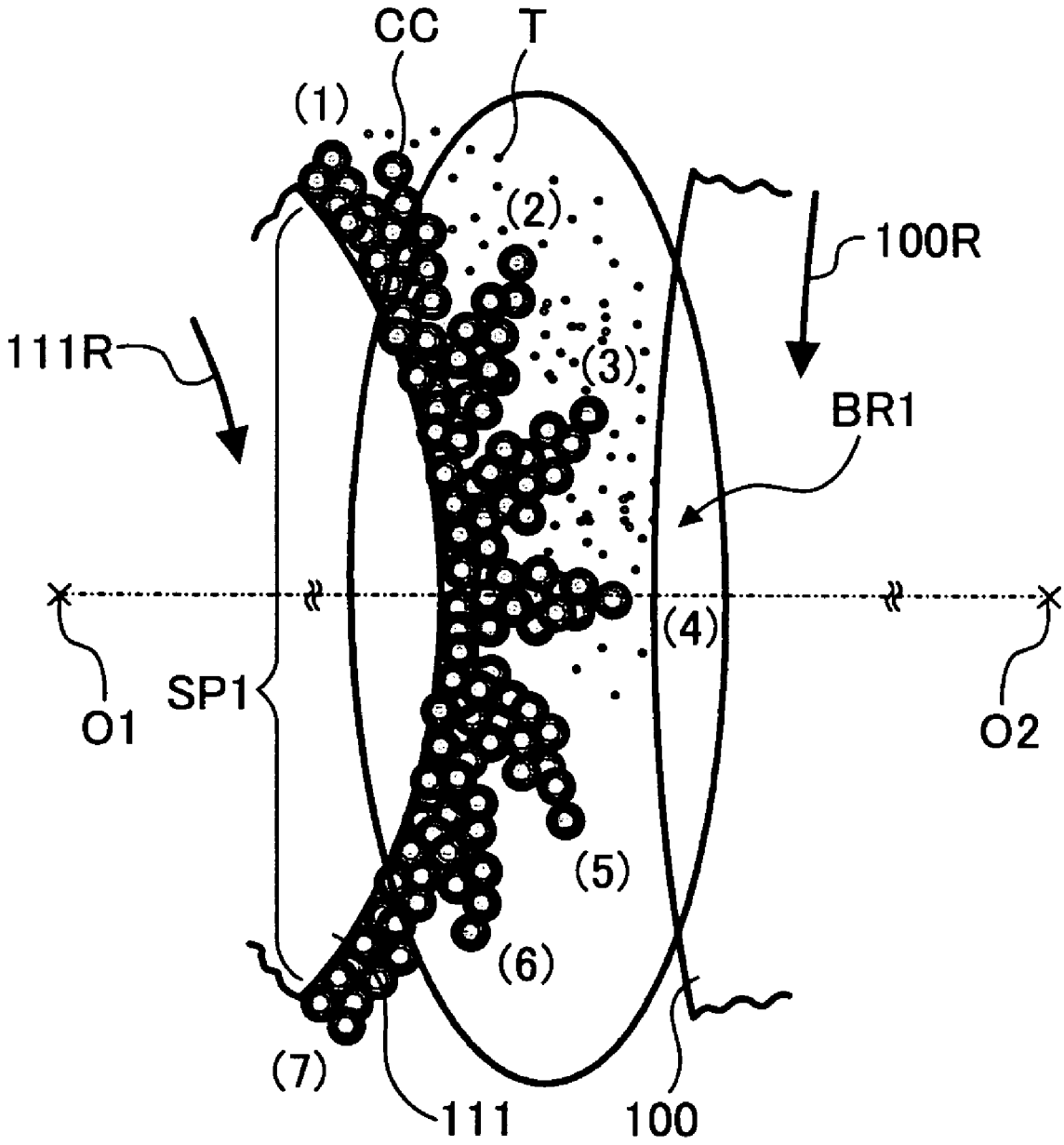
FIG. 10 is a diagram for describing an example wherein a magnetic chain rising region is formed in a facing region.

In the present example, developing is performed with a configuration wherein the middle portion of the magnetic chain rising region is positioned at the nearest position. FIG. 10 shows the relation between the developing sleeve 111, the photosensitive member 100, and the magnetic chain rising region. The region where the free toner particles T are generated contains the nearest position of the photosensitive member 100 and the developing sleeve 111.

FIG. 10 shows the magnetic brush and the magnetic chain rising region under the basic configuration of the developing device 110 shown in FIG. 5. In FIG. 10, reference character BR1 denotes the magnetic brush due to the magnetic field distribution P1. The magnetic brush BR1 is formed of the magnetic chains along a number of magnetic lines of force (1) through (7), which have been described with reference to FIG. 6. The magnetic carrier particles CC forming magnetic chains flow while carrying the toner particles T, and the toner particles T separate from the magnetic carrier particles CC in the flow of the magnetic chains, whereby free toner particles T are generated.

Further, description will be made in detail regarding observed results. The magnetic brush BR1 is formed on the developing sleeve 111 regardless of polarity of the first magnet. The developing agent is pressed into contact with the developing sleeve 111 due to great magnetic force in the direction tangent to the developing sleeve 111 in the region between the magnets which corresponds to the stage prior to the magnet chains rising (e.g., the region on the developing sleeve 111 between the sixth and first magnets, or between the first and second magnets).

As shown in FIG. 10, each magnetic carrier particle CC in the developing agent layer has magnetic force. Accordingly, while the magnetic force in the direction perpendicular to the developing sleeve 111 is small in the region between the magnets, the magnetic force in the direction tangent to the developing sleeve 111 is great in the region between the magnets since the magnets adjacent one to another are disposed with polarities inverse one to another. Accordingly, the magnetic agent is confined in the shape of a thin film, and the magnetic carrier particles CC are confined in the developing agent layer, unlike the region facing the magnet.

When the developing agent layer arrives at the position corresponding to the first magnet, the magnetic chains formed of a certain number of magnetic carrier particles CC rise. In general, the number of the magnetic carrier particles CC forming the magnetic chain is determined not only by the amount of the developing agent which passes through the doctor blade 114, but also by the magnetic properties of the magnetic carrier particles CC, and the magnitude and the direction of the magnetic force due to the magnetic forces of the magnets, the shapes of the magnets, and the layout of the magnets.

Although the first magnet is fixed in place, the angle and size of the magnetic line of force, as measured at the position where the brush chains start rising, varies because the developing sleeve 111 is rotated. In this case, the magnetic brush does not immediately rise along the magnetic lines of force due to delay in the magnetic response of the magnetic carrier particles CC. Further, although the magnetic chain formed of a great number of the magnetic carrier particles CC rises by overcoming the restraint of the assembly, the polarities of all of the magnetic carrier particles CC are directed in the same direction under the action of the intense magnetic field of the magnet and therefore repulse each other. For these reasons, the developer layer suddenly splits with the result that the magnetic carrier particles CC rise in the form of a magnetic chain. Consequently, the toner particles T, confined in the assembly of the magnetic carrier particles CC, are made free. This, coupled with the strong centrifugal force acting on the toner particles T deposited on the magnetic carrier particles CC, releases the toner particles T from the magnetic carrier particles CC as free toner particles T.

Further, the magnetic chains rise and lie with acceleration, not at a constant speed, due to change in the magnetic field. Accordingly, the toner particles T are affected by inertial force, causing the toner particles T to separate from the surfaces of the magnetic carrier particles CC, whereby the free toner particles T are released in the developing space. The free toner particles T, which have separated from the surfaces of the magnetic carrier particles CC, are not affected by the electrostatic adhesion force and the physical adhesion force from the magnetic carrier particles CC, and thus, the free toner particles T can be easily controlled using the developing electric field.

In developing using the free toner particles T generated from the magnetic brush in the magnetic chain rising region SP1 formed in the facing region shown in FIG. 10, sufficient toner particles T adhere to the latent image, which is to be developed, reaching a state of saturation, in the stages corresponding to the magnetic chain regions upstream of the magnetic chain rising region (4). Accordingly, the latent image is hardly developed in the stages corresponding to the magnetic chain rising regions (5) through (6) positioned downstream from the magnetic chain rising region (4).

In the developing wherein an AC electric field is employed as an electric field applied to a space between the developing sleeve 111 and the photosensitive member 100, the toner particles T are vibrated, and the electric potential of the toner particles T is adjusted, such that the toner particles T adhere to the latent image even in the stages corresponding to the magnetic chain rising region (5) through (6).

In the condition shown in FIG. 10, the magnetic chain rising region assigned to the magnetic brush BR1 is located at the nearest position. Free toner particles 1 are generated and deposited on the photosensitive member 100 on the path along which the distance between the developing sleeve 111 and the photosensitive member 100 decreases little by little up to the nearest position. This, coupled with the toner particles T caused to separate from the photosensitive drum 100 by the magnetic brush BR1, insures a high-quality image with high density at a solid portion and with excellent sharpness of a character and fine line.

As shown in FIG. 10, the magnetic brush BR1 and the magnetic chain rising region SP1 are formed at the nearest position (on the imaginary line connecting between the center O1 and the center O2), and developing is performed while maintaining non-contact of the magnetic brush BR1 and the photosensitive member 100. In the present example, excellent developing can be performed while achieving the object of the present invention, as described later.

As shown in FIG. 10, in the magnetic chain rising region SP1 positioned at the nearest position, developing is performed using the free toner particles T in the region, where the magnetic chains are rising, under assistance from action of the magnetic chains facing the nearest position. The magnetic chain positioned at the middle portion of the magnetic chain rising region of the magnetic brush BR1 is positioned at the nearest position where the magnetic brush BR1 is the closest to the photosensitive member 100 while maintaining a non-contact relation between the magnetic brush BR1 and the photosensitive member 100. This causes the excessive toner particles T, which have adhered to the photosensitive member 100 in developing, to separate from the photosensitive member 100, and causes the separated toner particles T to adhere to the magnetic carrier particles CC forming the magnetic chains. Thus, the excessive toner particles T, which have been used in developing of the non-image-formation portion and the image-formation portion with low electric potential, return to the magnetic chains, thereby obtaining a high-quality image. In DC-bias developing, it is assumed that developing is completed in the stage that the magnetic brush becomes the closest to the photosensitive member 100. On the other hand, in AC-bias developing, vibration of the toner particles T in a space between the photosensitive member 100 and the magnetic brush is observed. The magnetic chain positioned at the middle portion of the magnetic chain rising region of the magnetic brush BR1 is positioned at the nearest position where the magnetic brush BR1 is the closest to the photosensitive member 100 while maintaining a non-contact relation between the magnetic brush BR1 and the photosensitive member 100. This causes the excessive toner particles T, which have adhered to the photosensitive member 100 in developing, to separate from the photosensitive member 100, and causes the separated toner particles T to adhere to the magnetic carrier particles forming the magnetic chains. Thus, the excessive toner particles T, which have been used in developing of the non-image-formation portion and the image-formation portion with low electric potential, return to the magnetic chains, thereby obtaining a high-quality image. In DC-bias developing, it is assumed that developing is completed in the stage that the magnetic brush becomes the closest to the photosensitive member 100. On the other hand, in AC-bias developing, vibration of the toner particles in a space between the photosensitive member and the magnetic brush is observed.

The tips of the magnetic brush at the nearest position moves close to the photosensitive member 100, causing the toner particles T to separate from the magnetic carrier particles CC and fly toward to the latent image L, whereby developing is performed. In the stage wherein the magnetic brush is transported by the developing sleeve 111, even if the tips of the magnetic brush becomes close to the photosensitive member 100, the toner particles T, which have adhered to the latent image (L) formed on the photosensitive member 100, do not separate therefrom, thereby obtaining an image without reducing the amount of the toner adhesion, and without deteriorating image quality.

Next, description will be made regarding the observed results using a pseudo photosensitive member 100*a* shown in FIG. 11 instead of the photosensitive member 100 in order to observe the steps that the line-shaped latent images in the main scanning direction and the sub-scanning direction are developed with the toner. The pseudo photosensitive member 100*a* shown in FIG. 11 has a configuration wherein a comb-shaped electrode 200X with the length in the main scanning direction, and a comb-shaped electrode 200Y with the length in the sub-scanning direction, are formed on a transparent glass drum 100*a* with ITO evaporation, and are coated with polycarbonate resin, which is used for the photosensitive member, with the dipping method.

Figure 11:
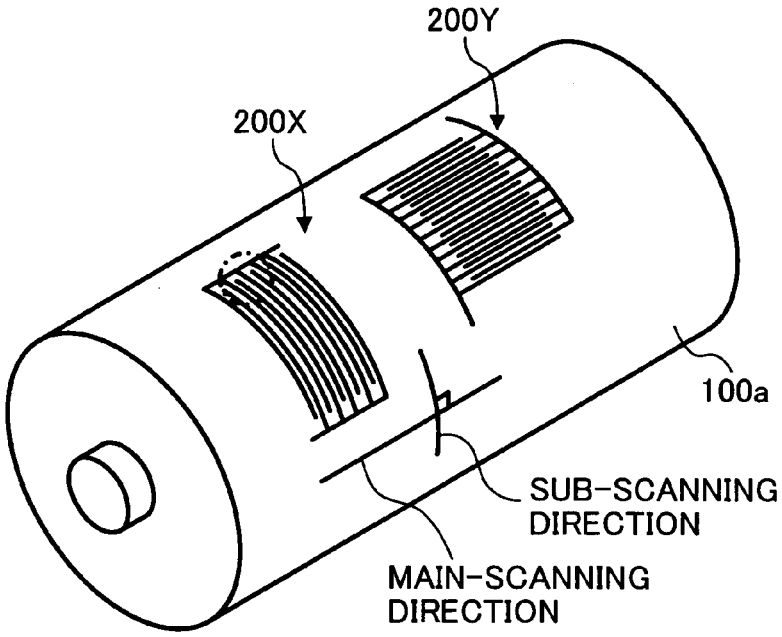
FIG. 11 is a perspective view of an exemplary pseudo photosensitive member.
Figure 12:
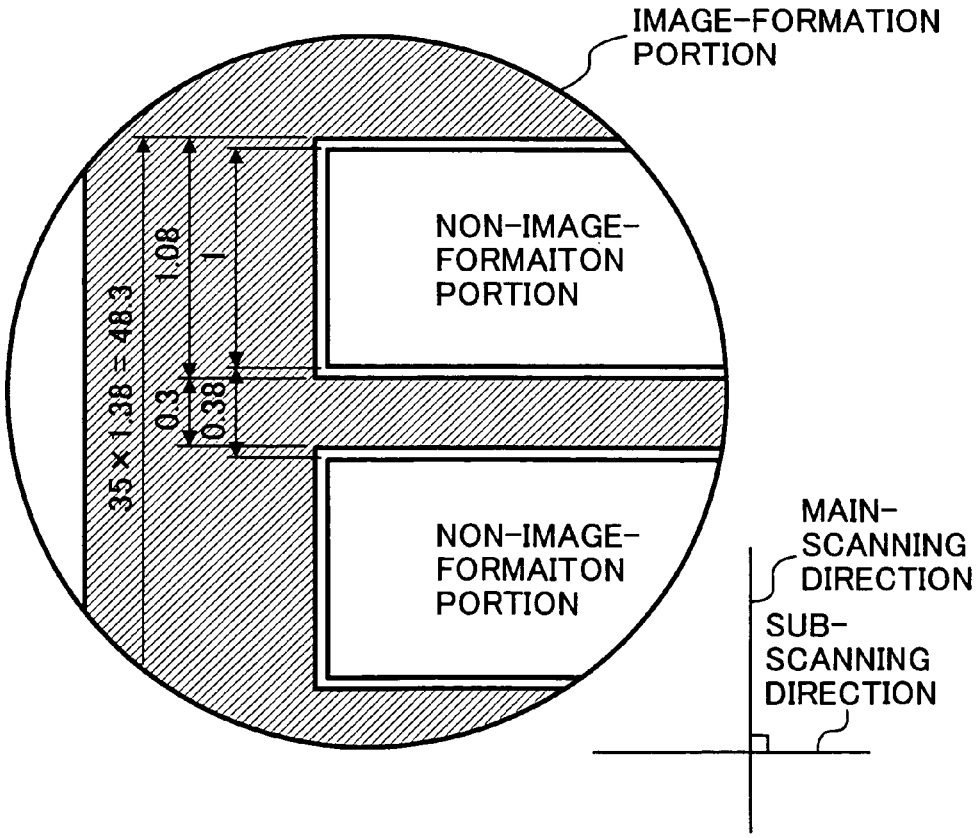
FIG. 12 is a partially enlarged view of a comb-shaped electrode.

FIG. 12 is an enlarged view of the comb-shaped electrode 200X encircled in FIG. 11. In FIG. 12, the hatched region represents an image-formation portion (electric latent image portion), and the non-hatched rectangular portions represent non-image-formation portions. Further, reference numerals denote the sizes of the various portions in millimeters. In this case, the image-formation portion is formed in the shape of a line which is long in the sub-scanning direction (rotational direction of the pseudo photosensitive member 100*a*) and with a line width of 0.3 mm. The comb-shaped electrode 200Y is formed in the same way, except for the direction of the length.

Adhesion of the toner in developing of the above-described pseudo photosensitive member 100*a* was observed using video images acquired with a frame rate of 9,000 to 40,500 frames per second using a stereoscopic microscope (SZH10 manufactured by Olympus Corporation) and a high-speed camera (FASTCAM-Ultima-$I^2$ manufactured by PHOTRON Limited).

The developing was performed using the yellow toner (TC=7% by weight, q/m=−18 μC/g) while applying a developing bias voltage where a DC voltage component $V_{DC}$ of −800 V and an AC voltage component $V_{PP}$ of 1 kV with a frequency f of 2.5 kHz having a rectangular wave shape with a duty ratio of 50% are superimposed, with electric potential of the image-formation portion on the photosensitive member of −50 V, with the electric potential of the non-image-formation portion on the photosensitive member of −900 V, and with the developing gap GP of 0.7 mm.

Figure 13:
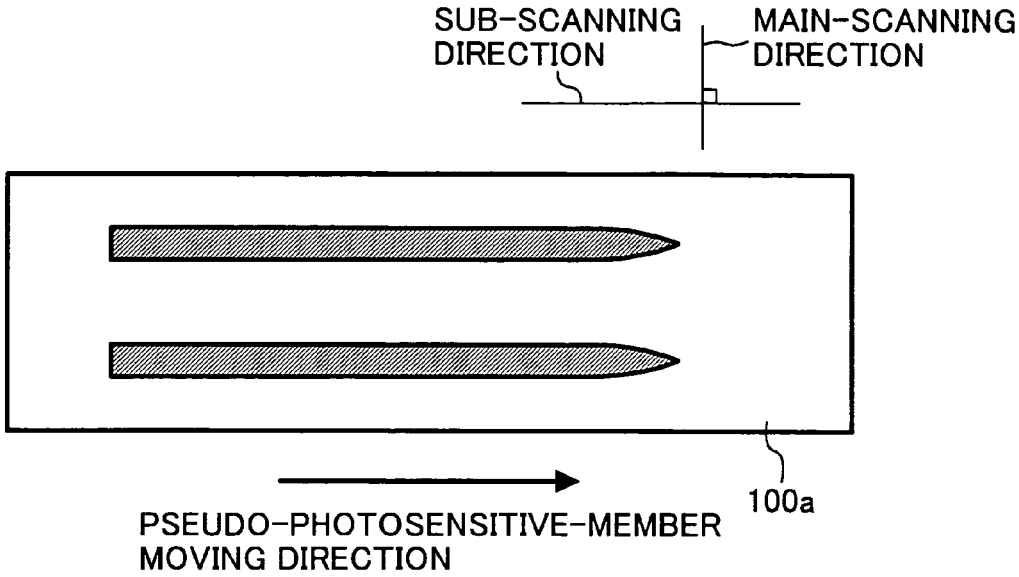
FIG. 13 is a diagram which shows an illustration of the developing state of a line pattern.
Figure 14:
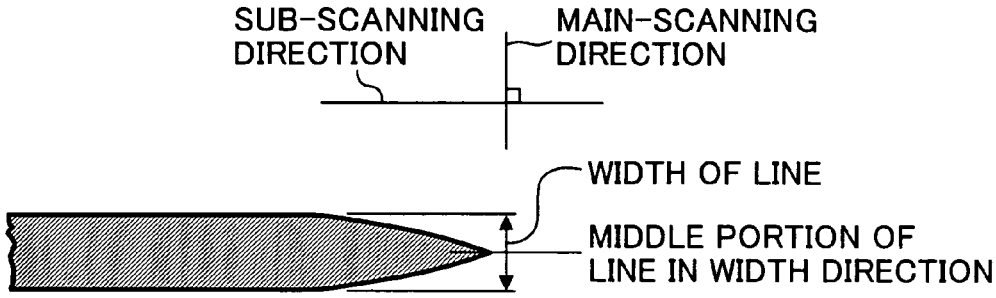
FIG. 14 is a partially enlarged view of the line pattern of FIG. 13.

FIG. 13 shows two line-shaped toner images with the length in the sub-scanning direction, observed in the image-formation step. FIG. 14 is an enlarged view of the tip of the line-shaped toner image. In FIGS. 13 and 14, the hatched region represents the portion developed with the toner. In FIG. 13, both the pseudo photosensitive member 100*a* and the developing agent move from the right to the left. In the present example, developing is performed with the free toner particles from the position (the position upstream of the nearest position shown in FIG. 10) upstream of the developing nip (the nearest position), where the developing agent comes into contact with the photosensitive member in conventional developing, and the right end of the toner image is sharpened with the middle portion of the line-shaped latent image in the width direction as the center, in the shape of a ski. Accordingly, it has been found that developing is performed starting from the middle portion of the line-shaped latent image in the width direction.

Figure 15:
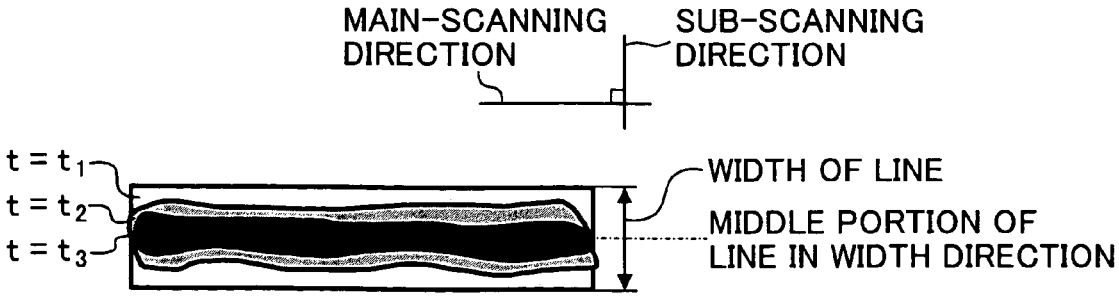
FIG. 15 is a diagram which shows an illustration of the developing state of a line pattern.

Likewise, with the line-shaped image with the length in the main scanning direction, it has been found from the observed results that developing is performed starting from the position upstream of the developing nip, where the developing agent comes into contact with the photosensitive member in conventional developing. FIG. 15 is a schematic diagram which shows a part of the line-shaped latent image obtained from the observed results. FIG. 15 shows the steps of formation of the toner image at the three points in time t ($t_1$, $t_2$, and $t_3$). At the point in time $t_1$, the right-hatched region is developed, at the point in time $t_2$, the width of the line-shaped toner image becomes great (left-hatched region), and at the point in time $t_3$, the most part of the line-shaped latent image is filled in with the developing toner. Accordingly, it has been found that developing is performed starting from the middle portion of the line-shaped latent image in the width direction, in the same way as with the line-shaped image with the length in the sub-scanning direction.

Next, evaluation of the image was made using the image forming apparatus employing such a developing method. As a result, an image is obtained with an excellent reproduction at a solid portion, with a horizontal/vertical ratio of 1.01, and with excellent image quality at an edge portion.

SECOND EXAMPLE

Figure 16:
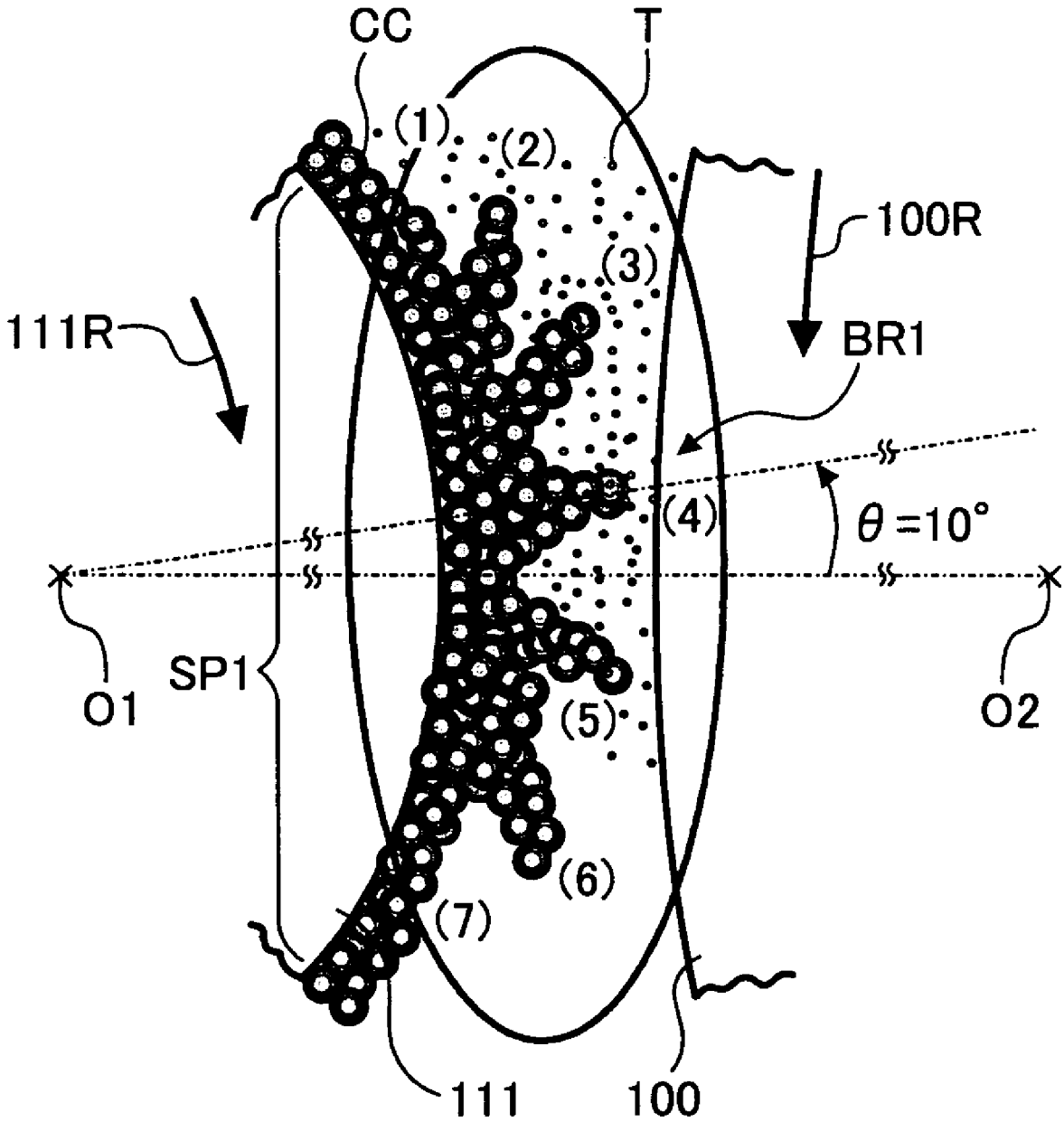
FIG. 16 is a schematic diagram for describing an example wherein a magnetic chain rising region is formed in the facing region.

Example wherein the Center Portion of the Magnetic Brush Rising Region is Shifted Upstream from the Nearest Portion As shown in FIG. 16, the present example has the same configuration as shown in FIG. 10 described above, i.e., the configuration wherein the developing gap is adjusted such that the magnetic brush does not come into contact with the photosensitive member 100 during developing, except for the position of the center of the first magnet serving as the device for generating the magnetic field, located upstream of the nearest position on the imaginary line connected between the center O1 and the center O2. Accordingly, the positions of the second and sixth magnets are adjusted such that a suitable magnetic field is obtained.

Thus, in the present developing method, the magnetic chains formed of the magnetic carrier particles CC flow while forming the magnetic brush. Further, the region, where the free toner particles T are generated due to separation thereof from the surfaces of the magnetic carrier particles CC, is controlled by adjusting the position of the magnet included in the developing sleeve 111, or the magnetic force, in the step for causing the flow of the magnetic chains.

Thus, in the present example, the positions of the magnetic chain rising region SP1 and the magnetic brush BR1, formed around the developing sleeve 111, are shifted upstream as compared with the basic configuration shown in FIG. 10. Specifically, the magnetic chain rising region (4) is formed upstream, and the magnetic chain rising region (5) is formed downstream, from the nearest position on the imaginary line connected between the center O1 and the center O2 in the direction for transporting the developing agent. In the present example, the free toner particles T are also generated in the region containing the nearest position where the photosensitive member 100 and the developing sleeve 111 face one another. Further, in the present example, developing is performed while maintaining non-contact between the magnetic brush BR1 and the photosensitive member 100. An excellent developing is performed while achieving the object of the present invention.

Developing was performed under the same conditions as with the first example, except for the shift angle θ of 10° shown in FIG. 16. In this case, the nearest position is located downstream from the position where the greatest amount of the magnetic chains of the magnetic brush BR1 rise (the position between (4) and (5) in FIG. 16). In this region around the nearest position, a great amount of the free toner particles T are suspended in a space, and the free toner particles T can move to the latent image (L) formed on the photosensitive member 100. Further, the electric field applied to the space around the nearest position has the greatest strength, thereby enabling excellent developing with the free toner particles T in this region.

With such a configuration, the most part of the cloud-like or smoke-like free toner particles T generated in the region where the magnetic brush is formed readily moves to the image-formation portion on the photosensitive member 100 due to the developing electric field. Next, description will be made step by step, regarding developing with reference to FIGS. 17A through 17C.

Figure 17A:
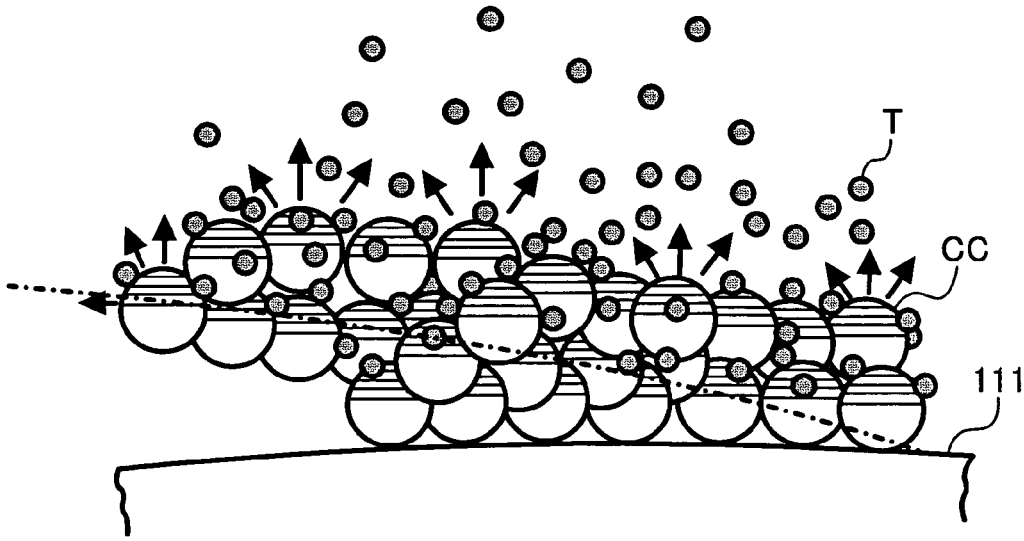
FIGS. 17A-17C are schematic diagrams for describing the relation between the state of the magnetic chain formed of magnetic carrier and separation of toner.
Figure 17B:
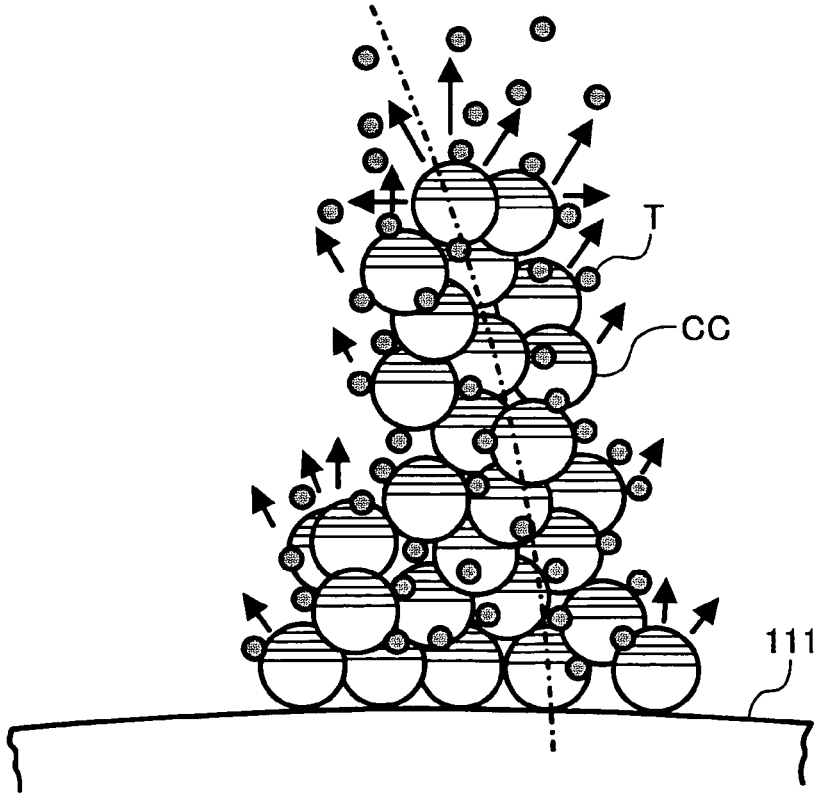
Figure 17C:
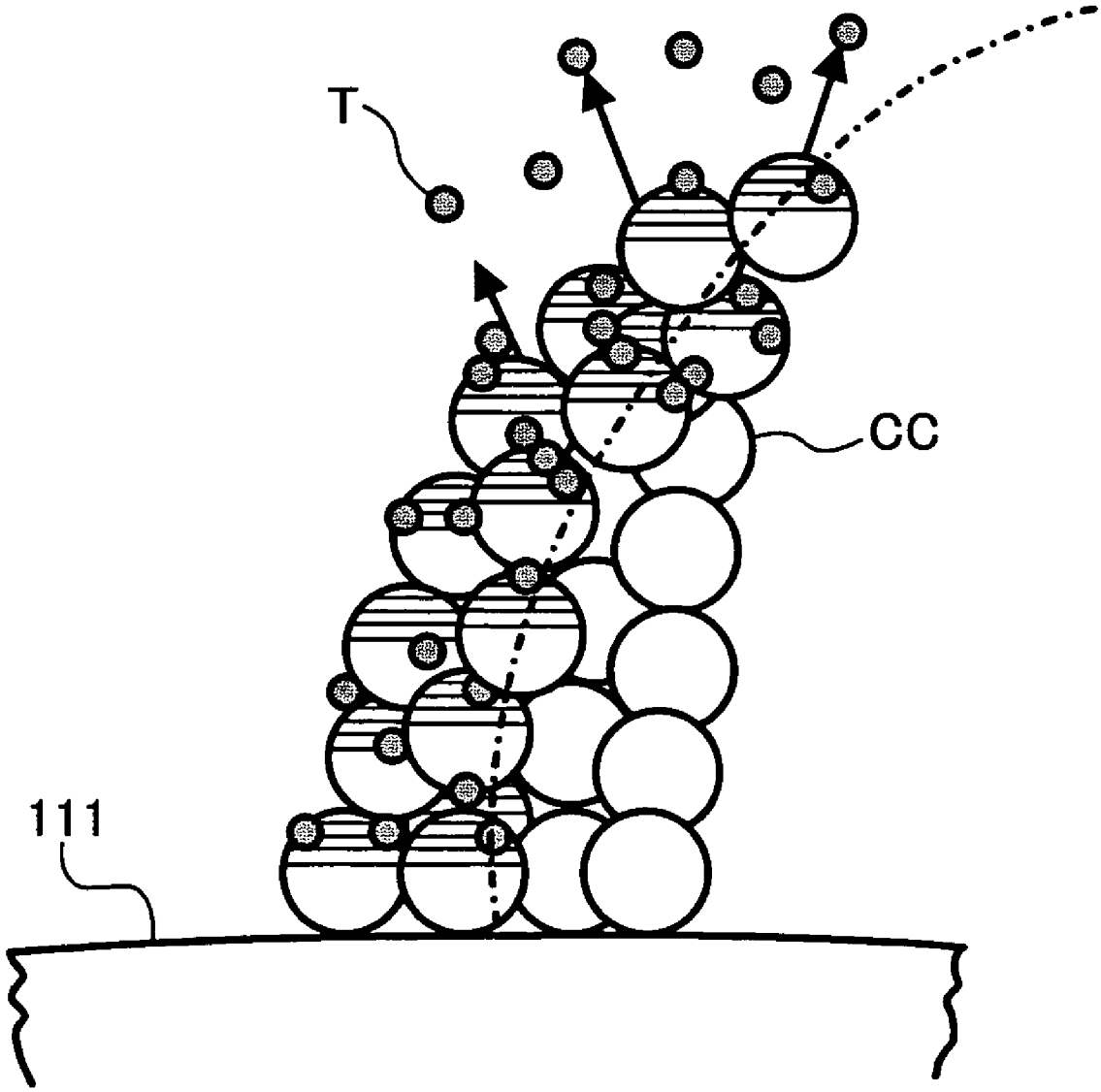

FIGS. 17A through 17C are schematic diagrams for describing separation of the toner particles T under the conditions of the magnetic chain formed of the magnetic carrier particles CC. FIG. 17A is a schematic diagram corresponding to the magnetic chain rising region (2) in FIG. 16, which shows separation of the toner particles T at the time of the magnetic chains formed of the magnetic carrier CC particles being rising. FIG. 17B is a schematic diagram corresponding to the magnetic chain rising region (4) in FIG. 16, which shows separation of the toner particles T at the time of the magnetic chains formed of the magnetic carrier particles CC rising completely, and being the closest to the photosensitive member 100. FIG. 17C is a schematic diagram corresponding to the magnetic chain rising region (5) in FIG. 16, which shows separation of the toner particles T at the time of the magnetic chains formed of the magnetic carrier particles CC being lying. Here, in FIGS. 17A through 17C, the hatched region on the magnetic carrier particles CC represents the region where the toner particles T carried on the magnetic carrier particles CC can separate, and the direction of the arrow represents the direction wherein the toner particles T fly, and the length of the arrow represents the degree that the toner particles T readily fly.

As shown in FIGS. 17A through 17C, the free toner particles T are readily generated from the magnetic carrier particles CC positioned on the magnetic brush facing the photosensitive member 100. Accordingly, in the present example, the toner particles T can be efficiently separated from the entire surface area of the magnetic brush by shifting the nearest position to the upstream side with a shift angle of 10°.

Thus, developing is performed with improved efficiency of use of the toner particles T. Further, in the present example, an AC electric field is applied to a space where the photosensitive member 100 and the developing sleeve 111 face one another using an electric power supply for applying the AC electric field, and furthermore, developing is performed while keeping the magnetic brush BR1 close to the photosensitive member 100, but not in contact therewith, causing the toner particles T, which have adhered onto the photosensitive member 100, to separate from the photosensitive member 100, and to return to the magnetic carrier particles CC of the magnetic chains, again. Thus, the toner particles T, which have been used for developing of the non-image-formation portion and the image-formation portion with low electric potential, return to the magnetic chains, thereby obtaining a high-quality image.

Furthermore, the steps that the line-shaped latent images with the length in the main scanning direction and the sub-scanning direction are developed with the toner particles T were observed in the same way as with the above-described first example. As a result, it has been found that developing is performed starting from the middle portion of the line-shaped latent image in the width direction for both the line-shaped latent images with the length in the main scanning direction and the sub-scanning direction, in the same way as with the first example.

Evaluation of the image was made using the image forming apparatus employing such a developing method. As a result, an image is obtained with an excellent reproduction at a solid portion, with a horizontal/vertical ratio of 0.99, and with excellent image quality at an edge portion.

As described above, in the developing method according to the embodiment of the present invention, developing is performed within a greater developing region than that of the conventional one, i.e., developing is performed with the free toner particles mainly in the region upstream of the developing nip, and accordingly, developing is performed starting from the middle portion of the line-shaped latent image in the width direction for the line-shaped latent images with the length in the sub-scanning direction, thereby obtaining a smooth image without edge effects. On the other hand, developing is performed for the line-shaped latent images with the length in the main scanning direction with the free toner particles mainly in the region upstream of the developing nip. In this case, developing is performed starting from the middle portion of the line-shaped latent image in the width direction, thereby improving developing performance, and thereby obtaining a high-quality smooth image with excellent uniformity at a solid portion, with little fogging at non-image-formation portions, and with excellent sharpness of fine lines and characters.

COMPARATIVE EXAMPLE

Next, evaluation was made using the developing device 110 under the same conditions as with the above-described first example, except for the gap between the developing agent carrying member (developing sleeve 111) and the photosensitive member 100 being narrowed such that the magnetic chain rising region SP1 shown in FIG. 10 corresponding to the nearest portion comes into contact with the photosensitive member 100, and a urethane seal member disposed for preventing movement of the free toner particles from a magnetic chain rising region upstream from the magnetic chain rising region SP1 toward the photosensitive member 100.

As a result, it has been found that developing is performed starting from the portion where the magnetic brush comes into contact with for both the line-shaped latent images with the length in the main scanning direction and the sub-scanning direction. Developing was performed using the toner with the TC of 7% by weight, and an image was obtained with poor reproduction at a solid portion, and with edge effects. In order to solve the aforementioned problems, developing was performed using the toner with the TC of 10% by weight. As a result, an image was obtained with improved reproduction at a solid portion, and with improved image quality at an edge portion, leading to a problem of the horizontal/vertical ratio of 1.3.

Description has been made regarding a developing method, a developing device, and an image forming apparatus, wherein a single magnetic field distribution P1 is formed within the facing region where the developing sleeve 111 (developing agent carrying member) and the photosensitive member 100 (image carrying member) face one another as shown in FIG. 5, and accordingly, a single magnetic chain of the magnetic brush is formed within the facing region.

A configuration is not limited to the configuration wherein a single magnetic chain rising region is formed in the facing region. For example, the configuration wherein at least two or more magnetic chain rising region are formed within the facing region, may be employed.

Description will be made below regarding another developing method wherein at least two magnetic chain rising regions are formed in the facing region. A developing device according to another embodiment includes a first magnet disposed at a position the closest to the image carrying member for generating one of the aforementioned at least two magnetic chain rising regions, and a second magnet positioned upstream in the transporting direction from the aforementioned one magnetic chain rising region for generating the other magnetic chain rising region. Furthermore, developing is performed for the line-shaped latent image starting from the middle portion thereof in the width direction due to the magnetic chain rising region from the second magnet, whereby a first thin toner layer is formed. In the same way, developing is further performed for the line-shaped latent image starting from the middle portion thereof in the width direction due to the magnetic chain rising region from the first magnet, whereby a second thin toner layer is formed on the first thin toner layer.

In FIG. 18 through FIG. 21B for describing the basic configuration, and FIGS. 22 and 23 for describing generation of the magnetic brush and the free toner particles, redundant description of the components having the same functions as the components which have been described with reference to other drawings will be omitted, and only the reference numerals are shown in the drawings.

Figure 18:
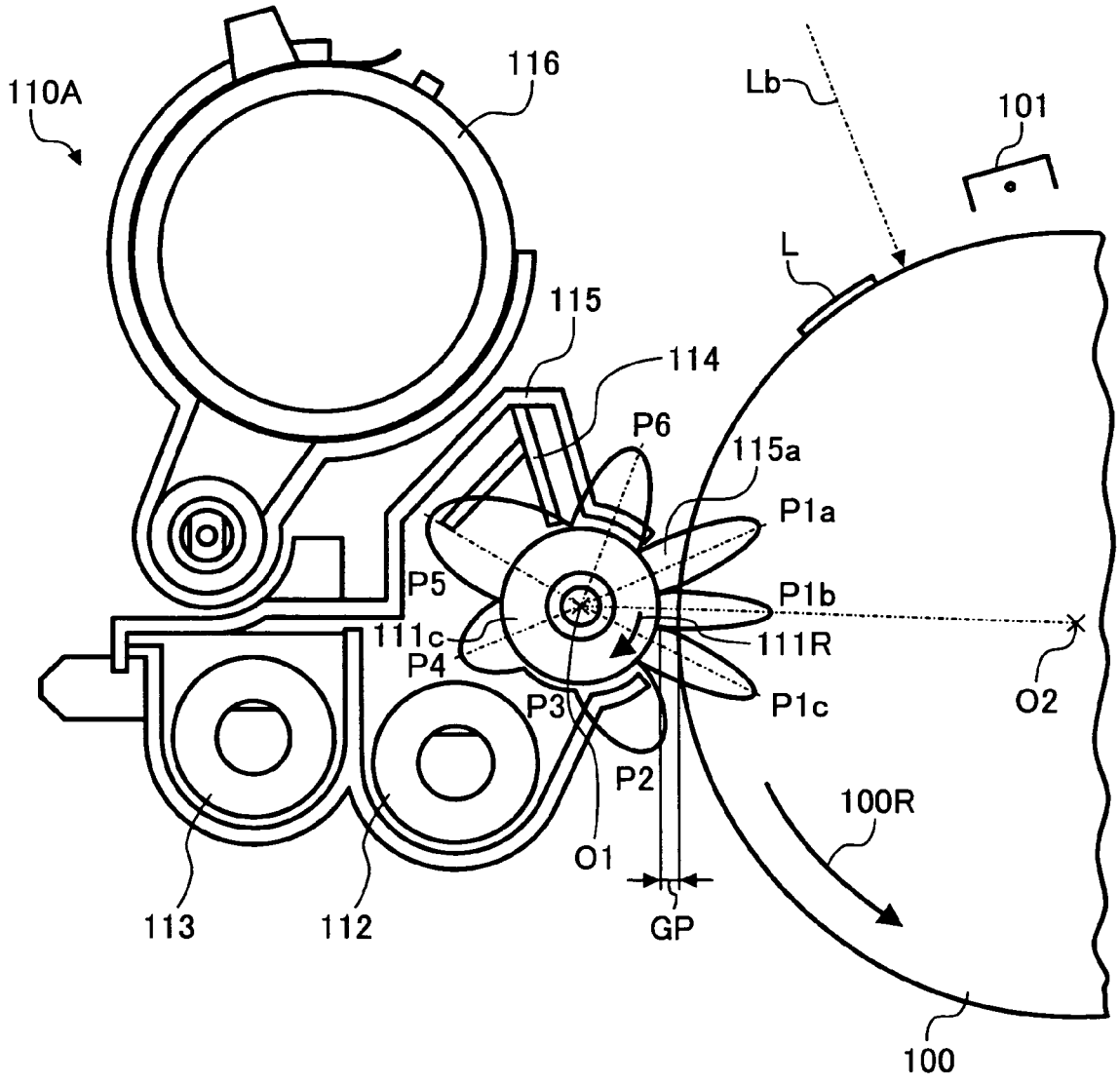
FIG. 18 is a front view showing a basic configuration of the developing device.
Figure 19:
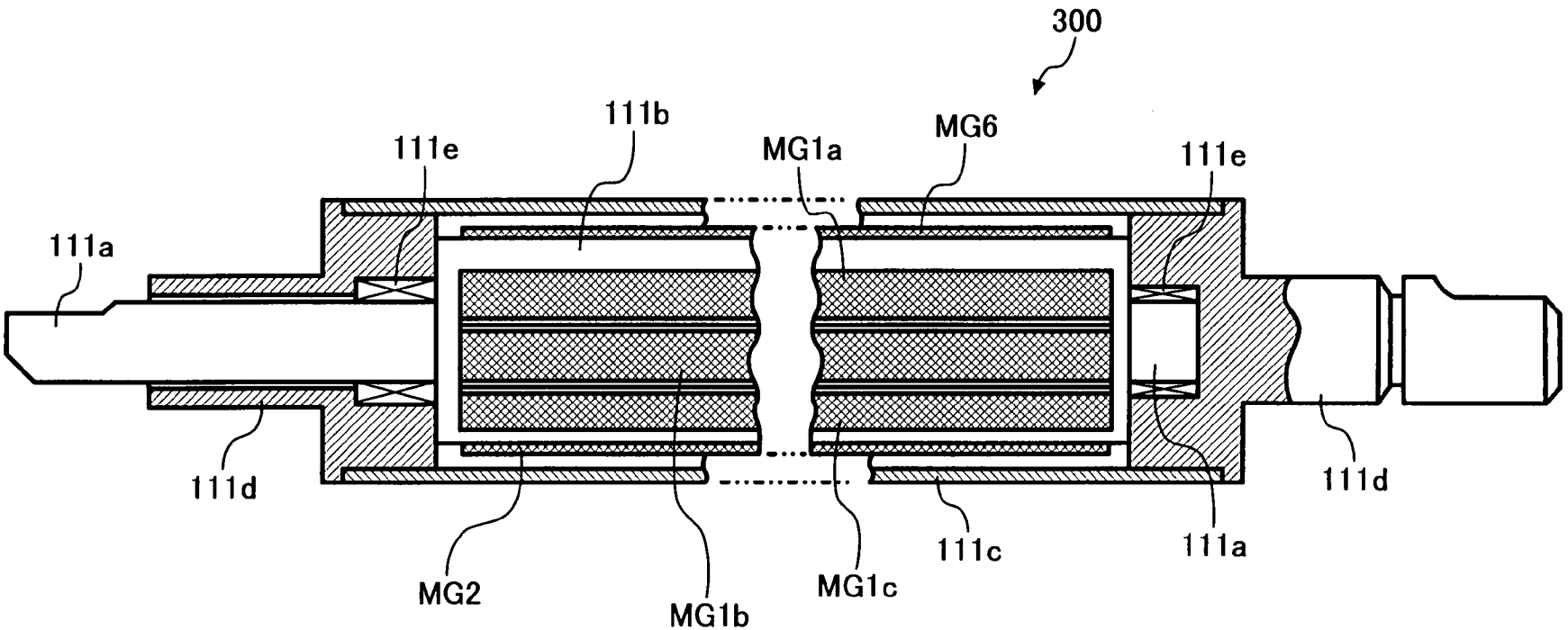
FIG. 19 is a cross-sectional view of a developing sleeve.

In a developing device 110A of FIG. 18, a developing sleeve 111*c* is configured to rotate around stationary magnets. Specifically, as shown in FIG. 19, a developing roller 300 includes a stationary shaft 111*a* which is fixed to the developing casing 115 serving as a stationary component, a cylinder-shaped magnet supporting member 111*b* integrally formed with the shaft 111*a*, the cylinder-shaped developing sleeve 111*c* which covers the circumference of the magnet supporting member 111*b* with a gap, and a rotational member 111*d* integrally formed with the developing sleeve 111*c*.

The rotational member 111*d* is rotatably mounted to the shaft 111*a* via bearings 111*e*. A drive device (not shown) causes the rotational member 111*d* to rotate.

Figure 20:
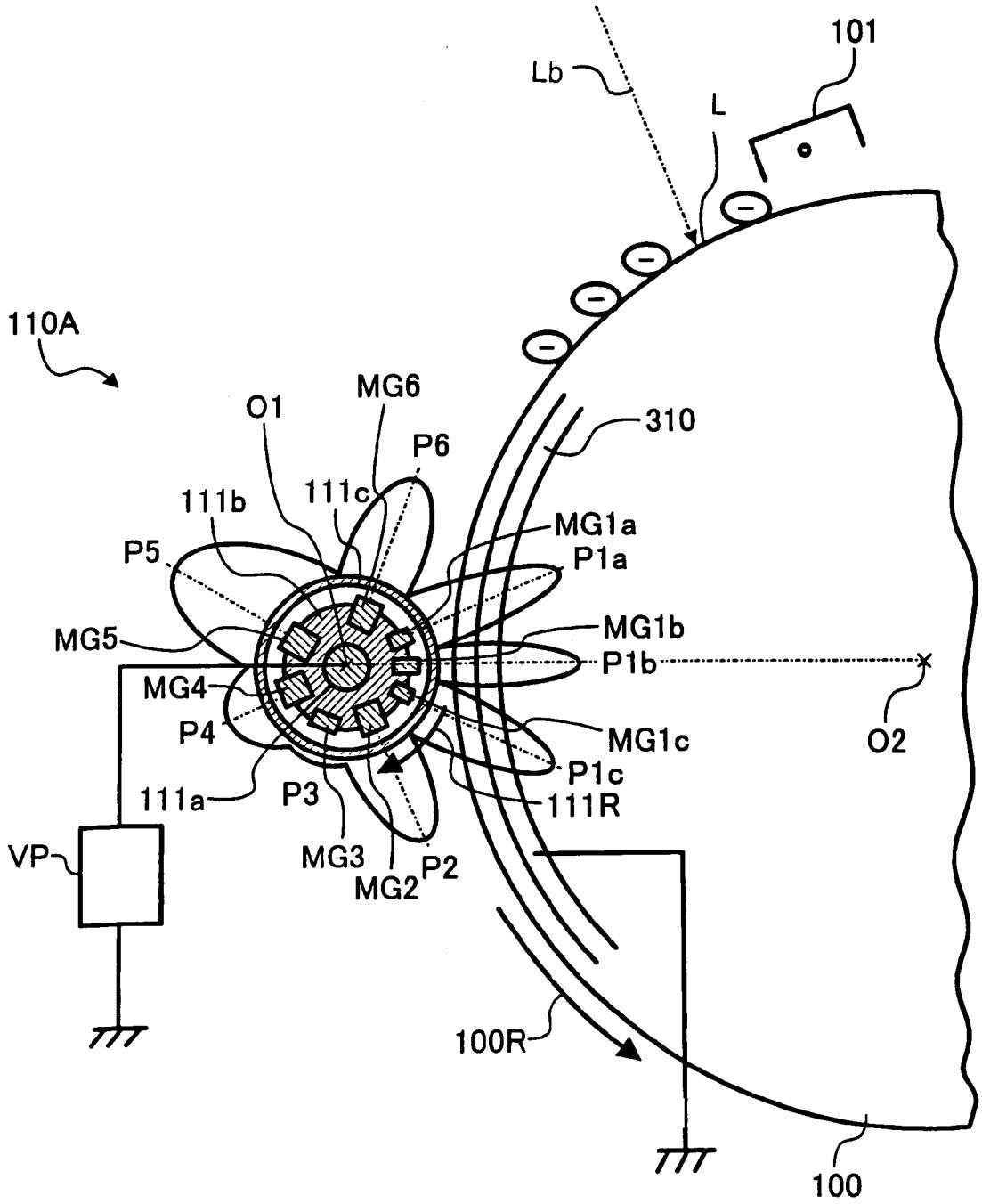
FIG. 20 is a schematic configuration diagram showing a basic configuration of the developing device.

As shown in FIG. 20, multiple magnets MG1*a*, MG1*b*, MG1*c*, MG2, MG3, MG4, MG5, and MG6 (which will be collectively referred to as "MG" hereafter) are fixed on the outer face of the magnet supporting member 111*b* at predetermined intervals. The developing sleeve 111*c* is rotated around these magnets MG.

The developing sleeve 111*c* is formed of non-magnetic substance such as aluminum, brass, stainless steel, conductive resin, or the like, and is configured to rotate clockwise around the magnets MG by an unshown rotational driving mechanism, as shown in FIGS. 18 and 20.

These magnets MG forms magnetic field such that the developing agent is transported while generating the magnetic chains due to rotation of the developing sleeve 111*c*. The magnetic chains are formed of the magnetic carrier particles so as to follow along the magnetic lines of forces due to these magnets MG. The magnetic brush is formed of the magnetic chains. The magnetic chain and the magnetic brush are formed of the magnetic carrier particles carrying the charged toner particles.

The developing sleeve 111*c* is disposed at a position close to the photosensitive member 100 via the developing gap GP, and developing is performed within the facing region where the developing sleeve 111*c* and the photosensitive member 100 face one another. In the present embodiment, both the photosensitive member 100 and the developing sleeve 111*c* are formed in the shape of a cylinder, and accordingly, in the facing region where two convex faces face one another, the gap between the photosensitive member 100 and the developing sleeve 111*c* becomes greater the farther away from the nearest position where the gap between the photosensitive member 100 and the developing sleeve 111*c* is the smallest. Even if the photosensitive member 100 is not in the shape of a cylinder, but in the shape of a belt, i.e., in the shape of a plate, for example, the nearest position is formed in the same way. In FIGS. 18 and 20, the nearest position is on the imaginary line connected between the center O1 of the developing sleeve 111*c* and the center O2 of the photosensitive member 100.

FIG. 20 is a schematic diagram which shows magnetic field distributions P1*a*, Pb1, P1*c*, P2, P3, P4, P5, and P6, corresponding to the aforementioned second magnet MG1*a*, the first magnet MG1*b*, and the magnets MG1*c*, MG2, MG4, MG5, and MG6, disposed around the developing sleeve 111*c*.

The first magnet MG1*b* (magnetic field distribution P1*b*) is disposed at a position corresponding to the nearest position. Further, the second magnet MG1*a* (magnetic field distribution P1*a*) is disposed at a position upstream from the first magnet MG1*b* (magnetic field distribution P1*b*), and the magnet MGc (magnet distribution P1*c*) is disposed at a position downstream from the first magnet MG1*b* (magnetic field distribution P1*b*), in the rotational direction 111R of the developing sleeve 111*c*.

Furthermore, the magnets MG3 (magnetic field distribution P3), MG4 (magnetic field distribution P4), MG5 (magnetic field distribution P5), and MG6 (magnetic field distribution P6), are disposed in order downstream from the magnets MG1*c* (magnetic field distribution P1*c*) in the rotational direction 111R of the developing sleeve 111*c*. Of these magnets, the second magnet MG1*a* (magnet distribution P1*a*), the first magnet MG1*b* (magnet distribution P1*b*), and the magnet MG1*c* (magnet distribution P1*c*), are disposed in the facing region where the developing sleeve 111*c* and the photosensitive member 100 face one another.

In the developing method used in the developing device 110A according to the embodiment of the present invention, developing is performed using the cycle that magnetic brushes formed due to at least the second magnet MG1*a* (magnetic field distribution P1*a*) and the first magnet MG1*b* (magnetic field distribution P1*b*) rise and lie.

The magnet MG1*c* (magnetic field distribution P1*c*) restricts the half-value width of the magnetic force formed due to the adjacent first magnet MG1*b* (magnetic field distribution P1*b*) to a predetermined narrow width, and the magnet MG6 (magnetic field distribution P6) restricts the half-value width of the magnetic force formed due to the adjacent second magnet MG1*a* (magnetic field distribution P1*a*) to a predetermined narrow width, such that developing is efficiently performed using the cycle that the magnetic brushes rise and lie, thereby improving developing performance.

Figure 21A:
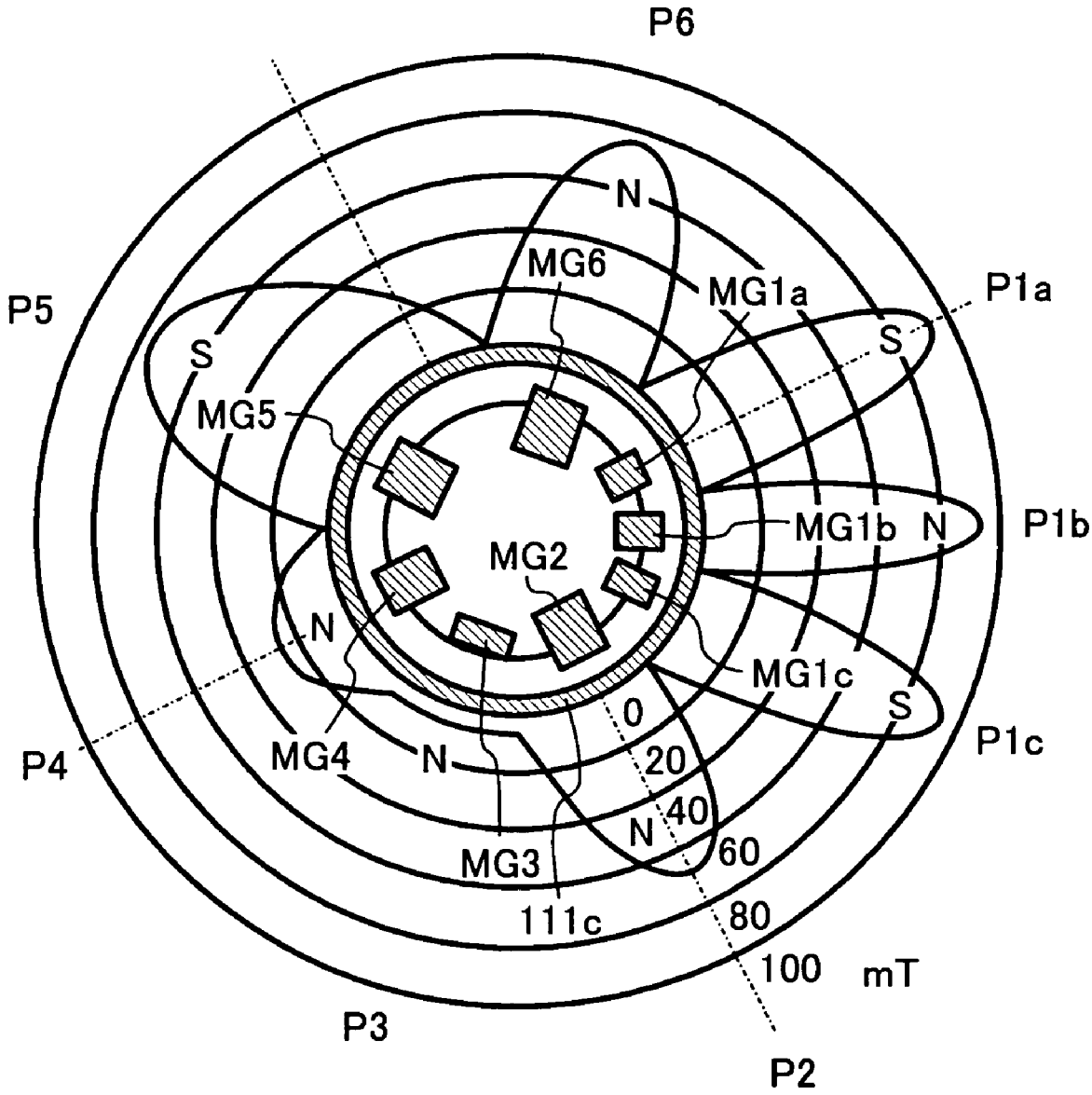
FIG. 21A is a diagram which shows a magnetic field distribution and a strength thereof.

As shown in FIG. 21A, in the present embodiment, all the magnets MG are disposed such that each half-value width of the magnetic force due to the corresponding magnet is restricted by the adjacent magnet, and the half-value width of the magnetic force of each magnet is determined due to interaction with the adjacent magnets such that developing is efficiently performed using the magnet (magnetic force).

In the present embodiment, the half-value width of the magnetic force formed due to the magnet is narrowed, and accordingly, the cycle wherein the magnetic chains rise and lie occurs rapidly, causing motion of the magnetic chains with less smoothness. Accordingly, the motion of the magnetic brush becomes rapid, and disturbing effects such as disturbance of formation of the magnetic chains, or the like, occur. Accordingly, it is assumed that separation of the toner particles from the magnetic carrier particles, and flying of the toner particles, readily occur. Furthermore, the period in time for the developing agent passing through the surface of the photosensitive member can be reduced, and accordingly, it is assumed that the counter charge generated in the magnetic carrier hardly affects developing.

The magnet MG4 (magnetic field distribution P4) has a function for scooping up the developing agent onto the developing sleeve 111*c*. The magnet MG3 (magnetic field distribution P3) has a function of separating the developing agent particles from the chains. Each of the magnets MG2, MG5, and MG6 (magnetic field distributions P2, P5, and P6) has a function of transporting the developing agent scooped up onto the developing sleeve 111*c* up to the facing region.

The axes of these magnets MG1*a* (magnetic field distribution P1*a*), MG1*b* (magnetic field distribution P1*b*), MG1*c* (magnetic field distribution P1*c*), MG2 (magnetic field distribution P2), MG3 (magnetic field distribution P3), MG4 (magnetic field distribution P4), MG5 (magnetic field distribution P5), and MG6 (magnetic field distribution P6) are all positioned in the radial direction of the developing sleeve 111*c*.

In the present embodiment, the developing sleeve 111*c* includes an eight-pole magnet component, and three magnets (MG1*a*, MG1*b*, and MG1*c*) are disposed in the facing region where the developing sleeve 111*c* and the photosensitive member 100 face one another. Alternatively, four or more magnets may be disposed in the facing region to increase toner separated from magnetic carrier particles.

Further, the developing sleeve 111*c* may include a ten-pole magnet component or twelve-pole magnet component, for example, wherein additional magnets are further disposed between the magnet MG3 and the doctor blade 114 to improve the performance of scooping up the developing agent, and uniformity of a solid portion.

The second magnet MG1*a*, the first magnet MG1*b*, and the magnet MG1*c*, are arrayed in that order from the upstream direction in the rotational direction 111R of the developing sleeve 111*c*. Each of these magnets MG1*a*, MG1*b*, and MG1*c*, are formed of a magnet with a small cross-sectional area. These magnets are formed of an alloy of rare earth metal.

In the present embodiment, as shown in FIG. 21A, the first magnet MG1*b*, and the magnets MG2, MG3, and MG6, serve as N-pole magnetic field generating devices, and the second magnet MG1*a*, and the magnets MG1*c*, and MG5, serve S-pole magnetic field generating devices. For example, a magnet having the magnetic force of 85 mT or more is employed as the first magnet MG1*b* on the developing roller. It has been confirmed that in the event that the first magnet MG1*b* has the magnetic force of 60 mT or more, a toner image is obtained without defects such as adhesion of the magnetic carrier particles. In the event that a magnet having the magnetic force less than 60 mT was employed for the first magnet MG1*b*, a toner image was obtained with adhesion of the magnetic carrier particles.

Each of the second magnet MG1*a*, the first magnet MG1*b*, and the magnet MG1*c*, were formed with a width of 2 mm. In this case, the half-value width of the magnetic field distribution P1*b* was 160. Furthermore, it has been confirmed that the smaller the width of the magnet is, the narrower the width of the half-value width of the magnetic field distribution is. In the event that a magnet with a width of 1.6 mm is employed as the first magnet MG1*b*, the half-value width of the magnetic field distribution P1*b* was 120.

Figure 21B:
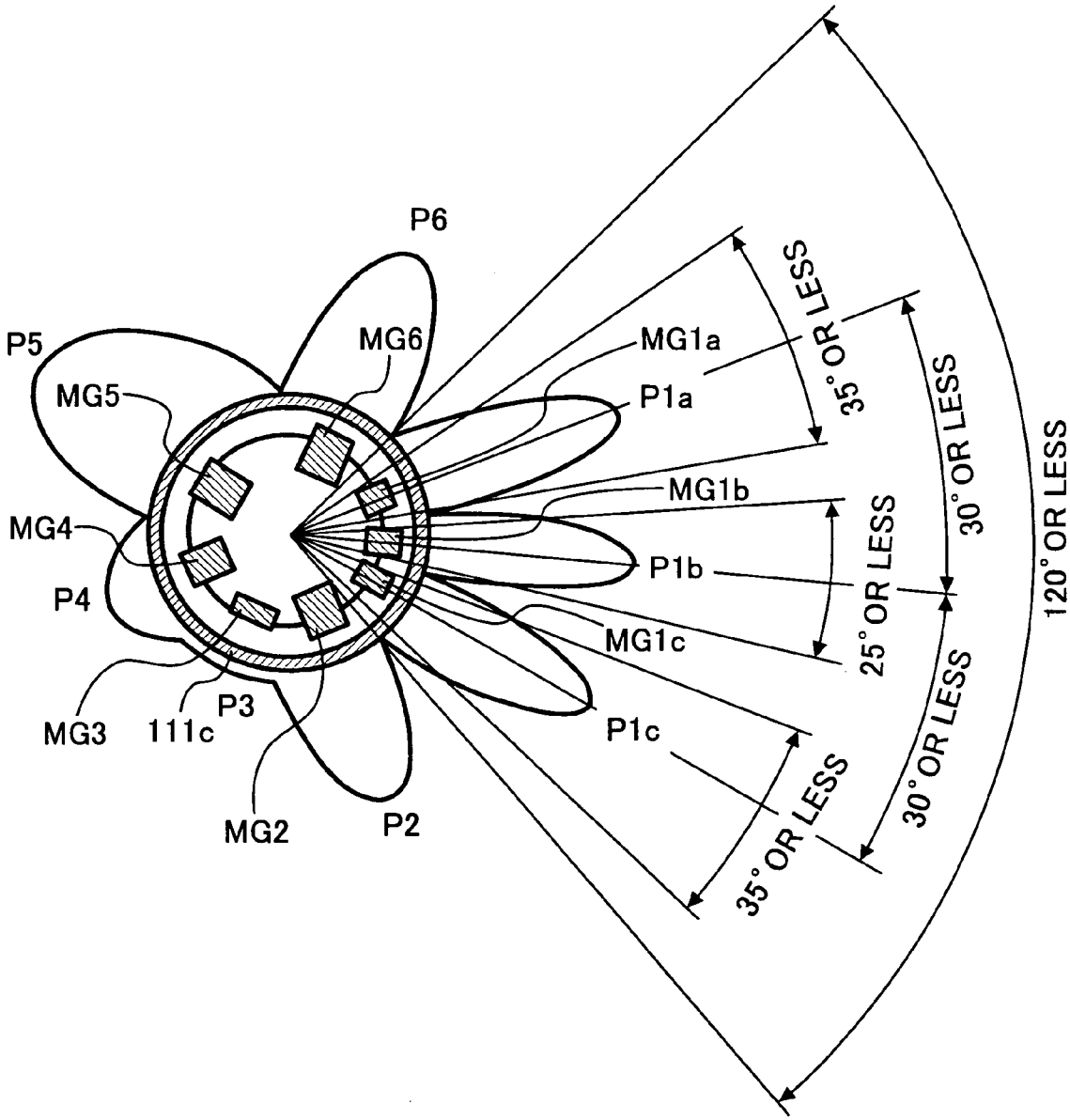
FIG. 21B is a diagram for describing a layout of magnets.

As shown in FIG. 21B which shows the layout of the magnets such as the first magnet MG1*b*, the second magnet MG1*a*, the magnet MG1*c*, and the like, the magnetic field distributions P1*a* and P1*c* are formed with a half-value width of 35° or less. The magnetic field distribution in this region cannot be formed with a relatively narrow half-value width due to the large half-value widths of the magnetic field distributions P2 and P6 positioned outside thereof, unlike the magnetic field distribution P1*b*.

With the layout of the first magnet MG1*b*, the second magnet MG1*a*, and the magnet MG1*c*, the first magnet MG1*b* is introduced between the second magnet MG1*a* and the magnet MG1*c* with an angle of 30° or less. In the above-described embodiment, the magnetic field distribution P1*b* is formed with the half-value width of 16°, and accordingly, the aforementioned angle of introduction is determined to be 22°. Furthermore, these magnets are introduced between two pole inversion points (where the magnetic force exhibits 0 mT: the point where the N-pole magnetic field distribution change to S-pole magnetic field distribution, or the point where the S-pole magnetic field distribution change to N-pole magnetic field distribution) due to the magnets MG2 and MG6 with an angle of 120° or less.

As shown in FIG. 20, in the developing device 110A, the stationary shaft 111*a* is connected to a grounded power supply VP for supplying a bias voltage. The voltage from the power supply VP connected to the stationary shaft 111*a* is applied to the developing sleeve 111*c* via the electro-conductive bearings 111*e* and the electro-conductive rotational member 111*d* shown in FIG. 19. On the other hand, as shown in FIG. 20, a conductive support 310, forming the innermost layer of the photosensitive member 100, is grounded.

Thus, an electric field is formed in the facing region for moving the toner particles separated from the magnetic carrier particles toward the photosensitive member 100, thereby enabling movement of the toner particles toward the photosensitive member 100.

As described above with reference to FIG. 18 through FIGS. 21B, the developing device 110A has a configuration wherein the developing sleeve 111*c* having the magnets therewithin is disposed at a position facing the photosensitive member 100, the developing sleeve 111*c* carries the developing agent containing the toner particles and the magnetic carrier particles carrying the toner particles on the surface thereof, the developing agent carried by the developing sleeve 111*c* is transported to the facing region where the developing sleeve 111*c* and the photosensitive member 100 face one another, an electric field is applied to a space between the developing sleeve 111*c* and the photosensitive member 100, and the latent image (L) formed on the surface of the photosensitive member 100 is developed with the toner particles. The developing method according to the embodiment of the present invention can be performed using the aforementioned developing device 110A.

The developing device 110A is combined with an image forming apparatus of the type writing a latent image with a laser beam (Lb). Specifically, after the charger 101 uniformly and negatively charges the surface of the photosensitive member 100, the laser beam (Lb) scans the photosensitive member 100 to form the latent image (L) by lowering the potential to reduce the amount of writing. The developing device 110A has the same configuration as with the developing device 110 described with reference to FIG. 5.

In the developing device 110A, the developing sleeve 111*c* including the magnets MG is disposed at a position facing the photosensitive member 100. The layer formed of developing agent containing the toner particles and the magnetic carrier particles is carried on the surface of the developing sleeve 111*c*. The developing sleeve 111*c* is rotated while maintaining the magnets MG stationary so as to cause a speed difference between the developing sleeve 111*c* and the magnets MG, thereby forming a magnetic brush at least at the facing region, and thereby causing the formed magnetic brush to flow. In the step for causing the magnetic brush to flow, the free toner particles separated from the magnetic carrier particles adhere to the latent image (L) formed on the photosensitive member 100, whereby developing is performed.

While the developing sleeve 111*c* has been shown and described as rotating relative to the stationary magnets MG, the magnets MG may be rotated relative to the developing sleeve 111*c* or the developing sleeve 111*c* and magnets MG may be rotated in opposite directions to each other. The crux is that a speed difference be established between the developing sleeve 111*c* and the magnets MG.

The developing gap GP between the photosensitive member 100 and the developing sleeve 111*c* is adjusted such that developing is performed while maintaining non-contact of the tips of the magnetic brush and the photosensitive member 100.

The magnetic chains, magnetic brush and position where the magnetic chains rise will be described hereafter.

As shown in FIGS. 18, 20, 21A, and 21B, the magnetic field distributions P1*a*, P1*b*, P1*c*, P2, P3, P4, P5, and P6, are radially formed due to magnets MG disposed within the outer face of the developing sleeve 111*c*.

Description has been made regarding generation of the free toner particles with reference to FIGS. 6A through 6G. In the present embodiment, the free toner particles are generated in the same way as in FIG. 6 described above. As shown in FIGS. 18, and 20, the developing agent carried on the developing sleeve 111*c* is transported by rotation of the developing sleeve 111*c*. Upon the developing agent passing through in each magnetic field distribution, the cycle that the magnetic chains formed of the magnetic carrier particles rise and lie on the developing agent layer on the developing sleeve 111*c*. Here, each magnetic chain is formed so as to follow along the magnetic line of force due to the magnetic field distribution.

Specifically, the developing agent layer on the developing sleeve 111*c* is transported along with the developing sleeve 111*c*. Upon the developing agent layer reaching the magnetic field distribution P1*a*, the magnetic chain formed of the magnetic carrier particles CC in the shape of a chain separates from and rises on the developing agent layer along the magnetic line of force (1) (shown in FIG. 6A). The magnetic chain looks like a chain as viewed from the axis-longitudinal direction of the developing sleeve 111*c*, and the magnetic chains are arrayed so as to face the magnet MG1*a* in the longitudinal direction of the developing sleeve 111*c*, which is the direction perpendicular to the drawing.

Upon the magnetic chain formed of the magnetic carrier particles CC rising along the magnetic line of force, the toner particles T separate from the magnetic carrier particles CC. The toner particles T thus separate from the magnetic carrier particles CC and cast into to a space so as to be suspended on the rising side of the magnetic chain (the reverse side of the side wherein the magnetic chain faces the developing sleeve 111*c*). Furthermore, deformation of the developing agent layer occurs, as well, due to the magnetic chain rising from the developing agent layer, causing the toner particles T to separate from the developing agent layer, whereby the free toner particles T are generated.

Subsequently, the magnetic chain changes the shape and position thereof so as to extend along the magnetic lines of force (3) and (4) in that order, due to further rotation of the developing sleeve 111, whereby the magnetic chain rises generally perpendicular to the face of the developing sleeve 111 (shown in FIG. 6D). In the step of the aforementioned change, the toner particles T are further separated from the magnetic carrier particles CC into the free toner particles T cast around the tip of the magnetic chain.

In the developing method according to the present embodiment of the present invention, at least two magnetic chain rising regions of the magnetic brushes are formed in the facing region. The diameter of the developing sleeve 111*c* is relatively small as compared with the diameter of the photosensitive member 100, and accordingly, the maximal facing region matches ((the diameter of the developing sleeve 111*c*)×(the length thereof in the longitudinal direction)), which will be referred to as "maximal facing region" hereafter.

However, as shown in FIG. 18, the developing sleeve 111*c* is surrounded by the developing casing 115, and the developing casing 115 has an opening with a suitable opening size such that the toner particles can freely fly from the developing sleeve 111*c* toward the photosensitive member 100. That is, the developing sleeve 111*c* and the photosensitive member 100 directly face one another through the aforementioned opening.

In the present developing method, the developing casing 115 has an opening 115*a* with the smaller size in the rotational direction 111R than with the aforementioned maximal facing region in order to prevent scattering of toner. Accordingly, the photosensitive member 100 and the developing sleeve 111*c* directly face one another through the facing region restricted by the opening 115*a* to a smaller size than with the aforementioned maximal facing region.

In the present developing method, the developing region is defined as the region where the toner particles T in the developing agent fly toward the photosensitive member 100, and developing is performed using the toner particles T, regardless of the state of the developing agent layer whether the magnetic brush is formed of the magnetic chains formed of the magnetic carrier particles CC, or a thin developing agent layer is formed on the developing sleeve 111*c*.

[Case 1]

Figure 22:
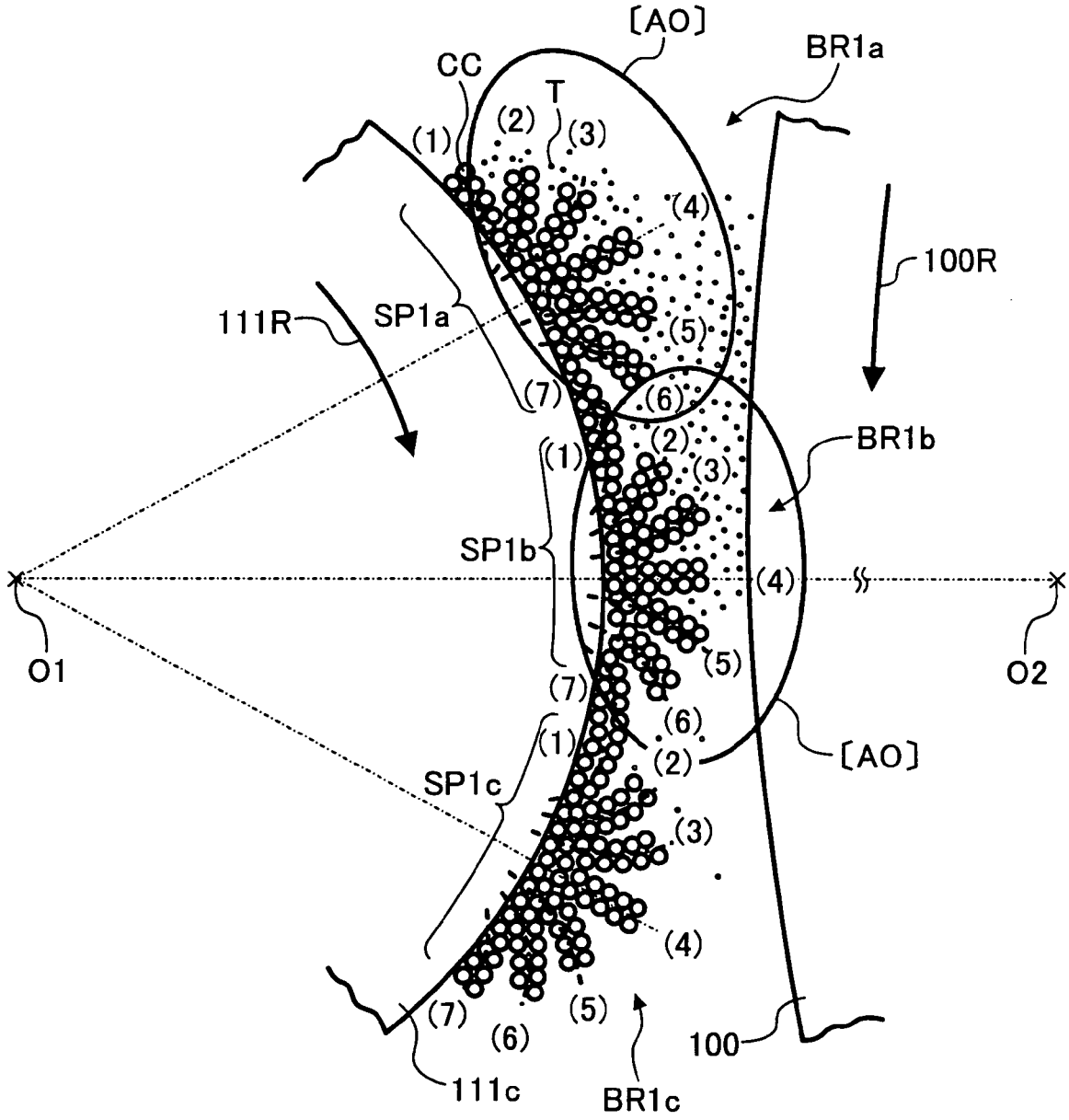
FIG. 22 is a schematic diagram showing an example wherein multiple magnetic chain rising regions are formed in the facing region.

FIG. 22 shows the magnetic brushes, and the magnetic chain rising regions, occurring under the basic configuration described in FIGS. 18 through 21B. In FIG. 22, reference characters BR1*a*, BR1*b*, and BR1*c*, denote magnetic brushes occurring due to the aforementioned magnetic field distribution P1*a*, P1*b*, and P1*c*, respectively. Each of these magnetic brushes BR1*a*, BR1*b*, and BR1*c* are formed of magnetic chains along a number of magnetic lines of force (1) through (7) as described with reference to FIGS. 6A through 6G. While there is little difference in appearance therebetween, the magnetic chains formed of the magnetic carrier particles CC flow while maintaining the toner particles T, and in the step for causing the flow, the toner particles T separate from the magnetic carrier particles CC, whereby the free toner particles T are generated.

Each magnetic brush BR1*a*, BR1*b*, and BR1*c* is formed of a great number of magnetic chains, and extends in a space. The region in the space where the great number of magnetic chains extend is referred to as a "magnetic chain rising region". Reference characters SP1*a*, SP1*b*, and SP1*c*, denote the magnetic chain rising regions corresponding to the magnetic brushes BR1*a*, BR2*a*, and BR1*c*, respectively. As described above, in the present embodiment, there are three magnetic chain rising regions SP1*a*, SP1*b*, and SP1*c* in the facing region.

In the present embodiment, as shown in FIG. 22, the magnetic brush BR1*b* and the corresponding magnetic chain rising region SP1*b* are formed at the nearest position in the facing region (the line from the center O1 of the developing sleeve 111*c* to the center O2 of the photosensitive member 100 passes through the nearest position). Further, the magnetic brush BR1*a* and the corresponding magnetic chain rising region SP1*a* are formed at a position upstream from the nearest position in the direction for transporting the developing agent. Developing is performed while maintaining non-contact between both the magnetic brushes BR1*a* and BR1*b* and the photosensitive member 100.

The magnetic chain rising region SP1*b* is formed due to the first magnet MG1*b* (magnetic field distribution P1*b*) positioned corresponding to the nearest position which is the closest to the photosensitive member 100. On the other hand, the magnetic chain rising region SP1*a* is formed due to the second magnet MG1*a* (magnetic field distribution P1*a*) positioned upstream from the aforementioned magnetic chain rising region SP1*b* in the rotational direction 111R (i.e., the direction for transporting the developing agent).

In FIG. 22, in the magnetic chain rising region SP1*a* on the upstream side, the free toner particles T in the region [A0], where the cycle that the magnetic chains formed of the magnetic carrier particles CC rise and lie occurs, readily flow toward the downstream direction due to rotation of the developing sleeve 111*c*. Further, a great amount of toner particles T are generated at a region downstream from the magnetic line of force (4) on the side where the magnetic chains lie, and the generated free toner particles T are used for developing. Furthermore, the magnetic chain rising region SP1*b* positioned downstream from the magnetic chain rising region SP1*a* has the region [A0 ] thereof in the same way as with the above-described region [A0] of the magnetic chain rising region SP1*a*.

In the illustrative embodiment shown in FIG. 22, the three magnetic chain rising regions SP1*a*, SP1*b*, and SP1*c*, are formed in the facing region. In the event that developing is performed with the free toner particles T generated from the magnetic brushes in these magnetic chain rising regions SP1*a*, SP1*b*, and SP1*c*, a sufficient amount of toner particles T adhere to the position, where the latent image is to be developed, due to the most upstream magnetic chain rising region SP1*a* and the magnetic chain rising region SP1*b* positioned at the nearest position, i.e., developing is saturated, and accordingly, developing is hardly performed using the magnetic chain rising region SP1*c* positioned downstream from the magnetic chain rising region SP1*b*.

If an AC electric field is applied to a space between the developing sleeve 111*c* and the photosensitive member 100, vibration of the toner particles T occurs at a position downstream from the magnetic chain rising region SP1*b*, and the electric potential of the latent image is adjusted such that adhesion of toner particles T occurs.

Although the magnetic chain rising region SP1*c* hardly contributes to actual developing, the magnetic chain rising region SP1*c* is formed in the present embodiment due to the reason that, in the present embodiment, the magnet MG1*c* (magnetic field distribution P1*c*) is disposed adjacent to the first magnet MG1*b* (magnetic field distribution P1*b*) in order to narrow the half-value width of the magnetic field P1*b* positioned at the nearest position, and accordingly, the magnetic chain rising region SP1*c* is formed due to the magnet MG1*c* (magnetic field distribution P1*c*) by a natural process.

Accordingly, in the embodiment according to the present invention, the magnetic chain rising region at a position downstream from the nearest position is not necessary. Therefore, a configuration may be made wherein only the magnetic chain rising regions SP1*a* and SP1*b* shown in FIG. 22 are formed, or a configuration may be made wherein at least two or more magnetic chain rising regions are formed in the region at and upstream from the nearest position are formed, by adjusting various configurations such as the configuration of the magnets MG, the diameter of the developing sleeve 111*c*, or the shape and the size of the developing casing 115.

[Case 2]

The present embodiment has generally the same configuration as the configuration shown in FIG. 22 described above, i.e., the basic configuration wherein the developing gap is adjusted such that developing is performed while maintaining non-contact between the magnetic brushes and the photosensitive member 100, except for the center of the first magnet MG1*b* shifted downstream from the nearest position (or line formed of the center O1 of the developing sleeve 111*c* and the center O2 of the photosensitive member 100) in the direction for transporting the developing agent (rotational direction 111R) by turning the stationary shaft 111*a*, as compared with the basic configuration of the developing device 110A shown in FIGS. 18 through 21B described above.

Figure 23:
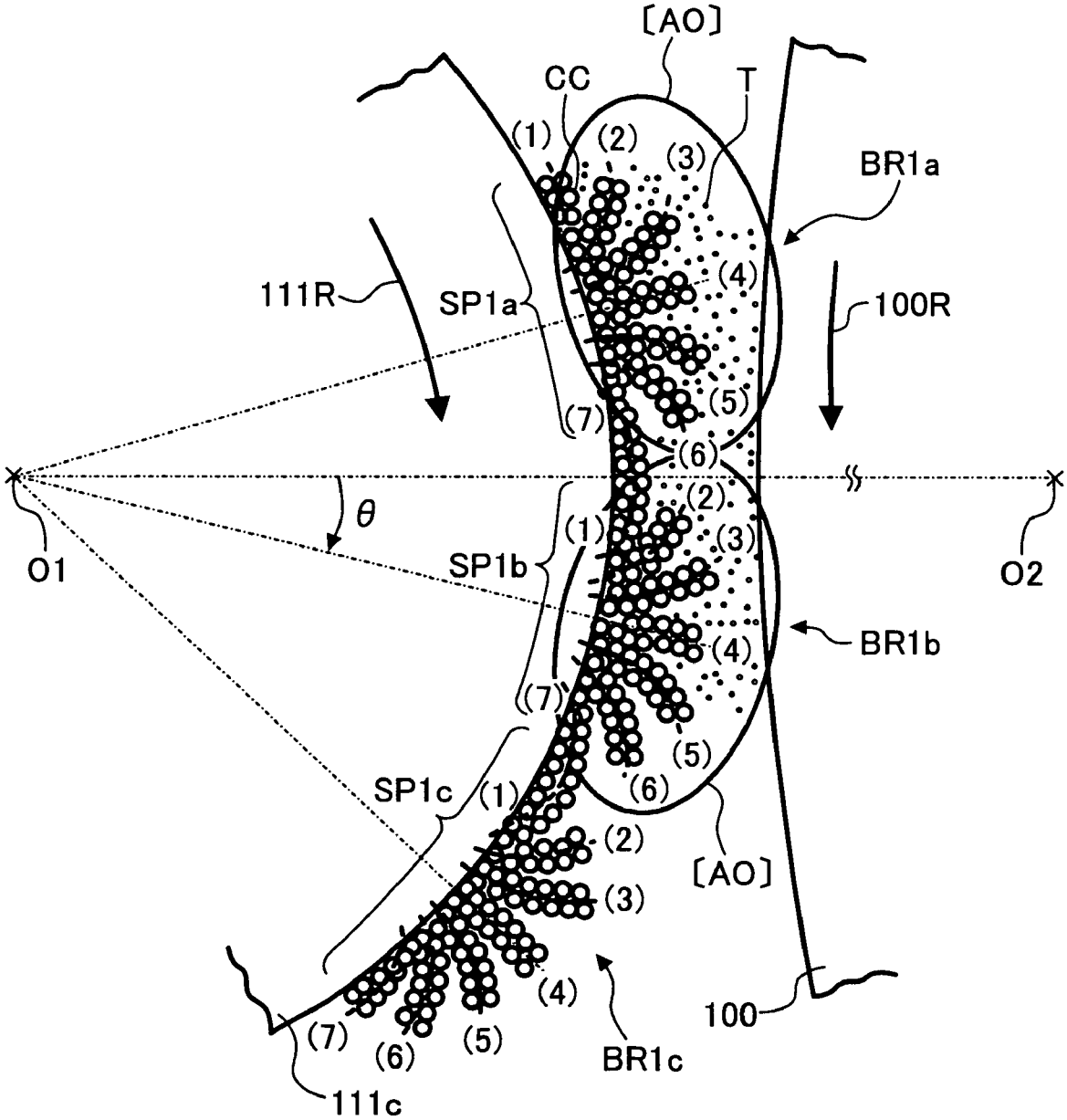
FIG. 23 is a schematic diagram showing an example wherein multiple magnetic chain rising regions are formed in the facing region.

The layout of the magnetic chain rising regions shown in FIG. 23 is that the layout thereof in the above-described [Case 1] is modified such that the center line (magnetic line of force (4)) serving as the peak position of the magnetic force of the first magnet MG1*b* (magnetic field distribution P1*b*) is shifted downstream from the nearest position (or the line from the center O1 of the developing sleeve 111*c* and the center O2 of the photosensitive member 100) in the direction for transporting the developing agent (rotational direction 111R) by a shift angle θ. That is, in the present configuration, the magnetic field distributions P1*a* through P1*c* (the magnets MG1*a* through MG1*c*) are turned in the rotational direction 111R, while maintaining the other magnetic field distributions P2 through P6 (the magnets MG2 through MG6) as with the above-described configuration described in [Case 1].

Thus, the positions of the magnetic chain rising regions SP1*a*, SP1*b*, and SP1*c*, formed around the developing sleeve 111*c*, and the magnetic brushes BR1*a*, BR1*b*, and BR1*c*, are shifted downstream as to the entire configuration by an angle θ as compared with the above-described [Case 1] shown in FIG. 22, such that the magnetic chain rising region SP1*a* is formed upstream from the nearest position (or the line from the center O1 of the developing sleeve 111*c* and the center O2 of the photosensitive member 100), and the magnetic chain rising region SP1*b* is formed downstream therefrom. In the present embodiment, developing is performed while maintaining non-contact between both the magnetic brushes BR1*b* and BR1*a* and the photosensitive member 100.

In the present embodiment, the space (where a great amount of the free toner particles are suspended) in the range from the region where the magnetic brush BR1*a* lies (the region downstream from the region [A0] corresponding to SP1*a*) to the region where the magnetic brush BR1*b* is rising (the region [A0] corresponding to SP1*b*) is the closest to the photosensitive member 100 as compared with the above-described [Case 1] (see FIG. 22). In the present embodiment, there is little developing agent at a space between the magnetic brushes BR1*a* and BR1*b*, as compared with the above-described [Case 1], and accordingly, the strength of the magnetic field around the tips of the two magnetic brushes is increased, increasing the strength of the electric magnetic field applied by the electric power supply VP, thereby improving the developing performance with the free toner particles generated from these magnetic brushes, and thereby enabling excellent developing while achieving the object of the present invention.

(Developing of the Line-Shaped Latent Image)

In the developing device 110A having a configuration described in FIG. 18 through FIG. 23, and further having a configuration wherein at least two or more magnetic chain rising regions are formed in the aforementioned facing region, one of the aforementioned two magnetic chain rising regions is generated due to the first magnet MG1*b* (magnetic field distribution P1*b*) disposed at a position the closest to the photosensitive member 100, and the other magnetic chain rising region is generated due to the second magnet MG1 a (magnetic field distribution P1*a*) positioned upstream from the aforementioned one magnetic chain rising region in the rotational direction 111R. Furthermore, developing is performed for the line-shaped latent image from the middle portion thereof in the width direction due to the magnetic chain rising region from the aforementioned second magnet MG1*a* (magnetic field distribution P1*a*), whereby a thin toner layer (a first layer) is formed. In the same way, developing is further performed for the line-shaped latent image from the middle portion thereof in the width direction due to the magnetic chain rising region from the aforementioned first magnet MG1*b* (magnetic field distribution P1*b*), thereby enabling high-quality developing.

Developing of the line-shaped image using two or more magnetic chain rising regions positioned in the facing region is performed generally in the same way as with developing of the line-shaped image using a single magnetic chain rising region as described with reference to FIG. 10 through FIG. 17C, and accordingly, description thereof will be omitted.

A brief description has been made regarding a step according to the embodiment of the present invention with reference to FIGS. 1A-1C, wherein developing is performed for the line-shaped latent image from the middle portion thereof in the width direction due to the magnetic chain rising region from the aforementioned second magnet, whereby a thin toner layer (a first layer) is formed. Now, further description thereof will be made.

Figure 24A:
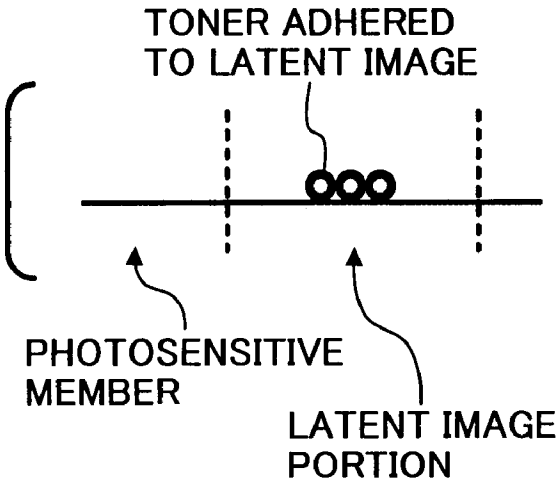
FIGS. 24A-24D are schematic explanatory diagrams for describing toner developing steps according to the present invention.
Figure 24B:
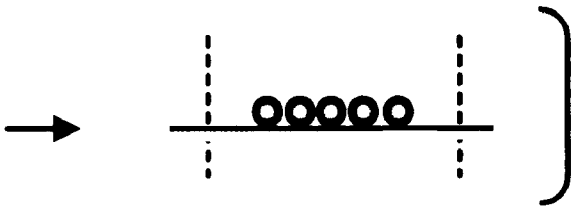
Figure 24C:
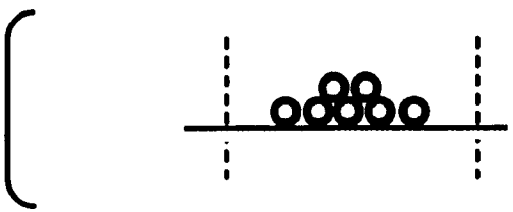
Figure 24D:
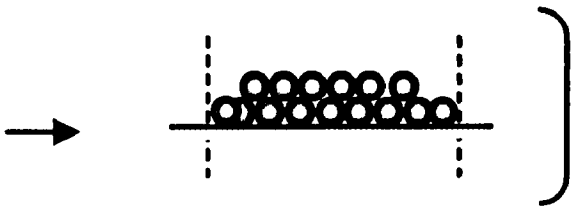

FIGS. 24A through 24D are schematic diagrams each of which shows positions on the latent image portion (the region between the broken lines in the drawing) where the toner particles adhere over time. The FIGS. 24A and 24B show developing in the magnetic chain rising region due to the second magnet MG1*a* (magnetic field distribution P1*a*), and FIGS. 24C and 24D show developing in the magnetic chain rising region due to the first magnet MG1*b* (magnetic field distribution P1*b*).

As shown in FIG. 24A, first, the toner particles adhere to the middle portion of the line-shaped image denoted by "latent image portion" in the width direction (the horizontal direction in the drawing) due to the magnetic chain rising region from the second magnet MG1*a* (magnetic distribution P1*a*), whereby a thin layer (first layer) is formed. Developing is further performed due to the magnetic chain rising region from the second magnet MG1*a* (magnetic field distribution P1*a*) during a predetermined period in time. The amount of the toner forming the aforementioned thin layer (first layer) becomes large during the aforementioned predetermined period in time, as shown in FIG. 24B. However, even in this stage, the toner has not adhered to the edge, or a small amount of the toner has adhered to the edge as compared with the middle portion thereof.

Upon further elapse of time, the aforementioned latent image portion reaches a position facing the magnetic chain rising region from the first magnet MG1*b* (magnetic distribution P1*b*), and the toner particles adhere to the middle portion of the aforementioned thin layer (first layer) in the width direction (the horizontal direction in the drawing) of the line-shaped latent image, whereby a thin layer (second layer) is formed. Developing is further performed due to the magnetic chain rising region from the first magnet MG1*b* (magnetic field distribution P1*b*) during a predetermined period in time. The amount of the toner forming the aforementioned thin layer (second layer) becomes large during the aforementioned predetermined period in time, as shown in FIG. 24D. However, even in the stage wherein developing using the magnetic chain rising region due to the first magnet MG1*b* (magnetic distribution P1*b*) is completed, the edge is developed with small toner adhesion density as compared with the middle portion thereof as shown in FIG 24D.

While description has been made regarding a schematic example wherein the toner layer which has adhered to the photosensitive member 100 is formed of the first layer and second layer, in reality, the toner layer is not formed of the divided first layer and second layer. However, in reality, upon completion of developing, the middle portion of the line-shaped latent image in the width direction is developed with greater toner adhesion density than with the edge thereof in the same way, thereby reducing edge effects, and thereby enabling developing of a line-shaped latent image without edge effects.

On the other hand, with the conventional developing method, as described with reference to FIGS. 1D, 1E, and 1F, the edge of the line-shaped latent image is developed with greater toner thickness than with the middle portion thereof, leading to a problem of edge effects.

According to the embodiment of the present invention, developing of a line-shaped latent image is performed starting from the middle portion thereof in the width direction of the line-shaped latent image, thereby obtaining an image with excellent uniformity in image density at a solid portion without edge effects while suppressing deviation of the horizontal/vertical ratio of portions other than a solid portion.

Developing of a line-shaped latent image is performed starting from the middle portion thereof in the width direction of the line-shaped latent image using free toner, thereby obtaining an image without edge effects.

Free toner is generated in the region at and upstream from the nearest position in the direction for transporting a developing agent, and developing can be performed with excellent efficiency using the generated free toner, thereby obtaining an image with excellent smoothness without edge effects. Also, free toner is generated for developing in the region at and upstream from the nearest position in the direction for transporting a developing agent, thereby obtaining a high-quality image with high image density at a solid portion, and with excellent sharpness of fine lines and characters.

Developing is performed using free toner generated in both the magnetic chain rising regions upstream and downstream from the nearest position. A great amount of free toner is generated in the region between the magnetic chain rising regions formed at a upstream position and a downstream position, and a high electric field is applied to a space where the aforementioned great amount of free toner readily move to, whereby excellent developing is performed.

Also, a speed difference is generated between the developing agent carrying member and the magnets included therein such that the motion of the magnetic brush becomes intense while the magnetic chains are rising, and accordingly, a greater amount of free toner is generated, thereby obtaining a high-quality image with high image density at a solid portion, and further with excellent sharpness of fine lines and characters.

The amount of counter charge generated due to separation of toner is rapidly reduced, thereby preventing edge effects. Also, the developing region using the free toner is extended, and defects in a toner image due to the magnetic carrier are prevented. The free toner is generated in the region containing the nearest position where the highest developing electric field is applied to, developing can be performed using the free toner. The region for generating the free toner can be adjusted by magnetic field generating devices. Also, the toner is separated from the magnetic carrier into free toner. Thus, an image with high image density can be obtained.

According to the embodiment of the present invention, developing is performed using the free toner while applying an electric field. Intense motion of the toner particles, like vibrations, occurs, and accordingly, the toner particles follow the latent image more precisely, thereby obtaining a high-quality image.

Numerous additional modifications and variations of the present invention are possible in light of the above teachings. It is therefore understood that within the scope of the appended claims, the present invention may be practiced other than as specifically described herein.

What is claimed is:

1. A method of developing a latent image including a line-shaped latent image formed on an image carrying member with a two-component developing agent containing a toner and a magnetic carrier, comprising:

carrying the two-component developing agent on a developing agent carrying member, which is disposed facing the image carrying member, in a form of a layer;

causing the magnetic carrier not to contact the image carrying member; and developing the line-shaped latent image with the toner starting from a middle portion of the line-shaped latent image in a width direction of the line-shaped latent image.

2. The method according to claim 1, wherein the developing agent carrying member includes at least one magnetic field generating device that comprises a magnet.

3. A method of developing a latent image including a line-shaped latent image formed on an image carrying member with a two-component developing agent containing a toner and a magnetic carrier, comprising:

preparing a developing agent carrying member facing the image carrying member and including at least one magnetic field generating device to carry the two-component developing agent on the developing agent carrying member in a form of a layer;

forming a magnetic brush including the magnetic carrier holding the toner on the layer of the two-component developing agent at least in a facing region where the developing agent carrying member and the image carrying member face one another and causing the magnetic brush to flow by making a speed difference between the developing agent carrying member and the at least one magnetic field generating device;

separating the toner from the magnetic carrier; and developing the line-shaped latent image with the toner separated from the magnetic carrier starting from a middle portion of the line-shaped latent image in a width direction of the line-shaped latent image.

4. The method according to claim 3, wherein the developing agent carrying member is rotated around the at least one magnetic field generating device in a direction of transporting the two-component developing agent, wherein at least two magnetic chain rising regions formed of magnetic brushes are formed in the facing region, wherein a first magnetic chain rising region of the at least two magnetic chain rising regions is formed by a first magnetic field generating device of the at least one magnetic field generating device, which is disposed at a position nearest to the image carrying member, wherein a second magnetic chain rising region of the at least two magnetic chain rising regions is formed by a second magnetic field generating device of the at least one magnetic field generating device, which is disposed at a position upstream of the first magnetic chain rising region in the direction of transporting the two-component developing agent, and wherein the line-shaped latent image is developed by the second magnetic chain rising region starting from the middle portion of the line-shaped latent image, whereby a first thin toner layer is formed on the line-shaped latent image, and the line-shaped latent image is developed by the first magnetic chain rising region starting from the middle portion of the line-shaped latent image, whereby a second thin toner layer is formed on the first thin toner layer.

5. The method according to claim 4, wherein the at least two magnetic chain rising regions are formed at least at a nearest position in the facing region where the image carrying member and the developing agent carrying member are nearest to each other, and at a position upstream of the nearest position in the direction of transporting the two-component developing agent.

6. The method according to claim 4, wherein the at least two magnetic chain rising regions are formed at least at positions upstream and downstream of a nearest position in the facing region where the image carrying member and the developing agent carrying member are nearest to each other, in the direction of transporting the two-component developing agent.

7. The method according to claim 6, wherein a center line of the first magnetic field generating device is disposed at a position shifted downstream from the nearest position in the direction of transporting the two-component developing agent, and wherein the first magnetic chain rising region is formed at a position downstream of the nearest position in the direction of transporting the two-component developing agent, and the second magnetic chain rising region is formed at a position upstream of the nearest position in the direction of transporting the two-component developing agent.

8. The method according to claim 3, wherein an edge portion of the line-shaped latent image is developed at a position where a tip of the magnetic brush is the nearest to the image carrying member.

9. The method according to claim 3, wherein each speed of the image carrying member and the developing agent carrying member, a gap between the image carrying member and the developing agent carrying member, and a resistance of the magnetic carrier, are adjusted for the developing such that the magnetic carrier passes through the line-shaped latent image after a counter charge generated in the magnetic carrier due to separation of toner decays sufficiently so as not to cause adverse effects on the developing.

10. The method according to claim 3, wherein the toner is separated from the magnetic carrier and becomes free toner when a magnetic chain formed of the magnetic carrier rises in the facing region, and the latent image is developed with the free toner.

11. The method according to claim 3, wherein the magnetic brush does not contact the image carrying member in the facing region.

12. The method according to claim 3, wherein the developing agent carrying member is rotated around the at least one magnetic field generating device in a direction of transporting the two-component developing agent, and wherein a region where the toner is separated from the magnetic carrier is located upstream of a nearest position where the image carrying member and the developing agent carrying member are nearest to each other, in the direction of transporting the two-component developing agent.

13. The method according to claim 3, wherein a region where the toner is separated from the magnetic carrier is a region including a nearest position where the image carrying member and the developing agent carrying member are nearest to each other.

14. The method according to claim 3, wherein the at least one magnetic field generating device adjusts a region where the toner is separated from the magnetic carrier.

15. The method according to claim 3, wherein when a magnetic chain formed of the magnetic carrier rises on the developing agent carrying member, a tip of the magnetic brush is separated from the layer of the two-component developing agent by the at least one magnetic field generating device, and the toner is separated from the magnetic carrier and becomes free toner, and the latent image is developed with the free toner.

16. The method according to claim 3, wherein a ratio of a linear velocity (Vs) of the developing agent carrying member to a linear velocity (Vp) of the image carrying member (Vs/Vp) is greater than 0.9 and less than 4.

17. The method according to claim 3, wherein the latent image is developed with the toner separated from the magnetic carrier in the facing region by applying an electric field to a space between the image carrying member and the developing agent carrying member.

18. The method according to claim 17, wherein an AC electric field is applied to the space between the image carrying member and the developing agent carrying member.

19. The method according to claim 3, wherein the at least one magnetic field generating device comprises a magnet.

20. A developing device that develops a latent image including a line-shaped latent image formed on an image carrying member with a two-component developing agent containing a toner and a magnetic carrier, the developing device comprising:

a developing agent carrying member configured to carry the two-component developing agent in a form of a layer, the developing agent carrying member being disposed facing the image carrying member; and at least one magnetic field generating device configured to generate a magnetic field, the at least one magnetic field generating device being provided in the developing agent carrying member, wherein the magnetic carrier does not contact the image carrying member, and wherein the line-shaped latent image is developed with the toner starting from a middle portion of the line-shaped latent image in a width direction of the line-shaped latent image.

21. The developing device according to claim 20, wherein the at least one magnetic field generating device comprises a magnet.

22. A developing device that develops a latent image including a line-shaped latent image formed on an image carrying member with a two-component developing agent containing a toner and a magnetic carrier, the developing device comprising:

a developing agent carrying member configured to carry the two-component developing agent in a form of a layer, the developing agent carrying member being disposed facing the image carrying member; and at least one magnetic field generating device configured to generate a magnetic field, the at least one magnetic field generating device being provided in the developing agent carrying member, wherein a speed difference is made between the developing agent carrying member and the at least one magnetic field generating device so as to form a magnetic brush including the magnetic carrier holding the toner on the layer of the two-component developing agent at least in a facing region where the developing agent carrying member and the image carrying member face one another and to cause the magnetic brush to flow, wherein the toner is separated from the magnetic carrier in the flow of the magnetic brush, and wherein the line-shaped latent image is developed with the toner separated from the magnetic carrier starting from a middle portion of the line-shaped latent image in a width direction of the line-shaped latent image.

23. The developing device according to claim 22, wherein the developing agent carrying member is rotated around the at least one magnetic field generating device in a direction of transporting the two-component developing agent, wherein at least two magnetic chain rising regions formed of magnetic brushes are formed in the facing region, wherein a first magnetic chain rising region of the at least two magnetic chain rising regions is formed by a first magnetic field generating device of the at least one magnetic field generating device, which is disposed at a position nearest to the image carrying member, wherein a second magnetic chain rising region of the at least two magnetic chain rising regions is formed by a second magnetic field generating device of the at least one magnetic field generating device, which is disposed at a position upstream of the first magnetic chain rising region in the direction of transporting the two-component developing agent, and wherein the line-shaped latent image is developed by the second magnetic chain rising region starting from the middle portion of the line-shaped latent image, whereby a first thin toner layer is formed on the line-shaped latent image, and the line-shaped latent image is developed by the first magnetic chain rising region starting from the middle portion of the line-shaped latent image, whereby a second thin toner layer is formed on the first thin toner layer.

24. The developing device according to claim 23, wherein the at least two magnetic chain rising regions are formed at least at a nearest position in the facing region where the image carrying member and the developing agent carrying member are nearest to each other, and at a position upstream of the nearest position in the direction of transporting the two-component developing agent.

25. The developing device according to claim 23, wherein the at least two magnetic chain rising regions are formed at least at positions upstream and downstream of a nearest position in the facing region where the image carrying member and the developing agent carrying member are nearest to each other, in the direction of transporting the two-component developing agent.

26. The developing device according to claim 25, wherein a center line of the first magnetic field generating device is disposed at a position shifted downstream from the nearest position in the direction of transporting the two-component developing agent, and wherein the first magnetic chain rising region is formed at a position downstream of the nearest position in the direction of transporting the two-component developing agent, and the second magnetic chain rising region is formed at a position upstream of the nearest position in the direction of transporting the two-component developing agent.

27. The developing device according to claim 22, wherein an edge portion of the line-shaped latent image is developed at a position where a tip of the magnetic brush is the nearest to the image carrying member.

28. The developing device according to claim 22, wherein each speed of the image carrying member and the developing agent carrying member, a gap between the image carrying member and the developing agent carrying member, and a resistance of the magnetic carrier, are adjusted for the developing such that the magnetic carrier passes through the line-shaped latent image after a counter charge generated in the magnetic carrier due to separation of toner decays sufficiently so as not to cause adverse effects on the developing.

29. The developing device according to claim 22, wherein the toner is separated from the magnetic carrier and becomes free toner when a magnetic chain formed of the magnetic carrier rises in the facing region, and the latent image is developed with the free toner.

30. The developing device according to claim 22, wherein the magnetic brush does not contact the image carrying member in the facing region.

31. The developing device according to claim 22, wherein the developing agent carrying member is rotated around the at least one magnetic field generating device in a direction of transporting the two-component developing agent, and wherein a region where the toner is separated from the magnetic carrier is located upstream of a nearest position where the image carrying member and the developing agent carrying member are nearest to each other, in the direction of transporting the two-component developing agent.

32. The developing device according to claim 22, wherein a region where the toner is separated from the magnetic carrier is a region including a nearest position where the image carrying member and the developing agent carrying member are nearest to each other.

33. The developing device according to claim 22, wherein the at least one magnetic field generating device adjusts a region where the toner is separated from the magnetic carrier.

34. The developing device according to claim 22, wherein when a magnetic chain formed of the magnetic carrier rises on the developing agent carrying member, a tip of the magnetic brush is separated from the layer of the two-component developing agent by the at least one magnetic field generating device, and the toner is separated from the magnetic carrier and becomes free toner, and the latent image is developed with the free toner.

35. The developing device according to claim 22, wherein a ratio of a linear velocity (Vs) of the developing agent carrying member to a linear velocity (Vp) of the image carrying member (Vs/Vp) is greater than 0.9 and less than 4.

36. The developing device according to claim 22, wherein the latent image is developed with the toner separated from the magnetic carrier in the facing region by applying an electric field to a space between the image carrying member and the developing agent carrying member.

37. The developing device according to claim 36, wherein an AC electric field is applied to the space between the image carrying member and the developing agent carrying member.

38. The developing device according to claim 22, wherein the at least one magnetic field generating device comprises a magnet.

39. An image forming apparatus, comprising:

an image carrying member configured to carry a latent image including a line-shaped latent image; and a developing device configured to develop the latent image carried on the image carrying member with a two-component developing agent containing a toner and a magnetic carrier, the developing device comprising:

a developing agent carrying member configured to carry the two-component developing agent in a form of a layer, the developing agent carrying member being disposed facing the image carrying member; and at least one magnetic field generating device configured to generate a magnetic field, the at least one magnetic field generating device being provided in the developing agent carrying member, wherein the magnetic carrier does not contact the image carrying member, and wherein the line-shaped latent image is developed with the toner starting from a middle portion of the line-shaped latent image in a width direction of the line-shaped latent image.

40. The image forming apparatus according to claim 39, wherein the at least one magnetic field generating device comprises a magnet.

41. An image forming apparatus, comprising:

an image carrying member configured to carry a latent image including a line-shaped latent image; and a developing device configured to develop the latent image carried on the image carrying member with a two-component developing agent containing a toner and a magnetic carrier, the developing device comprising:

a developing agent carrying member configured to carry the two-component developing agent in a form of a layer, the developing agent carrying member being disposed facing the image carrying member; and at least one magnetic field generating device configured to generate a magnetic field, the at least one magnetic field generating device being provided in the developing agent carrying member, wherein a speed difference is made between the developing agent carrying member and the at least one magnetic field generating device so as to form a magnetic brush including the magnetic carrier holding the toner on the layer of the two-component developing agent at least in a facing region where the developing agent carrying member and the image carrying member face one another and to cause the magnetic brush to flow, wherein the toner is separated from the magnetic carrier in the flow of the magnetic brush, and wherein the line-shaped latent image is developed with the toner separated from the magnetic carrier starting from a middle portion of the line-shaped latent image in a width direction of the line-shaped latent image.

42. The image forming apparatus according to claim 41, wherein the developing agent carrying member is rotated around the at least one magnetic field generating device in a direction of transporting the two-component developing agent, wherein at least two magnetic chain rising regions formed of magnetic brushes are formed in the facing region, wherein a first magnetic chain rising region of the at least two magnetic chain rising regions is formed by a first magnetic field generating device of the at least one magnetic field generating device, which is disposed at a position nearest to the image carrying member, wherein a second magnetic chain rising region of the at least two magnetic chain rising regions is formed by a second magnetic field generating device of the at least one magnetic field generating device, which is disposed at a position upstream of the first magnetic chain rising region in the direction of transporting the two-component developing agent, and wherein the line-shaped latent image is developed by the second magnetic chain rising region starting from the middle portion of the line-shaped latent image, whereby a first thin toner layer is formed on the line-shaped latent image, and the line-shaped latent image is developed by the first magnetic chain rising region starting from the middle portion of the line-shaped latent image, whereby a second thin toner layer is formed on the first thin toner layer.

43. The image forming apparatus according to claim 42, wherein the at least two magnetic chain rising regions are formed at least at a nearest position in the facing region where the image carrying member and the developing agent carrying member are nearest to each other, and at a position upstream of the nearest position in the direction of transporting the two-component developing agent.

44. The image forming apparatus according to claim 42, wherein the at least two magnetic chain rising regions are formed at least at positions upstream and downstream of a nearest position in the facing region where the image carrying member and the developing agent carrying member are nearest to each other, in the direction of transporting the two-component developing agent.

45. The image forming apparatus according to claim 44, wherein a center line of the first magnetic field generating device is disposed at a position shifted downstream from the nearest position in the direction of transporting the two-component developing agent, and wherein the first magnetic chain rising region is formed at a position downstream of the nearest position in the direction of transporting the two-component developing agent, and the second magnetic chain rising region is formed at a position upstream of the nearest position in the direction of transporting the two-component developing agent.

46. The image forming apparatus according to claim 41, wherein an edge portion of the line-shaped latent image is developed at a position where a tip of the magnetic brush is the nearest to the image carrying member.

47. The image forming apparatus according to claim 41, wherein each speed of the image carrying member and the developing agent carrying member, a gap between the image carrying member and the developing agent carrying member, and a resistance of the magnetic carrier, are adjusted for the developing such that the magnetic carrier passes through the line-shaped latent image after a counter charge generated in the magnetic carrier due to separation of toner decays sufficiently so as not to cause adverse effects on the developing.

48. The image forming apparatus according to claim 41, wherein the toner is separated from the magnetic carrier and becomes free toner when a magnetic chain formed of the magnetic carrier rises in the facing region, and the latent image is developed with the free toner.

49. The image forming apparatus according to claim 41, wherein the magnetic brush does not contact the image carrying member in the facing region.

50. The image forming apparatus according to claim 41, wherein the developing agent carrying member is rotated around the at least one magnetic field generating device in a direction of transporting the two-component developing agent, and wherein a region where the toner is separated from the magnetic carrier is located upstream of a nearest position where the image carrying member and the developing agent carrying member are nearest to each other, in the direction of transporting the two-component developing agent.

51. The image forming apparatus according to claim 41, wherein a region where the toner is separated from the magnetic carrier is a region including a nearest position where the image carrying member and the developing agent carrying member are nearest to each other.

52. The image forming apparatus according to claim 41, wherein the at least one magnetic field generating device adjusts a region where the toner is separated from the magnetic carrier.

53. The image forming apparatus according to claim 41, wherein when a magnetic chain formed of the magnetic carrier rises on the developing agent carrying member, a tip of the magnetic brush is separated from the layer of the two-component developing agent by the at least one magnetic field generating device, and the toner is separated from the magnetic carrier and becomes free toner, and the latent image is developed with the free toner.

54. The image forming apparatus according to claim 41, wherein a ratio of a linear velocity (Vs) of the developing agent carrying member to a linear velocity (Vp) of the image carrying member (Vs/Vp) is greater than 0.9 and less than 4.

55. The image forming apparatus according to claim 41, wherein the latent image is developed with the toner separated from the magnetic carrier in the facing region by applying an electric field to a space between the image carrying member and the developing agent carrying member.

56. The image forming apparatus according to claim 55, wherein an AC electric field is applied to the space between the image carrying member and the developing agent carrying member.

57. The image forming apparatus according to claim 41, wherein the at least one magnetic field generating device comprises a magnet.

58. A developing device that develops a latent image including a line-shaped latent image formed on an image carrying member with a two-component developing agent containing a toner and a magnetic carrier, the developing device comprising:

developing agent carrying means for carrying the two-component developing agent in a form of a layer, the developing agent carrying means being disposed facing the image carrying member; and magnetic field generating means for generating a magnetic field, the magnetic field generating means being provided in the developing agent carrying means, wherein the magnetic carrier does not contact the image carrying member, and wherein the line-shaped latent image is developed with the toner starting from a middle portion of the line-shaped latent image in a width direction of the line-shaped latent image.

59. A developing device that develops a latent image including a line-shaped latent image formed on an image carrying member with a two-component developing agent containing a toner and a magnetic carrier, the developing device comprising:

developing agent carrying means for carrying the two-component developing agent in a form of a layer, the developing agent carrying means being disposed facing the image carrying member; and magnetic field generating means for generating a magnetic field, the magnetic field generating means being provided in the developing agent carrying means, wherein a speed difference is made between the developing agent carrying means and the magnetic field generating means so as to form a magnetic brush including the magnetic carrier holding the toner on the layer of the two-component developing agent at least in a facing region where the developing agent carrying means and the image carrying member face one another and to cause the magnetic brush to flow, wherein the toner is separated from the magnetic carrier in the flow of the magnetic brush, and wherein the line-shaped latent image is developed with the toner separated from the magnetic carrier starting from a middle portion of the line-shaped latent image in a width direction of the line-shaped latent image.

60. An image forming apparatus, comprising:

image carrying means for carrying a latent image including a line-shaped latent image; and a developing device configured to develop the latent image carried on the image carrying means with a two-component developing agent containing a toner and a magnetic carrier, the developing device comprising:

developing agent carrying means for carrying the two-component developing agent in a form of a layer, the developing agent carrying means being disposed facing the image carrying means; and magnetic field generating means for generating a magnetic field, the magnetic field generating means being provided in the developing agent carrying means, wherein the magnetic carrier does not contact the image carrying means, and wherein the line-shaped latent image is developed with the toner starting from a middle portion of the line-shaped latent image in a width direction of the line-shaped latent image.

61. An image forming apparatus, comprising:

image carrying means for carrying a latent image including a line-shaped latent image; and a developing device configured to develop the latent image carried on the image carrying means with a two-component developing agent containing a toner and a magnetic carrier, the developing device comprising:

developing agent carrying means for carrying the two-component developing agent in a form of a layer, the developing agent carrying means being disposed facing the image carrying means; and magnetic field generating means for generating a magnetic field, the magnetic field generating means being provided in the developing agent carrying means, wherein a speed difference is made between the developing agent carrying means and the magnetic field generating means so as to form a magnetic brush including the magnetic carrier holding the toner on the layer of the two-component developing agent at least in a facing region where the developing agent carrying means and the image carrying means face one another and to cause the magnetic brush to flow, wherein the toner is separated from the magnetic carrier in the flow of the magnetic brush, and wherein the line-shaped latent image is developed with the toner separated from the magnetic carrier starting from a middle portion of the line-shaped latent image in a width direction of the line-shaped latent image.

* * * * *